US008796193B2

(12) United States Patent
Tagawa et al.

(10) Patent No.: US 8,796,193 B2
(45) **Date of Patent: *Aug. 5, 2014**

(54) REFRIGERATING MACHINE OIL COMPOSITIONS

(75) Inventors: Kazuo Tagawa, Yokohama (JP); Yuji Shimomura, Yokohama (JP); Toshiyuki Obata, Yokohama (JP); Katsuya Takigawa, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 836 days.

This patent is subject to a terminal disclaimer.

(21) Appl. No.: 10/566,494

(22) PCT Filed: Jul. 29, 2004

(86) PCT No.: PCT/JP2004/010827

§ 371 (c)(1),
(2), (4) Date: Aug. 29, 2006

(87) PCT Pub. No.: WO2005/012467

PCT Pub. Date: Feb. 10, 2005

(65) Prior Publication Data

US 2007/0155635 A1 Jul. 5, 2007

(30) Foreign Application Priority Data

Aug. 1, 2003 (JP) ..... P2003-285401
Mar. 31, 2004 (JP) ..... P2004-105417

(51) Int. Cl.
*C10M 105/34* (2006.01)
*C10M 105/38* (2006.01)
*C09K 5/00* (2006.01)

(52) U.S. Cl.
USPC ..... 508/459; 508/463; 252/68

(58) Field of Classification Search
USPC ..... 508/459, 463; 252/68
See application file for complete search history.

(56) References Cited

U.S. PATENT DOCUMENTS

| | | | | |
|---|---|---|---|---|
| 3,629,114 | A * | 12/1971 | Fairing | 508/440 |
| 4,199,461 | A | 4/1980 | Olund | |
| 5,342,533 | A | 8/1994 | Kondo et al. | |
| 5,370,809 | A * | 12/1994 | Ishida et al. | 508/304 |
| 5,403,503 | A * | 4/1995 | Seiki et al. | 508/440 |
| 5,547,593 | A * | 8/1996 | Sanechika et al. | 508/207 |
| 5,728,655 | A | 3/1998 | Muraki et al. | |
| 6,221,274 | B1 | 4/2001 | Akahori et al. | |
| 6,228,282 | B1 * | 5/2001 | Shimomura et al. | 252/68 |
| 6,548,457 | B1 * | 4/2003 | Kaimai et al. | 508/280 |
| 7,595,286 | B2 * | 9/2009 | Yokota et al. | 508/199 |
| 2001/0011716 | A1 * | 8/2001 | Kaneko et al. | 252/68 |
| 2002/0013233 | A1 * | 1/2002 | Corr et al. | 508/405 |
| 2002/0123436 | A1 * | 9/2002 | Osumi et al. | 508/462 |
| 2003/0125219 | A1 * | 7/2003 | Tazaki et al. | 508/422 |
| 2004/0198617 | A1 * | 10/2004 | Kinoshita et al. | 508/527 |
| 2007/0032391 | A1 | 2/2007 | Tagawa et al. | |

FOREIGN PATENT DOCUMENTS

| | | | |
|---|---|---|---|
| CN | 1136586 | | 11/1996 |
| CN | 1349555 | A | 5/2002 |
| EP | 1 225 213 | | 7/2002 |
| JP | 53-104608 | | 9/1978 |
| JP | 55-149394 | | 11/1980 |
| JP | 62-292895 | | 12/1987 |
| JP | 2-158693 | | 6/1990 |
| JP | H0324197 | A | 2/1991 |
| JP | 3-128992 | | 5/1991 |
| JP | 3-200895 | | 9/1991 |
| JP | 03-505602 | | 12/1991 |
| JP | 5-59386 | | 3/1993 |
| JP | H0617078 | A | 1/1994 |
| JP | H06228584 | A | 8/1994 |
| JP | 06-313180 | | 11/1994 |
| JP | 06-100882 | | 12/1994 |
| JP | H0711277 | A | 1/1995 |
| JP | 08-48990 | | 2/1996 |
| JP | 08-157847 | | 6/1996 |
| JP | 08-209182 | | 8/1996 |
| JP | 08-337786 | | 12/1996 |
| JP | 09-157676 | | 6/1997 |
| JP | 09-302372 | | 11/1997 |

(Continued)

OTHER PUBLICATIONS

International Search Report, Oct. 22, 2004.
International Search Report dated Oct. 21, 2004 of PCT JP 2004/010840 cited in the copending U.S. Appl. No. 10/565,739.
Japanese Office Action dated Mar. 15, 2011.
Thai Office Action dated May 26, 2011.
Office Action for JP Application No. P2005-512513 dated Mar. 13, 2012.

(Continued)

*Primary Examiner* — Vishal Vasisth
(74) *Attorney, Agent, or Firm* — Finnegan, Henderson, Farabow, Garrett & Dunner, LLP

(57) ABSTRACT

The first refrigerating machine oil composition of the invention comprises a predetermined base oil, and at least one ester additive selected from esters of a monobasic fatty acid having 12 or more carbon atoms and a monohydric alcohol having 1-24 carbon atoms, and an ester of a chain-like dibasic acid and a monohydric alcohol. The second refrigerating machine oil composition of the invention comprises a predetermined base oil, and at least one oxygen-containing compound selected from the following (A1)-(A6). The third refrigerating machine oil composition of the invention comprises a predetermined base oil, and at least one oxygen-containing compound selected from the following (A1), (A2), (A4), (A7) and (A8).

(A1) Alkylene oxide adduct of a polyhydric alcohol having 3-6 hydroxyl groups
(A2) Polyalkylene glycol
(A3) Trihydric alcohol having 3-20 carbon atoms apart from (A1)
(A4) Dihydric alcohol having 2-20 carbon atoms apart from (A2)
(A5) Hydrocarbyl ether of (A1)-(A4)
(A6) Hydrocarbyl ester of (A1)-(A4)
(A7) Hydrocarbyl ether of (A1), (A2) or (A4)
(A7) Hydrocarbyl ester of (A1), (A2) or (A4).

12 Claims, No Drawings

(56) References Cited

FOREIGN PATENT DOCUMENTS

| | | | |
|---|---|---|---|
| JP | 9-310086 | | 12/1997 |
| JP | 10-001689 | | 1/1998 |
| JP | 10-168479 | | 6/1998 |
| JP | 10-505623 | | 6/1998 |
| JP | 2000-17282 | A | 1/2000 |
| JP | 2000-256692 | | 9/2000 |
| JP | 2002-38175 | | 2/2002 |
| JP | 2002-097486 | | 4/2002 |
| JP | 2002-129178 | A | 5/2002 |
| JP | 2002-194366 | | 7/2002 |
| JP | 2002-235664 | | 8/2002 |
| JP | 2003-96481 | | 4/2003 |
| WF | WO 96/07721 | | 3/1996 |
| WO | WO 91/09097 | | 6/1991 |
| WO | WO 00/68345 | A1 | 11/2000 |
| WO | WO/01-02519 | | 1/2001 |
| WO | WO 01/48127 | A1 | 7/2001 |

OTHER PUBLICATIONS

Office Action for CN Application No. 200710148291.9 dated May 11, 2012.

JP Office Action for Application No. P2010-190935 dated Sep. 24, 2013.

JP Office Action for Application No. P2010-146879 dated Dec. 11, 2012.

Yugui, MA, "The Collection of Hydraulic Components Use and Repair Technology," Chinese building materials industry publication, vol. 1, Jan. 1995, p. 17.

* cited by examiner

REFRIGERATING MACHINE OIL COMPOSITIONS

CROSS REFERENCE TO RELATED APPLICATIONS

This application is a national phase application based on PCT/JP2004/010827, filed Jul. 29, 2004, the content of which is incorporated herein by reference, and claims the right to priority based on Japanese Application No. JP 2003-285401, filed Aug. 1, 2003 and Japanese Application No. JP 2004-105417, filed Mar. 31, 2004.

TECHNICAL FIELD

The present invention relates to a refrigerating machine oil composition.

BACKGROUND ART

Now that alternative refrigerants for ozone-depleting fluorons are being discussed based on the Montreal Protocol, attention is turning towards refrigerating machine oils suitable for the alternative refrigerants. For example, synthetic oils for use with hydrofluorocarbons (HFC) are known such as polyol esters and ethers which are compatible with HFC refrigerants (e.g., Patent documents 1-3).

[Patent document 1] JP-A H03-505602
[Patent document 2] JP-A H03-128992
[Patent document 3] JP-A H03-200895

DISCLOSURE OF THE INVENTION

However, when the aforesaid prior art refrigerating machine oils including oxygen-containing synthetic oils were used, since the lubricating properties of the refrigerating machine oil itself were lower than those of a mineral oil type refrigerating machine oil, and the lubricating properties of the alternative refrigerant used together with it were also lower than those of an ozone-depleting fluoron, the operation of the refrigerating machine tended to become unstable and the lifetime of the device was shortened.

The Inventors therefore considered ways of improving the frictional properties of refrigerating machine oil compositions by using an oily agent. However, sufficient frictional property improvement was not obtained even if an oily agent such as a monohydric alcohol or an acid which had been used conventionally, was added to the refrigerating machine oil composition. Moreover, in addition to the fact that sufficient improvement of the original properties was not obtained, there was a decrease of thermal/oxidation stability of the refrigerating machine oil composition and deposits occurred in the refrigerant atmosphere at low temperatures.

It is therefore an object of the present invention, which was conceived in view of the above situation, to provide a refrigerating machine oil composition having superior lubricant properties in refrigerating/air conditioning devices using refrigerants such as HFC which will permit stable operation of the refrigerating machine over long periods of time.

In order to resolve the above problems, a first refrigerating machine oil composition according to the invention comprises a predetermined base oil, and at least one ester additive selected from monoesters of a monobasic fatty acid having 12 or more carbon atoms and a monohydric alcohol having 1-24 carbon atoms, and esters of a chain-like dibasic acid and a monohydric alcohol.

In the first refrigerating machine oil composition of the invention, by using at least one ester additive selected from monoesters of a monobasic fatty acid having 12 or more carbon atoms and a monohydric alcohol having 1-24 carbon atoms, and esters of a chain-like dibasic acid and a monohydric alcohol, the frictional properties of the refrigerating machine oil composition are considerably improved while maintaining thermal/oxidation stability of the refrigerating machine oil composition and effectively preventing deposition in the refrigerant atmosphere at low temperature. This therefore makes it possible to operate the refrigerating/air conditioning devices stably over a long period of time even when used with various refrigerants such as HFC.

Moreover, since the frictional property improvement due to the first refrigerating machine oil composition of the invention may contribute to higher energy efficiency of refrigerating/air conditioning devices, it is very useful from the viewpoint of energy saving and reducing the manufacturing cost of refrigerating/air conditioning devices. In prior art refrigerating/air conditioning devices, sufficient consideration was not given to reducing the friction of the refrigerating machine oil, and since it was feared that there would be an adverse impact due to the use of a refrigerating machine oil, attempts were made to improve frictional properties by improving hardware such as compressors. Hence, according to the first refrigerating machine oil composition of the invention, since the sliding load inside the compressor is considerably decreased by superior frictional properties, the energy efficiency of the refrigerating machine can be increased even if hardware such as the compressor and heat exchanger are not improved. Moreover, by combining the first refrigerating machine oil composition of the invention with a compressor having better frictional properties, the energy efficiency can be remarkably improved.

A second refrigerating machine oil composition according to the invention comprises a predetermined base oil and at least one kind of oxygen-containing substance selected from the following (A1)-(A6):

(A1) Alkylene oxide adduct of a polyhydric alcohol having 3-6 hydroxyl groups.
(A2) Polyalkylene glycol
(A3) Trihydric alcohol having 3-20 carbon atoms apart from (A1)
(A4) Dihydric alcohol having 2-20 carbon atoms apart from (A2)
(A5) Hydrocarbyl ethers of (A1)-(A4)
(A6) Hydrocarbyl ethers of (A1)-(A4)

Since the second refrigerating machine oil composition of the invention contains at least one type of oxygen-containing compound selected from (A1)-(A6) (hereafter, these oxygen-containing compounds will be referred to as ingredients (A1)-(A6)) in a predetermined base oil, frictional properties, abrasion resistance and stability can both be considerably enhanced in a balanced manner. Therefore, according to the second refrigerating machine oil composition of the invention, both energy-saving and increased lifetime of a refrigerating machine can be realized. In particular, the second refrigerating machine oil composition of the invention has even better abrasion resistance than the first refrigerating machine oil composition of the invention.

A third refrigerating machine oil composition of the invention comprises a predetermined base oil, and at least one type of oxygen-containing compound selected from the following (A1), (A2), (A4), (A7) and (A8).

(A1) Alkylene oxide adduct of polyhydric alcohol having 3-6 hydroxyl groups
(A2) Polyalkylene glycol (A4) Dihydric alcohol having 2-20 carbon atoms apart from (A2)

(A7) Hydrocarbyl ether of (A1), (A2) or (A4)

(A8) Hydrocarbyl ester of (A1), (A2) or (A4).

Since the third refrigerating machine oil composition of the invention comprises at least one of oxygen-containing compound selected from (A1), (A2), (A4), (A7) and (A8) (hereafter, these oxygen-containing compounds will be referred to as ingredients (A1), (A2), (A4), (A7) and (A8)) in a predetermined base oil, frictional properties, abrasion resistance and stability can both be considerably enhanced in a balanced manner. Therefore, both energy-saving and increased lifetime of refrigerating machines can be realized with the second refrigerating machine oil composition of the invention. In particular, the second refrigerating machine oil composition of the invention has even better abrasion resistance than the first refrigerating machine oil composition of the invention.

According to the invention, there is provided a refrigerating machine oil composition having superior lubricating properties in refrigerating/air conditioning devices using various types of refrigerant such as HFC, and which permits stable operation of refrigerating/air conditioning devices over a long period of time.

BEST MODES FOR CARRYING OUT THE INVENTION

Hereafter, the invention will be described in further detail referring to specific examples.

The base oil of the first, second and third refrigerating machine oil compositions of the invention may be a mineral oil, a synthetic oil, or a mixture of a mineral oil and synthetic oil.

The mineral oil may be for example a paraffinic or a naphthenic mineral oil obtained by applying one, two or more refining means such as solvent deasphalting, solvent extraction, hydrocracking, solvent dewaxing, catalytic dewaxing, hydrotreatment, sulfuric acid treatment or clay treatment to the lubricating oil distillation fraction obtained by atmospheric distillation or vacuum distillation of paraffin base crude oil, intermediate base crude oil or naphthene base crude oil.

Among these mineral oils, highly refined mineral oil (hereafter, "ultra-pure mineral oil") is preferably used since it has better thermal stability. Specific examples of ultra-pure mineral oil include the refined oils obtained by purifying, according to the normal methods, the distilled oils obtained by atmospheric distillation of paraffin base crude oil, intermediate base crude oil or naphthene base crude oil, or vacuum distillation of the residual oil from atmospheric distillation; deep dewaxing oil obtained by deep dewaxing after purification; and hydrotreated oil obtained by hydrotreatment.

The refining technique in the aforesaid refining process is not particularly limited and any known method may be used, e.g., any one of (a) hydrotreatment, (b) dewaxing (solvent dewaxing or hydration dewaxing), (c) solvent extraction, (d) alkali purification or sulfuric acid purification, or (e) clay treatment can be used alone; or two or more can be combined in a suitable order. It is also effective to split any of the above treatment (a)-(e) into plural steps and repeat them. More specifically, these methods are (i) hydrotreatment of distilled oil, or hydrotreatment followed by alkali purification or sulfuric acid purification; (ii) hydrogenation treatment of distilled oil followed by dewaxing; (iii) solvent extraction of distilled oil followed by hydrogenation treatment; (iv) two-step or three-step hydrotreatment of distilled oil, optionally followed by alkali purification or sulfuric acid purification; and (v) the aforesaid (i)-(iv), followed by repeat dewaxing treatment to obtain a deep dewaxed oil.

Among the ultra-pure mineral oils obtained by the aforesaid refining methods, naphthene-type mineral oil and the mineral oil obtained by deep dewaxing treatment are preferred from the viewpoint of low temperature fluidity, and the fact that there is no wax deposition at low temperature. This deep dewaxing treatment is normally performed by solvent dewaxing under rigorous conditions, or by catalytic dewaxing treatment using a zeolite catalyst.

Also, the non-aromatic unsaturated fraction (degree of unsaturation) of these ultra-pure mineral oils is preferably 10 mass % or less, more preferably 5 mass % or less, still more preferably 1 mass % or less and most preferably 0.1 mass % or less. If the non-aromatic unsaturated fraction exceeds 10 mass %, sludge develops more easily, and as a result, expansion mechanisms such as capillaries forming the refrigerant recirculation system tend to become clogged.

The synthetic oil used in the invention may be a hydrocarbon oil such as an olefin polymer, naphthalene compound or alkyl benzene; or an oxygen-containing synthetic oil such as an ester, polyalkylene glycol, polyvinyl ether, ketone, polyphenyl ether, silicone, polysiloxane and perfluoroether.

Examples of an olefin polymer are substances obtained by polymerizing an olefin having 2-12 carbon atoms and substances obtained by hydrotreatment of the compounds obtained by this polymerization, such as polybutene, polyisobutene, oligomers of α-olefins having 5-12 carbon atoms (poly-α-olefins), ethylene-propylene copolymer and the substances obtained by hydrotreatment thereof.

The method of manufacturing the olefin polymer is not particularly limited, and may be any of the various methods known in the art. For example, a poly-α-olefin can be manufactured using the α-olefin manufactured from ethylene as starting material, and treating it by a polymerization method known in the art such as the Ziegler catalyst method, radical polymerization method, aluminum chloride method or the boron fluoride method.

The naphthalene compound is not particularly limited provided that it has a naphthalene skeleton, but from the viewpoint of miscibility with the solvent, compounds having 1-4 alkyl groups with 1-10 carbon atoms wherein the total number of carbon atoms in the alkyl groups is 1-10 are preferred, and compounds having 1-3 alkyl groups with 1-8 carbon atoms wherein the total number of carbon atoms in the alkyl groups is 3-8, are more preferred.

Specific examples of an alkyl group with 1-10 carbon atoms in the naphthalene compound are methyl, ethyl, n-propyl, isopropyl, straight-chain or branched butyl, straight-chain or branched pentyl, straight-chain or branched hexyl, straight-chain or branched heptyl, straight-chain or branched octyl, straight-chain or branched nonyl, and straight-chain or branched decyl.

If a naphthalene compound is used, a compound having a single structure may be used alone, or two or more compounds having different structures can be used together.

The method of manufacturing the naphthalene compound is not particularly limited, and various methods known in the art can be used. Examples of this method are to add a halogen compound of a hydrocarbon having 1-10 carbon atoms, an olefin having 2-10 carbon atoms or a styrene compound having 8-10 carbon atoms to naphthalene in the presence of a catalyst which is a mineral acid such as sulfuric acid, phosphoric acid, silicotungstic acid or hydrogen fluoride, a solid acidic substance such as acid clay or active clay, or a Friedel-Crafts catalyst which is a metal halide such as aluminum chloride or zinc chloride.

The alkyl benzene of the invention is not particularly limited, but from the viewpoint of excellent miscibility with the refrigerant, a compound having 1-4 alkyl groups with 1-40 carbon atoms wherein the total number of carbon atoms in the alkyl groups is 1-40 is preferred, and a compound having 1-4 alkyl groups with 1-30 carbon atoms wherein the total number of carbon atoms in the alkyl groups is 3-30, is more preferred.

Examples of an alkyl group having 1-40 carbon atoms in the alkyl benzene are methyl, ethyl, n-propyl, isopropyl, straight-chain or branched butyl, straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched heptadecyl, straight-chain or branched octadecyl, straight-chain or branched nonadecyl, straight-chain or branched icosyl, straight-chain or branched henicosyl, straight-chain or branched docosyl, straight-chain or branched tricosyl, straight-chain or branched tetracosyl, straight-chain or branched pentacosyl, straight-chain or branched hexacosyl, straight-chain or branched heptacosyl, straight-chain or branched octacosyl, straight-chain or branched nonacosyl, straight-chain or branched triacontyl, straight-chain or branched hentriacontyl, straight-chain or branched dotriacontyl, straight-chain or branched tritriacontyl, straight-chain or branched tetratriacontyl, straight-chain or branched pentatriacontyl, straight-chain or branched hexatriacontyl, straight-chain or branched heptatriacontyl, straight-chain or branched octatriacontyl, straight-chain or branched nonatriaconyl, or straight-chain or branched tetracontyl (including all isomers thereof).

These alkyl groups may be straight-chain or branched, but from the viewpoint of compatibility with the organic materials used in the refrigerant recirculation system, straight-chain alkyl groups are preferred. On the other hand, from the viewpoint of refrigerant miscibility, thermal stability and lubricating properties, branched alkyl groups are preferred, and from the viewpoint of ease of acquisition, branched alkyl groups derived from oligomers of olefins such as propylene, butene and isobutylene are more preferred.

If an alkyl benzene is used, a compound having a single structure may be used alone, or two or more compounds having different structures may be used together.

The method of manufacturing this alkyl benzene may be any desired method and is not limited in any way, but for example, it can be produced by the following synthetic methods.

Examples of an aromatic compound used as starting material are benzene, toluene, xylene, ethyl benzene, methylethyl benzene, diethyl benzene and mixtures thereof. The alkylating agent may be a straight-chain or branched olefin having 6-40 carbon atoms obtained by polymerization of a lower monoolefin such as ethylene, propylene, butene or isobutylene (preferably propylene); a straight-chain or branched olefin having 6-40 carbon atoms obtained by thermal decomposition of wax, heavy oil, petroleum distillate, polyethylene or polypropylene; a straight-chain olefin having 9-40 carbon atoms obtained by separating n-paraffin from a petroleum distillate such as coal oil, light oil and olefinating it by a catalyst, and mixtures thereof.

When the aforesaid aromatic compound and alkylating agent are reacted together, an alkylating catalyst known in the art, e.g. a Friedel-Crafts catalyst such as aluminum chloride or zinc chloride, or an acidic catalyst such as sulfuric acid, silicotungstic acid, hydrogen fluoride or acidic catalyst such as active cray may be used.

Examples of an ester are an aromatic ester, dibasic acid ester, polyol ester, complex ester, carbonic acid ester and mixtures thereof.

This aromatic ester is preferably an ester of an aromatic carboxylic acid having a basicity of 1-6, preferably 1-4 and more preferably 1-3, and an aliphatic alcohol having 1-18 but preferably 1-12 carbon atoms. The aromatic carboxylic acid having a basicity of 1-6 may be for example benzoic acid, phthalic acid, isophthalic acid, terephthalic acid, trimellitic acid, pyromellitic acid and mixtures thereof. The aliphatic alcohol having 1-18 carbon atoms may be straight-chain or branched, specifically methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, heptadecanol, straight-chain or branched octadecanol, and mixtures thereof.

The aromatic ester obtained by using this aromatic compound and aliphatic alcohol may be for example dibutyl phthalate, di(2-ethylhexyl) phthalate, dinonyl phthalate, didecyl phthalate, didodecyl phthalate, ditridecyl phthalate, tributyl trimellitate, tri(2-ethylhexyl) trimellitate, trinonyl trimellitate, tridecyl trimellitate, tridodecyl trimellitate and tritridecyl trimellitate. When an aromatic carboxylic acid having a basicity of 2 or more is used, the ester may of course be a simple ester of one aliphatic alcohol, or a complex ester of two or more aliphatic alcohols.

The dibasic acid ester is preferably an ester of a straight-chain or alicyclic dibasic acid having 5-10 carbon atoms such as glutaric acid, adipic acid, pimelic acid, subaric acid, azelaic acid, sebacic acid, 1,2-cyclohexane dicarboxylic acid or 4-cyclohexene-1,2-dicarboxylic acid with a straight-chain or branched monohydric alcohol having 1-15 carbon atoms such as methanol, ethanol, propanol, butanol, pentanol, hexanol, heptanol, octanol, nonanol, decanol, undecanol, dodecanol, tridecanol, tetradecanol or pentadecanol, or mixtures thereof, but more specifically ditridecyl glutarate, di-2-ethylhexyl adipate, diisodecyl adipate, ditridecyl adipate, di-2-ethylhexyl sebacate, a diester of 1,2-cyclohexane dicarboxylic acid with a monohydric alcohol having 4-9 carbon atoms, a diester of 4-cyclohexene-1,2-dicarboxylic acid with a monohydric alcohol having 4-9 carbon atoms, or mixtures thereof.

The polyol ester is preferably an ester of a diol or a polyol having 3-20 hydroxyl groups with a fatty acid having 6-20 carbon atoms. Here, the diol may be ethylene glycol, 1,3-propane diol, propylene glycol, 1,4-butane diol, 1,2-butane diol, 2-methyl-1,3-propane diol, 1,5-pentane diol, neopentyl glycol, 1,6-hexane diol, 2-ethyl-2-methyl-1,3-propane diol, 1,7-heptane diol, 2-methyl-2-propyl-1,3-propane diol, 2,2-diethyl-1,3-propane diol, 1,8-octane diol, 1,9-nonane diol, 1,10-decane diol, 1,11-undecane diol or 1,12-dodecane diol. The polyol may be trimethyloylethane, trimethyloylpropane, trimethyloylbutane, di-(trimethyloylpropane), tri-(trimethyloyl propane), pentaerythrytol, di-(pentaerythrytol), tri-(pentaerythrytol), glycerin, polyglycerine (2-20 glycerine units) 1,3,5-pentane triol, sorbitol, sorbitan, sorbitol-glycerine condensate, a polyhydric alcohol such as adonitol, arabitol, xylitol or mannitol, a sugar such as xylose, arabinose, ribose, rhamnose, glucose, fructose, galactose, mannose, sorbose, cellobiose, maltose, isomaltose, trehalose, sucrose, raffinose, gentianose or melezitose, and their partially etherified derivatives and methyl glucosides (glycosides). Among these, the polyol is preferably a hindered alcohol such as neopentyl glycol, trimethyloylethane, trimethyloylpropane, trimethyloylbutane, di-(trimethyloylpropane), tri-(trimethyloyl propane), pentaerythrytol, di-(pentaerythrytol) or tri-(pentaerythrytol).

In the fatty acid used for the polyol ester, the number of carbon atoms is not particularly limited, but a compound having 1-24 carbon atoms is generally used. Among fatty acids having 1-24 carbon atoms, from the viewpoint of lubricating properties, those having 3 or more carbon atoms are preferred, those having 4 or more carbon atoms or more preferred, those having 5 or more carbon atoms are still more preferred and those having 10 or more carbon atoms are most preferred. From the viewpoint of miscibility with the refrigerant, fatty acids having 18 or less carbon atoms are preferred, those having 12 or less carbon atoms are more preferred and those having 9 or less carbon atoms are still more preferred.

The fatty acid may be a straight-chain or branched fatty acid, but from the viewpoint of lubricating properties, a straight-chain fatty acid is preferred, and from the viewpoint of hydrolytic stability, a branched fatty acid is preferred. The fatty acid may also be saturated or unsaturated.

Examples of a fatty acid are pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid and oleic acid. These fatty acids may be straight-chain or branched, and they may also be a fatty acid wherein the $\alpha$ carbon atom is a tertiary carbon atom (neo acid). Among these, valeric acid (n-pentanoic acid), caproic acid (n-hexanoic acid), enanthic acid (n-heptanoic acid), caprylic acid (n-octanoic acid), pelargonic acid (n-nonanoic acid), capric acid (n-decanoic acid), oleic acid (cis-9-octadecenoic acid), isopentanoic acid (3-methyl butanoic acid), 2-methyl hexanoic acid, 2-ethyl pentanoic acid, 2-ethyl hexanoic acid and 3,5,5-trimethyl hexanoic acid are preferably used.

Preferably, provided that it has two or more ester groups, the polyol ester of the invention may be a partial ester wherein part of the hydroxyl groups of the polyol are not esterified, a full ester wherein all the hydroxyl groups are esterified, or a mixture of a partial ester and a full ester, but a full ester is preferred.

Examples of a complex ester are an ester of a fatty acid and dibasic acid with a monohydric alcohol and a polyol, and the fatty acid, dibasic acid, monohydric alcohol and polyol may be the fatty acid, dibasic acid, monohydric alcohol and polyol mentioned in the description of the aforesaid dibasic acid ester and polyol ester.

The carbonic acid ester is a compound having the carbonic acid ester bond represented by the following formula (1):

$$—O—CO—O— \quad (1)$$

in the molecule. The number of carbonic acid ester bonds represented by the aforesaid formula (1) may be 1, 2 or more per molecule.

The alcohol forming the carbonic acid ester may be the monohydric alcohol or polyol mentioned in the description of the aforesaid dibasic acid ester and polyol ester, a polyglycol, or a compound obtained by addition of a polyglycol to a polyol. Compounds obtained from carbonic acid, a fatty acid and/or a dibasic acid may also be used.

It will of course be understood that when an ester is used, it may be a compound having a single structure, or two or more compounds having different structures which are used together.

Among the aforesaid esters, due to their superior miscibility with the refrigerant, dibasic acid esters, polyol esters and carbonic acid esters are preferred.

Moreover, among dibasic acid esters, alicyclic dicarboxylic acid esters such as 1,2-cyclohexane di-carboxylic acid and 4-cyclohexene-1,2-dicarboxylic acid are more preferred from the viewpoints of miscibility with the refrigerant, and thermal/hydrolytic stability.

Examples of dibasic acid esters which can be used are dibasic acid esters obtained from at least one monohydric alcohol selected from a group comprising butanol, pentanol, hexanol, heptanol, octanol and nonanol, and at least one dibasic acid selected from a group comprising 1,2-cyclohexane dicarboxylic acid and 4-cyclohexene-1,2-dicarboxylic acid, or mixtures thereof.

In the dibasic acid ester of the invention, from the viewpoint that the low temperature properties of the refrigerating machine oil composition and miscibility of the refrigerant are improved, it is preferred to use two or more of the monohydric alcohols forming the dibasic acid ester. The dibasic acid ester formed from two or more monohydric alcohols includes a mixture of two or more esters of a dibasic acid with one type of alcohol, and esters of a dibasic acid with a mixture of two or more type of alcohols.

Among polyol esters, from the viewpoint of superior hydrolytic stability, esters of hindered alcohols such as neopentyl glycol, trimethylolethane, trimethylolpropane, trimethylolbutane, di-(trimethylolpropane), tri-(trimethylolpropane), pentaerythritol, di-(pentaerythritol) and tri-(pentaerythritol) are more preferred, esters of neopentyl glycol, trimethylolethane, trimethylolpropane, trimethylolbutane and pentaerythritol are still more preferred, and esters of pentaerythritol are most preferred since they have particularly good miscibility with refrigerants and hydrolytic stability.

Examples of polyol esters which can be used preferably in the invention are di-esters, tri-esters and tetra-esters of at least one fatty acid selected from a group comprising valeric acid, caproic acid, enanthic acid, caprylic acid, pelargonic acid, capric acid, oleic acid, isopentanoic acid, 2-methyl hexanoic acid, 2-ethyl pentanoic acid, 2-ethyl hexanoic acid and 3,5,5-trimethyl hexanoic acid with at least one alcohol selected from a group comprising neopentyl glycol, trimethylolethane, trimethylolpropane, trimethylolbutane and pentaerythritol, and mixtures thereof.

In the polyol ester of the invention, from the viewpoint that low temperature properties of the refrigerating machine oil composition and miscibility with the refrigerant are improved, it is preferred that two or more fatty acids form the polyol ester. Polyol esters formed from two or more fatty acids include a mixture of two or more esters of a polyol with one fatty acid, and an ester of a polyol with a mixture of two or more fatty acids.

Among carbonic acid esters, esters having a structure represented by the following formula (2) are preferred:

$$(X^1O)_b—B—[O—(A^1O)_c—CO—O—(A^2O)_d—Y^1]_a \quad (2)$$

[in formula (2), $X^1$ is a hydrogen atom, alkyl group, cycloalkyl group or the following formula (3): $Y^2—(OA^3)_e—$ (3) (in formula (3), $Y^2$ is a hydrogen atom, alkyl group or cycloalkyl group, $A^3$ is an alkylene group having 2-4 carbon atoms, e is an integer from 1-50), $A^1$, $A^2$ may be identical or different and are both alkylene groups having 2-4 carbon atoms, $Y^1$ is a hydrogen atom, alkyl group or cycloalkyl group, B is a residue of a compound having 3-20 hydroxyl groups, a is an integer from 1-20, b is an integer from 0-19, a+b is an integer from 3-20, c is an integer from 0-50 and d is an integer from 1-50].

In formula (2), $X^1$ is a hydrogen atom, alkyl group, cycloalkyl group or a group represented by formula (3). The number of carbon atoms in the alkyl group mentioned here is not particularly limited, but it is normally 1-24, preferably 1-18 and more preferably 1-12. This alkyl group may be straight-chain or branched.

The alkyl group having 1-24 carbon atoms may be for example methyl, ethyl, n-propyl, isopropyl, n-butyl, isobutyl, sec-butyl, tert-butyl, and straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched heptadecyl, straight-chain or branched octadecyl, straight-chain or branched nonadecyl, straight-chain or branched icosyl, straight-chain or branched henicosyl, straight-chain or branched docosyl, straight-chain or branched tricosyl or straight-chain or branched tetracosyl.

The cycloalkyl group may be for example cyclopentyl, cyclohexyl or cycloheptyl.

The alkylene group having 2-4 carbon atoms represented by $A^3$ in the aforesaid formula (2) may be for example ethylene, propylene, trimethylene, butylene, tetramethylene, 1-methyl trimethylene, 2-methyltrimethylene, 1,1-dimethyl ethylene or 1,2-dimethyl ethylene.

$Y^2$ in the aforesaid formula (2) may be a hydrogen atom, alkyl group or cycloalkyl group. The number of carbon atoms in the alkyl group mentioned here is not particularly limited, but is normally 1-24, preferably 1-18 and more preferably 1-12. This alkyl group may be straight-chain or branched. The alkyl group having 1-24 carbon atoms may be for example the alkyl groups mentioned in the description of $X^1$.

The cycloalkyl group may be for example cyclopentyl, cyclohexyl or cycloheptyl.

Among the groups represented by $Y^2$, a hydrogen atom or an alkyl group having 1-12 carbon atoms is preferred, and any of hydrogen, methyl, ethyl, n-propy, isopropyl, n-butyl, isobutyl, sec-butyl, tert-butyl, n-pentyl, isopentyl, neopentyl, n-hexyl, isohexyl, n-heptyl, isoheptyl, n-octyl, isooctyl, n-nonyl, isononyl, n-decyl, isodecyl, n-undecyl, isoundecyl, n-dodecyl or isododecyl is more preferred. e is an integer from 1-50.

Among the groups represented by $X^1$, a hydrogen atom, an alkyl group having 1-12 carbon atoms or a group represented by the aforesaid general formula (3) is preferred, and any of hydrogen, methyl, ethyl, n-propyl, isopropyl, n-butyl, isobutyl, sec-butyl, tert-butyl, n-pentyl, isopentyl, neopentyl, n-hexyl, isohexyl, n-heptyl, isoheptyl, n-octyl, isooctyl, n-nonyl, isononyl, n-decyl, isodecyl, n-undecyl, isoundecyl, n-dodecyl or isododecyl, or any of the groups represented by the general formula (3), is more preferred.

The compound which is the residue B having 3-20 hydroxyl groups may be any of the aforesaid polyols.

A1, A2 may be identical or different, and both represent alkylene groups having 2-4 carbon atoms. This alkylene group may be for example ethylene, propylene, trimethylene, butylene, tetramethylene, 1-methyl trimethylene, 2-methyltrimethylene, 1,1-dimethyl ethylene or 1,2-dimethyl ethylene.

$Y^1$ may be a hydrogen atom, alkyl group or cycloalkyl group. The number of carbon atoms in the alkyl group mentioned here is not particularly limited, but is normally 1-24, preferably 1-18 and more preferably 1-12. This alkyl group may be straight-chain or branched. The alkyl group having 1-24 carbon atoms may be for example the alkyl groups mentioned in the description of $X^1$.

The cycloalkyl group may be for example cyclopentyl, cyclohexyl or cycloheptyl.

Among the groups represented by $Y^1$, a hydrogen atom or an alkyl group having 1-12 carbon atoms is preferred, and any of hydrogen atom, methyl, ethyl, n-propyl, isopropyl, n-butyl, isobutyl, sec-butyl, tert-butyl, n-pentyl, isopentyl, neopentyl, n-hexyl, isohexyl, n-heptyl, isoheptyl, n-octyl, isooctyl, n-nonyl, isononyl, n-decyl, isodecyl, n-undecyl, isoundecyl, n-dodecyl or isododecyl is more preferred.

In the aforesaid formulae (2) and (3), c, d and e represent the degree of polymerization of the polyoxyalkylene chain, but the polyoxyalkylene chains in the molecule may be identical or different. If the carboxylic acid ester represented by the formula (2) has plural, different polyoxyalkylene chains, the type of polymerization of the oxyalkylene chains is not particularly limited, and they may be random copolymers or block copolymers.

The carboxylic acid ester used in the invention may be manufactured by any desired method, for example, it may be obtained by adding an alkylene oxide to a polyol compound to manufacture a polyalkylene glycol polyol ether, and then reacting this together with a chloroformate at 0-30° C. in the presence of an alkali metal hydroxide such as sodium hydroxide or potassium hydroxide, an alkali metal alkoxide such as sodium methoxide or sodium ethoxide, or an alkali metal such as metallic sodium. Alternatively, it can be obtained by reacting a polyalkylene glycol polyol ether with a source of carbonic acid such as a carbonic acid diester or phosgene at 80-150° C. in the presence of an alkali metal hydroxide such as sodium hydroxide or potassium hydroxide, an alkali metal alkoxide such as sodium methoxide or sodium ethoxide, or an alkali metal such as metallic sodium. Subsequently, the free hydroxyl groups are etherized if required.

The product obtained from the aforementioned starting materials may be purified to remove by-products or unreacted substances, but provided that the superior performance of the lubricating oil of the invention is not adversely affected, small amounts of side products and unreacted substances may be allowed to remain without problem.

If a carboxylic acid ester is used in the invention, a compound having a single structure may be used alone, or two or more compounds having different structures may be used together. The molecular weight of the carboxylic acid ester in the invention is not particularly limited, but from the viewpoint of improving seal properties of the compressor, the number average molecular weight is preferably 200-4000, and more preferably 300-3000. The kinematic viscosity of the carboxylic acid ester of the invention is preferably 2-150 $mm^2/s$, but more preferably 4-100 $mm^2/s$ at 100° C.

The polyoxyalkylene glycol used for the lubricant of the present invention may be for example a compound represented by the following general formula (4):

$$R^1—[(OR^2)_f—OR^3]_g \quad (4)$$

[in formula (4), $R^1$ is a hydrogen atom, alkyl group having 1-10 carbon atoms, acyl group having 2-10 carbon atoms or residue of a compound having 2-8 hydroxyl groups, $R^2$ is an alkylene group having 2-4 carbon atoms, $R^3$ is a hydrogen atom, alkyl group having 1-10 carbon atoms or acyl group having 2-10 carbon atoms, f is an integer from 1-80, and g is an integer from 1-8].

In the aforesaid general formula (4), the alkyl group represented by $R^1$, $R^3$ may be straight-chain, branched or cyclic. Specific examples of the alkyl group are methyl, ethyl, n-propyl, isopropyl, straight-chain or branched butyl, straight-chain or branched pentyl, straight-chain or branched hexyl, straight-chain or branched heptyl, straight-chain or branched octyl, straight-chain or branched nonyl, straight-chain or branched decyl, cyclopentyl and cyclohexyl. If the number of carbon atoms in this alkyl group exceeds 10, miscibility with the refrigerant decreases and phase separation tends to occur. The number of carbon atoms in the alkyl group is preferably 1-6.

The alkyl group part represented by $R^1$, $R^3$ may be straight-chain, branched or cyclic. Specific examples of the alkyl group part of the acyl group are moieties having 1-9 carbon atoms among the alkyl groups mentioned as examples of the aforesaid alkyl groups. If the number of carbon atoms in this acyl group exceeds 10, miscibility with the refrigerant decreases and phase separation tends to occur. The number of carbon atoms in the acyl group is preferably 2-6.

If the groups represented by $R^1$, $R^3$ are both alkyl groups or acyl groups, $R^1$, $R^3$ may be identical or different. Further, if g is 2 or more, the groups represented by plural $R^1$, $R^3$ in the molecule may be identical or different.

If the group represented by $R^1$ is a residue of a compound having 2-8 hydroxyl groups, this compound may be straight-chain or cyclic. Here, a compound having two hydroxyl groups may be ethylene glycol, 1,3-propane diol, propylene glycol, 1,4-butane diol, 1,2-butane diol, 2-methyl-1,3-propane diol, 1,5-pentane diol, neopentyl glycol, 1,6-hexane diol, 2-ethyl-2-methyl-1,3-propane diol, 1,7-heptane diol, 2-methyl-2-propyl-1,3-propane diol, 2,2-diethyl-1,3-propane diol, 1,8-octane diol, 1,9-nonane diol, 1,10-decane diol, 1,11-undecane diol or 1,12-dodecane diol.

A compound having 3-8 hydroxyl groups may be trimethyloylethane, trimethyloylpropane trimethyloylbutane, di-(trimethyloylpropane), tri-(trimethyloyl propane), pentaerythrytol, di-(pentaerythrytol), tri-(pentaerythrytol), glycerin, polyglycerol (2-6 glycerine units) 1,3,5-pentane triol, sorbitol, sorbitol-glycerine condensate, polyhydric alcohols such as adonitol, arabinitol, xylitol or mannitol, sugars such as xylose, arabinose, ribose, rhamnose, glucose, fructose, galactose, mannose, sorbose, cellobiose, maltose, isomaltose, trehalose, sucrose, raffinose, gentianose or melezitose, and their partially etherified derivatives and methyl glucosides (glycosides) thereof.

Among the polyoxyalkylene glycols represented by the aforesaid general formula (4), at least one of $R^1$, $R^3$ is preferably an alkyl group (more preferably, an alkyl group having 1-4 carbon atoms), and in particular a methyl group which is preferable from the viewpoint of refrigerant miscibility. Further, from the viewpoint of thermal/chemical stability, both $R^1$, $R^3$ are preferably alkyl groups (more preferably, alkyl groups having 1-4 carbon atoms), and in particular a methyl group. From the viewpoint of ease of manufacture and cost, it is preferred that one of $R^1$, $R^3$ is an alkyl group (more preferably, an alkyl group having 1-4 carbon atoms), and the other is a hydrogen atom, and it is particularly preferred that one is a methyl group and the other is a hydrogen atom.

$R^2$ in the aforesaid general formula (4) represents an alkylene group having 2-4 carbon atoms, examples of which are ethylene, propylene and butylene. The oxyalkylene group of the repeating unit represented by $OR^2$ may be oxyethylene, oxypropylene or oxybutylene. The oxyalkylene groups in the molecule may be identical, or it may contain two or more oxyalkylene groups.

Among the polyoxyalkylene glycols represented by the aforesaid general formula (4), from the viewpoint of refrigerant miscibility and viscosity-temperature properties, a copolymer containing an oxy ethylene (EO) group and a oxy propylene (PO) group is preferred, and in this case, from the viewpoint of printing load and viscosity-temperature properties, the proportion of oxy ethylene groups in the sum of oxy ethylene groups and oxy propylene groups (EO/(PO+EO)) is preferably within the range of 0.1-0.8, and more preferably within the range of 0.3-0.6.

Also, from the viewpoint of moisture absorption and thermal oxidation stability, the value of (EO/(PO+EO)) is preferably within the range of 0-0.5, more preferably 0-0.2 and most preferably 0 (i.e., propylene oxide polymer alone).

In the aforesaid general formula (4), f is an integer from 1-80, and g is an integer from 1-8. For example, if $R^7$ is an alkyl group or acyl group, g is 1. If $R^7$ is a residue of a compound having 2-8 hydroxyl groups, g is the number of hydroxyl groups in this compound.

The product of f and g (f×g) is not particularly limited, but in order to obtain a good balance in the properties required of the refrigerating machine oil, the average value of f×g is preferably 6-80.

Among the polyoxyalkylene glycols having the aforesaid composition, the polyoxy propylene glycol dimethylether represented by the following formula (5):

$$CH_3O—(C_3H_6O)_h—CH_3 \quad (5)$$

(in the formula h is an integer from 6-80), and the polyoxy ethylene polyoxy propylene glycol dimethylether represented by the following formula (6):

$$CH_3O—(C_2H_4O)_i—(C_3H_6O)_j—CH_3 \quad (6)$$

(in the formula, i, j are both greater than 1, and the sum of i, j is 6-80), are preferred from the viewpoint of economic viability and the aforementioned advantages.

Further, the polyoxy propylene glycol monobutyl ether represented by the following general formula (7):

$$C_4H_9O—(C_3H_6O)_k—H \quad (7)$$

(in the formula, k is an integer from 6-80), the polyoxy propylene glycol monomethyl ether represented by the following general formula (8):

$$CH_3O—(C_3H_6O)_l—H \quad (8)$$

(in the formula, l is an integer from 6-80), the polyoxy ethylene polyoxy propylene glycol monomethyl ether represented by the following general formula (9):

$$CH_3O—(C_2H_4O)_m—(C_3H_6O)_n—H \quad (9)$$

(in the formula, m, n are both 1 or more, and m+n is an integer from 6-80), the polyoxy ethylene polyoxy propylene glycol monobutyl ether represented by the following general formula (10):

$$C_4H_9O—(C_2H_4O)_m—(C_3H_6O)_n—H \quad (10)$$

(in the formula, m, n are both 1 or more, and m+n is an integer from 6-80), and the polyoxy propylene glycol diacetate represented by the following general formula (11):

$$CH_3COO—(C_3H_6O)_l—COCH_3 \quad (11)$$

(in the formula, l is an integer from 6-80) are preferred from the viewpoint of economic viability.

In the invention, as the aforesaid polyoxyalkylene glycol, the polyoxyalkylene glycol derivative having at least one structural unit represented by the general formula (12) may be used:

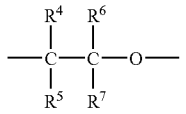

(12)

[in formula (12), $R^4$-$R^7$ may be identical or different, and are respectively a hydrogen atom, a monovalent hydrocarbon group having 1-10 carbon atoms, or a group represented by the following general formula (13):

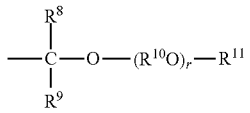

(13)

(in formula (13), $R^8$, $R^9$ may be identical or different, and are respectively a hydrogen atom, a monovalent hydrocarbon group having 1-10 carbon atoms or an alkoxy alkyl group having 2-20 carbon atoms, $R^{10}$ is an alkylene group having 2-5 carbon atoms, a substituted alkylene group having a total of 2-5 carbon atoms wherein the substituent group is an alkyl group, or a substituted alkylene group having a total of 4-10 carbon atoms wherein the substituent group is an alkoxy alkyl group, r is an integer from 0-20, and $R^{13}$ is a monovalent hydrocarbon group having 1-10 carbon atoms), and at least one of $R^8$-$R^{11}$ is a group represented by the general formula (13)].

In formula (12), $R^4$-$R^7$ are respectively a hydrogen atom, a monovalent hydrocarbon group having 1-10 carbon atoms or a group represented by the aforesaid general formula (13), wherein the monovalent hydrocarbon group having 1-10 carbon atoms may be for example a straight-chain or branched alkyl group having 1-10 carbon atoms, straight-chain or branched alkenyl group having 2-10 carbon atoms, cycloalkyl group or alkyl cycloalkyl group having 5-10 carbon atoms, aryl group or alkyl aryl group having 6-10 carbon atoms, or aryl alkyl group having 7-10 carbon atoms. Among these monovalent hydrocarbon groups, a monovalent hydrocarbon group having 6 or less carbon atoms, and in particular an alkyl group having 3 or less carbon atoms, specifically methyl, ethyl, n-propyl or isopropyl, is preferred.

In the aforesaid general formula (13), $R^8$, $R^9$ are respectively a hydrogen atom, a monovalent hydrocarbon group having 1-10 carbon atoms or an alkoxy alkyl group having 2-20 carbon atoms, but among these, an alkyl group having 3 or less carbon atoms or an alkoxy alkyl group having 6 or less carbon atoms is preferred. The alkyl group having 3 or less carbon atoms may be for example methyl, ethyl, n-propyl or isopropyl. The alkoxy alkyl group having 2-6 carbon atoms may be for example methoxy methyl, ethoxy methyl, n-propoxy methyl, isopropoxy methyl, n-butoxy methyl, isobutoxy methyl, sec-butoxy methyl, tert-butoxy methyl, pentoxy methyl (including all isomers), methoxy ethyl (including all isomers), ethoxy ethyl (including all isomers), propoxy ethyl (including all isomers), butoxy ethyl (including all isomers), methoxy propyl (including all isomers), ethoxy propyl (including all isomers), propoxy propyl (including all isomers), methoxy butyl (including all isomers), ethoxy butyl (including all isomers) or methoxy pentyl (including all isomers).

In the aforesaid general formula (13), $R^{10}$ is an alkylene group having 2-5 carbon atoms, a substituted alkylene group having a total of 2-5 carbon atoms wherein the substituent group is an alkyl group, or a substituted alkylene group having a total of 4-10 carbon atoms wherein the substituent group is an alkoxy alkyl group, but preferably an alkylene group having 2-4 carbon atoms and a substituted ethylene group having a total of 6 or less carbon atoms. The alkylene group having 2-4 carbon atoms may be ethylene, propylene or butylene. The substituted ethylene group having a total of 6 or less carbon atoms may be for example 1-(methoxy methyl)ethylene, 2-(methoxy methyl)ethylene, 1-(methoxy ethyl)ethylene, 2-(methoxy ethyl)ethylene, 1-(ethoxy methyl)ethylene, 2-(ethoxy methyl)ethylene, 1-methoxy methyl-2-methyl ethylene, 1,1-bis(methoxy methyl)ethylene, 2,2-bis (methoxy methyl)ethylene, 1,2-bis(methoxy methyl)ethylene, 1-methyl-2-methoxy methyl ethylene, 1-methoxy methyl-2-methyl ethylene, 1-ethyl-2-methoxy methyl ethylene, 1-methoxy methyl-2-ethylethylene, 1-methyl-2-ethoxy methyl ethylene, 1-ethoxy methyl-2-methyl ethylene, 1-methyl-2-methoxy ethylethylene, or 1-methoxy ethyl-2-methyl ethylene.

In formula (13), $R^{11}$ is a monovalent hydrocarbon group having 1-10 carbon atoms, wherein this hydrocarbon group having 1-10 carbon atoms may be for example a straight-chain or branched alkyl group having 1-10 carbon atoms, straight-chain or branched alkenyl group having 2-10 carbon atoms, cycloalkyl group or alkyl cycloalkyl group having 5-10 carbon atoms, aryl group or alkyl aryl group having 6-10 carbon atoms, or aryl alkyl group having 7-10 carbon atoms. Among these monovalent hydrocarbon groups, a monovalent hydrocarbon group having 6 or less carbon atoms, and in particular an alkyl group having 3 or less carbon atoms, specifically methyl, ethyl, n-propyl or isopropyl, is preferred.

In the general formula (12), at least one of $R^4$-$R^7$ is a group represented by the aforesaid general formula (13). In particular, it is preferred that one of $R^4$ and $R^6$ is a group represented by the aforesaid general formula (13), and the remaining $R^4$ or $R^6$ and $R^5$, $R^7$ are respectively a hydrogen atom or a monovalent hydrocarbon group having 1-10 carbon atoms.

The polyoxyalkylene glycol having a structural unit represented by the aforesaid general formula (12) which is preferably used in the invention, may be broadly divided into three types, i.e., a homopolymer formed of structural units represented by the general formula (12); a copolymer having two or more structural units represented by the general formula (12) of different structure, and a copolymer having a structural unit represented by the general formula (12) and another structural unit, e.g., a structural unit represented by the following general formula (14):

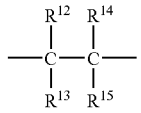

(14)

[in the formula, $R^{12}$-$R^{15}$ may be identical or different, and are respectively a hydrogen atom or an alkyl group having 1-3 carbon atoms. A preferred example of the aforesaid homopolymer contains 1-200 structural units A represented by the general formula (12), and the terminal groups may for example respectively be a hydroxyl group, an acyloxy group having 1-10 carbon atoms, an alkoxy group having 1-10 carbon atoms or an aryloxy group. A preferred example of the aforesaid copolymer respectively contains 1-200 of two structural units A, B represented by the general formula (12), or 1-200 structural units A represented by the general formula (12) and 1-200 structural units C represented by the general formula (12), the terminal groups respectively being a hydroxyl group, aryloxy group having 1-10 carbon atoms, alkoxy group having 1-10 carbon atoms or an aryloxy group. These copolymers may be an alternating copolymer, a random copolymer or a block copolymer comprising the structural unit A and structural unit B (or structural unit C), or a graft copolymer wherein the structural unit B is grafted to the main chain of the structural unit A.

The polyvinyl ether used in the invention may be for example a polyvinyl ether compound having a structural unit represented by the following general formula (15):

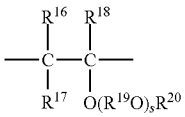

(15)

[in the formula (15), $R^{16}$-$R^{18}$ may be identical or different, and respectively a hydrogen atom or a hydrocarbon group having 1-8 carbon atoms, $R^{19}$ is a divalent hydrocarbon group having 1-10 carbon atoms or a divalent ether bond oxygen-containing hydrocarbon group having 2-20 carbon atoms, $R^{20}$ is a hydrocarbon group having 1-20 carbon atoms, s is an integer whereof the average value is 0-10, $R^{16}$-$R^{20}$ may be identical or respectively different in each structural unit, and when the structural unit represented by the general formula (15) contains plural $R^{19}O$, the plural $R^{19}O$ may be identical or different].

A polyvinyl ether compound comprising a block copolymer or random copolymer having a structural unit represented by the aforesaid general formula (15), and a structural unit represented by the following general formula (16), may also be used:

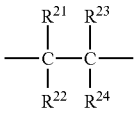

(16)

[in formula (16), $R^{21}$-$R^{24}$ may be identical or different, and are respectively a hydrogen atom or a hydrocarbon group having 1-20 carbon atoms, and $R^{21}$-$R^{24}$ may be identical or different in each structural unit].

$R^{16}$-$R^{18}$ in the aforesaid general formula (15) respectively represent a hydrogen atom or a hydrocarbon group having 1-8 carbon atoms (preferably, a hydrocarbon group having 1-4 carbon atoms), and these may be identical to or different from each other. The hydrocarbon group may be for example an alkyl group such as methyl, ethyl, n-propyl, isopropyl, n-butyl, isobutyl, sec-butyl, tert-butyl, and various pentyl, hexyl, heptyl or octyl groups; a cycloalkyl group such as cyclopentyl, cyclohexyl, various methyl cyclohexyl groups, various ethyl cyclohexyl groups or various dimethyl cyclohexyl groups, an aryl group such as phenyl, various methyl phenyl groups, various ethyl phenyl groups or various dimethyl phenyl groups; or an aryl alkyl group such as benzyl, various phenyl ethyl groups or various methyl benzyl groups, but $R^{22}$-$R^{24}$ are preferably a hydrogen atom.

On the other hand, $R^{19}$ in the aforesaid general formula (15) represents a divalent hydrocarbon group having 1-10 (preferably 2-10) carbon atoms, or a divalent ether bond oxygen-containing hydrocarbon having 2-20 carbon atoms.

The divalent hydrocarbon group having 1-10 carbon atoms may be for example a dibasic fatty acid chain-type hydrocarbon group such as methylene, ethylene, phenylethylene, 1,2-propylene, 2-phenyl-1,2-propylene, 1,3-propylene, various butylene groups, various pentylene groups, various hexylene groups, various heptylene groups, various octylene groups, various nonylene groups and various decylene groups; an alicyclic hydrocarbon group having two bonded sites in the alicyclic hydrocarbon, such as cyclohexane, methyl cyclohexane, ethyl cyclohexane, dimethyl cyclohexane and propyl cyclohexane; a divalent aromatic hydrocarbon group such as various phenylene groups, various methyl phenylene groups, various ethyl phenylene groups, various dimethyl phenylene groups and various naphthalene groups; an alkyl aromatic hydrocarbon group having a monovalent bonding site respectively in the alkyl group part and the aromatic group part of the alkyl aromatic hydrocarbon such as toluene, xylene and ethyl benzene; or an alkyl aromatic hydrocarbon having a bonding site in the alkyl group part of a polyalkyl aromatic hydrocarbon such as xylene or diethyl benzene. Among these, aliphatic chain-like hydrocarbons having 2-4 carbon atoms are particularly preferred.

A preferred example of the divalent ether bond oxygen-containing hydrocarbon having 2-20 carbon atoms may be methoxy methylene, methoxy ethylene, methoxy methyl ethylene, 1,1-bismethoxy methyl ethylene, 1,2-bismethoxy methyl ethylene, ethoxy methyl ethylene, (2-methoxy ethoxy)methyl ethylene or (1-methyl-2-methoxy)methyl ethylene. In the general formula (15), s is the number of repeating units of $R^{19}O$, and its average value is a number in the range 0-10 but preferably 0-5.

When there are plural $R^{19}O$ in the same structural unit, the plural $R^{19}O$ may be identical or different.

$R^{20}$ in the general formula (15) is a hydrocarbon group having 1-20 but preferably 1-10 carbon atoms, specific examples of this hydrocarbon group being an alkyl group such as methyl, ethyl, n-propyl, isopropyl, n-butyl, isobutyl, sec-butyl, tert-butyl, various pentyl groups, various hexyl groups, various heptyl groups, various octyl groups, various nonyl groups and various decyl groups; a cycloalkyl group such as cyclopentyl, cyclohexyl, various methyl cyclohexyl groups, various ethyl cyclohexyl groups, various propyl cyclohexyl groups and various dimethyl cyclohexyl groups; an aryl group such as phenyl, various methyl phenyl groups, various ethyl phenyl groups, various dimethyl phenyl groups, various propyl phenyl groups, various trimethyl phenyl groups, various butyl phenyl groups and various naphthyl groups; or an aryl alkyl group such as benzyl, various phenyl ethyl groups, various methyl benzyl groups, various phenyl propyl groups and various phenyl butyl groups. $R^{22}$-$R^{26}$ may be identical or different in each structural unit.

If the polyvinyl ether of the invention is a homopolymer having only the structural unit represented by the general formula (15), its carbon/oxygen molar ratio is preferably within the range of 4.2-7.0. If this molar ratio is less than 4.2, moisture absorption become excessive, and if it exceeds 7.0, miscibility with the refrigerant tends to decrease.

In the general formula (16), $R^{21}$-$R^{24}$ may be identical or different, and are respectively a hydrogen atom or a hydrocarbon group having 1-20 carbon atoms. Here, the hydrocarbon group having 1-20 carbon atoms may be the hydrocarbon groups mentioned in the description of $R^{20}$ in the general formula (15). $R^{21}$-$R^{24}$ may be respectively identical or different in each structural unit.

When the polyvinyl ether according to the invention is a block copolymer or random copolymer having the structural unit represented by the general formula (15) and the structural unit represented by the general formula (16), the molar ratio of carbon/oxygen is preferably within the range of 4.2-7.0. If the molar ratio is less than 4.2, moisture absorption is excessive, and if it exceeds 7.0, miscibility with the refrigerant tends to decrease.

Further, in the invention, a mixture of a homopolymer having only the structural unit represented by the general formula (15), and the block copolymer or random copolymer having the structural unit represented by the general formula (15) and the structural unit represented by the general formula (16), may also be used. These homopolymers and copolymers can be manufactured by polymerization of corresponding vinyl ether monomers, and by copolymerization of corresponding hydrocarbon monomers having an olefinic double bond with corresponding vinyl ether monomers.

In general, preferably, in the polyvinyl ether used in the invention, one of the terminal groups is represented by the following general formula (17) or (18):

(17)

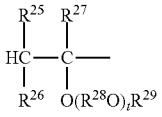

[in formula (17), $R^{25}$-$R^{27}$ may be identical or different, and are respectively a hydrogen atom or a hydrocarbon group having 1-8 carbon atoms, $R^{28}$ is a divalent hydrocarbon group having 1-10 carbon atoms or a divalent ether bond oxygen-containing hydrocarbon group containing 2-20 carbon atoms, $R^{29}$ is a hydrocarbon group containing 1-20 carbon atoms, t is an integer whereof the average value is 0-10, and when the terminal structure represented by the general formula (17) contains plural $R^{28}O$, the plural $R^{28}O$ may respectively be identical or different]

(18)

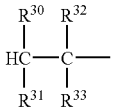

[in formula (18), $R^{30}$-$R^{31}$ may be identical or different, and are respectively a hydrogen atom or a hydrocarbon group having 1-20 carbon atoms, and the other terminal group is represented by the following general formula (19) or (20):

(19)

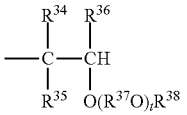

[in formula (19), $R^{34}$-$R^{36}$ may be identical or different, and are respectively a hydrogen atom or a hydrocarbon group having 1-8 carbon atoms], $R^{37}$ is a divalent hydrocarbon group having 1-10 carbon atoms or a divalent ether bond oxygen-containing hydrocarbon group having 2-20 carbon atoms, $R^{38}$ is a hydrocarbon group containing 1-20 carbon atoms, t is an integer whereof the average value is 0-10, and when the terminal structure represented by the general formula (19) contains plural $R^{37}O$, the plural $R^{37}O$ may respectively be identical or different]

(20)

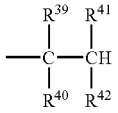

[in formula (20), $R^{39}$-$R^{42}$ may be identical or different, and are respectively a hydrogen atom or a hydrocarbon group having 1-20 carbon atoms]; and one of the terminal groups is represented by the general formula (17) or (18), and the other has a structure represented by the general formula (21):

(21)

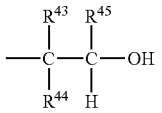

[in formula (21), $R^{43}$-$R^{45}$ may be identical or different, and are respectively a hydrogen atom or a hydrocarbon group having 1-8 carbon atoms]. Among these polyvinyl ethers, the following are particularly suitable.

(1) Polyvinyl ethers wherein one of the terminal groups has a structure represented by the general formula (17) or (18), and the other terminal group has a structure represented by the general formula (19) or (20), $R^{16}$-$R^{18}$ in the general formula (15) are both hydrogen, s is an integer from 0-4, $R^{19}$ is a divalent hydrocarbon group having 2-4 carbon atoms, and $R^{20}$ is a hydrocarbon group having 1-20 carbon atoms;

(2) Polyvinyl ethers having a structural unit represented by the general formula (15), one terminal group has a structure represented by the general formula (17), the other terminal group has a structure represented by the general formula (18), any of $R^{16}$-$R^{18}$ in the general formula (15) are hydrogen atom, s is an integer from 0-4, $R^{19}$ is a divalent hydrocarbon group having 2-4 carbon atoms, and $R^{20}$ is a hydrocarbon group having 1-20 carbon atoms;

(3) Polyvinyl ethers wherein one of the terminal groups has a structure represented by the general formula (17) or (18), and the other terminal group has a structure represented by the general formula (19), any of $R^{16}$-$R^{18}$ in the general formula (15) are hydrogen, s is an integer from 0-4, $R^{19}$ is a divalent hydrocarbon group having 2-4 carbon atoms, and $R^{20}$ is a hydrocarbon group having 1-20 carbon atoms;

(4) Polyvinyl ethers having a structural unit represented by the general formula (15), one terminal group has a structure represented by the general formula (17), the other terminal group has a structure represented by the general formula (20), any of $R^{16}$-$R^{18}$ in the general formula (15) are hydrogen, s is an integer from 0-4, $R^{19}$ is a divalent hydrocarbon group having 2-4 carbon atoms, and $R^{20}$ is a hydrocarbon group having 1-20 carbon atoms;

Further, in the invention, a polyvinyl ether compound having a structure containing a structural unit represented by the general formula (15), wherein one of the terminal groups is represented by the general formula (17) and the other terminal group is represented by the following general formula (22), may also be used:

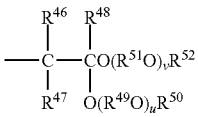

(22)

[in formula (22), $R^{46}$-$R^{48}$ may be identical or different, and are respectively a hydrogen atom or a hydrocarbon group having 1-8 carbon atoms, $R^{49}$, $R^{51}$ are identical or different, and are respectively a divalent hydrocarbon group having 2-10 carbon atoms, $R^{50}$, $R^{52}$ are identical or different and are respectively a hydrocarbon group having 1-10 carbon atoms, u, v are identical or different, and are integers whereof the average values are respectively 0-10, and when the terminal structure represented by the general formula (22) contains plural $R^{49}O$ or $R^{51}O$, the plural $R^{49}O$ or $R^{51}O$ may respectively be identical or different].

In the invention, a polyvinyl ether compound comprising a homopolymer or copolymer of a polyvinyl ether having a structure containing a structural unit represented by the following general formula (23) or (24), may also be used:

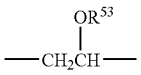

(23)

[in formula (23), $R^{53}$ is a hydrocarbon group having 1-8 carbon atoms]

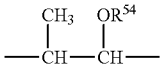

(24)

[in formula (24), $R^{54}$ is a hydrocarbon group having 1-8 carbon atoms] and having a weight average molecular weight of 300-5,000, wherein one of the terminal groups is represented by the following general formula (25) or (26):

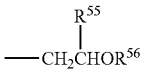

(25)

[in formula (25), $R^{55}$ is an alkyl group having 1-3 carbon atoms, and $R^{56}$ is a hydrocarbon group having 1-8 carbon atoms]

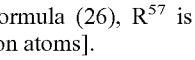

(26)

[in formula (26), $R^{57}$ is a hydrocarbon group having 1-8 carbon atoms].

In the invention, one moiety selected from a group comprising the aforesaid mineral oils and synthetic oils may be used, or two or more may be used. If the first, second and third refrigerating machine oil compositions of the invention are used for an open compressor such as a car air-conditioner using a HFC refrigerant, among the aforesaid mineral oils and synthetic oils, polyoxyalkylene glycols, esters, polyvinyl ether and ester polyvinyl ethers are preferred. If the first, second and third refrigerating machine oil compositions of the invention are used for a closed compressor such as a refrigerator or air conditioner, alkyl benzene, esters and polyvinyl ether are preferred.

In the case of the second refrigerating machine oil composition of the invention, the effect of adding the ingredients (A1)-(A6) is higher, so alicyclic dicarboxylic acid esters are most preferred. In the case also of the third refrigerating machine oil composition of the invention, the effect of adding the ingredients (A1), (A2), (A4), (A7), (A8) is higher, so alicyclic dicarboxylic acid esters are most preferred.

In the first refrigerating machine oil composition of the invention, at least one ester additive selected from among monoesters of a monobasic fatty acid having 12 or more carbon atoms with a monohydric alcohol having 1-24 carbon atoms, and esters of chain-like dibasic acids with monohydric alcohols, is blended with the aforesaid base oil. In the description below, for convenience, the former type will be referred to as "monoester of the invention" and the latter will be referred to as "dibasic acid ester of the invention".

From the viewpoint of frictional properties and thermal/oxidation stability, the number of carbon atoms in the monobasic fatty acid forming the monoester of the invention must be 12 or more as mentioned above, and is preferably 14 or more. The upper limit of the number of carbon atoms in the monomer basic fatty acid is not particularly limited, but from the viewpoint of preventing deposition in the refrigerant atmosphere at low temperature, the number of carbon atoms in the monobasic fatty acid is preferably 28 or less, more preferably 26 or less and still more preferably 24 less.

The monobasic fatty acid may be straight-chain or branched, and may be saturated or unsaturated. Examples are saturated fatty acids such as straight-chain or branched dodecanoic acid, straight-chain or branched tridecanoic acid, straight-chain or branched tetradecanoic acid, straight-chain or branched pentadecanoic acid, straight-chain or branched hexadecanoic acid, straight-chain or branched heptadecanoic acid, straight-chain or branched octadecanoic acid, straight-chain or branched hydroxy octadecanoic acid, straight-chain or branched nonadecanoic acid, straight-chain or branched eicosanoic acid, straight-chain or branched henicosanoic acid, straight-chain or branched docosanoic acid, straight-chain or branched tricosanoic acid, or straight-chain or branched tetracosanoic acid, and unsaturated fatty acids such as straight-chain or branched dodecenoic acid, straight-chain or branched tridecenoic acid, straight-chain or branched tetradecenoic acid, straight-chain or branched pentadecenoic acid, straight-chain or branched hexadecenoic acid, straight-chain or branched heptadecenoic acid, straight-chain or branched octadecenoic acid, straight-chain or branched hydroxyoctadecenoic acid, straight-chain or branched nonadecenoic acid, straight-chain or branched icosenoic acid, straight-chain or branched henicosenoic acid, straight-chain or branched docosenoic acid, straight-chain or branched tricosenoic acid, straight-chain or branched tetracosenoic acid, and mixtures thereof.

The monohydric alcohol forming the monoester of the invention has 1-24 carbon atoms, as mentioned above. The monohydric alcohol may be straight-chain or branched, and may be saturated or unsaturated. Examples are methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol, straight-chain or branched octadecanol, straight-chain or branched nonadecanol, straight-chain or branched icosanol, straight-chain or branched henicosanol, straight-chain or branched tricosanol, straight-chain or branched tetracosanol, and mixtures thereof. Among these, from the viewpoint of preventing deposition in the refrigerant atmosphere at low temperature, a monohydric alcohol having 1-12 carbon atoms is preferred, and a monohydric alcohol having 1-8 carbon atoms is more preferred.

From the viewpoint of frictional properties, the monoester of the invention is preferably an ester of a straight-chain monobasic acid.

The chain-like dibasic acid forming the dibasic acid ester of the invention may be straight-chain or branched, and may be saturated or unsaturated. This chain-like dibasic acid is preferably a dibasic acid having 2-16 carbon atoms, for example straight-chain or branched ethanedioic acid, propanedioic acid, straight-chain or branched butanedioic acid, straight-chain or branched pentanedioic acid, straight-chain or branched hexanedioic acid, straight-chain or branched heptanedioic acid, straight-chain or branched octanedioic acid, straight-chain or branched nonanedioic acid, straight-chain or branched decanedioic acid, straight-chain or branched undecanedioic acid, straight-chain or branched dodecanedioic acid, straight-chain or branched tridecanedioic acid, straight-chain or branched tetradecanedioic acid, straight-chain or branched heptadecanedioic acid, straight-chain or branched hexadecanedioic diacid, straight-chain or branched hexene diacid, straight-chain or branched heptene diacid, straight-chain or branched octene diacid, straight-chain or branched nonene diacid, straight-chain or branched decene diacid, straight-chain or branched undecene diacid, straight-chain or branched dodecene diacid, straight-chain or branched tridecene diacid, straight-chain or branched tetradecene diacid, straight-chain or branched heptadecene diacid, straight-chain or branched hexadecene diacid, and mixtures thereof.

The monohydric alcohol forming the dibasic acid ester of the invention, from the viewpoint of preventing deposition in the refrigerant atmosphere at low temperature, normally has 1-24, preferably 1-12 and more preferably 1-8 carbon atoms, and these alcohols may be straight-chain or branched and saturated or unsaturated. The alcohol having 1-24 carbon atoms may be for example methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol, straight-chain or branched octadecanol, straight-chain or branched nonadecanol, straight-chain or branched icosanol, straight-chain or branched henicosanol, straight-chain or branched tricosanol, straight-chain or branched tetracosanol, and mixtures thereof.

The dibasic acid ester of the invention may be a full ester wherein two carboxyl groups of the chain-like dibasic acid are esterified, or a partial ester wherein one of the carboxyl groups remains as it is, but from the viewpoint of effect on deposition properties in the refrigerant atmosphere, a full ester is preferred.

In the first refrigerating machine oil composition of the invention, by using the aforesaid specific ester additives, a superior effect can be obtained. For example, compared to a cyclic dibasic acid ester (e.g., an aromatic dicarboxylic acid ester), the dibasic acid ester of the invention gives superior stability to the refrigerating machine oil composition. Also, compared to a polybasic acid ester of valency 3 or more (e.g., trimellitic acid ester), the dibasic acid ester of the invention has superior anti-deposition properties in the refrigerant atmosphere at low temperature.

Compared to polyhydric alcohol esters, the monoester and dibasic acid ester of the invention have superior ability to prevent deposition in the refrigerant atmosphere at low temperature. Further, compared to full esters of polyhydric alcohols, the monoester and dibasic acid ester of the invention has superior friction-reducing properties.

Compared to alcohols such as oleyl alcohol, ethers such as glyceryl ether or carboxylic acids such as stearic acid, the monoester and dibasic acid ester of the invention has superior friction reducing properties. Still further, compared to alcohols and ethers, the monoester and dibasic acid ester of the invention have superior ability to prevent deposition, and compared to carboxylic acids, they are more stable.

Among the monoesters and dibasic acid esters of the invention, methyl laurate, propyl mystirate, butyl stearate, methyl stearate, methyl palmitate, isopropyl palmitate, di-isobutyl adipate, di-isodecyl adipate and diisononyl adipate are particularly preferred.

Further, among the monoesters and dibasic acid esters of the invention, from the viewpoint of superior frictional properties, the monoesters of the invention are preferred.

The monoester or dibasic acid ester of the invention may be used alone, or two or more may be used together. The ester content thereof is optional, but from the viewpoint of improving frictional properties, the total blending proportion of monoester and dibasic acid ester is preferably 0.01 mass % or more, more preferably 0.05 mass % or more, and still more preferably 0.1 mass % or more based on the total amount of composition. From the viewpoint of preventing deposition in the refrigerant atmosphere at low temperature, and of superior thermal/oxidation stability of the refrigerating machine oil composition, the total content is preferably 10 mass % or less, more preferably 7.5 mass % or less and still more preferably 5 mass % or less based on the total amount of composition.

In the second refrigerating machine oil composition of the invention, at least one moiety selected from among the ingredients (A1)-(A6) is blended with the aforesaid base oil.

(A1) Alkylene oxide adduct of a polyhydric alcohol having 3-6 hydroxyl groups.

(A2) Polyalkylene glycol (A3) Trihydric alcohol having 3-20 carbon atoms apart from (A1)

(A4) Dihydric alcohol having 2-20 carbon atoms apart from (A2)

(A5) Hydrocarbyl ether of (A1)-(A4)

(A6) Hydrocarbyl ester of (A1)-(A4)

Here, the following ingredients (A5-1)-(A5-4) are included in the ingredient (A5).

(A5-1) Hydrocarbyl ether of alkylene oxide adduct of polyhydric alcohol having 3-6 hydroxyl groups (A5-2) Hydrocarbyl ether of polyalkylene glycol (A5-3) Hydrocarbyl ether of trihydric alcohol having 3-20 carbon atoms apart from (A1)

(A5-4) Hydrocarbyl ether of dihydric alcohol having 2-20 carbon atoms apart from (A2)

The following (A6-1)-(A6-4) are included in the ingredient (A6).

(A6-1) Hydrocarbyl ester of alkylene oxide adduct of polyhydric alcohol having 3-6 hydroxyl groups (A6-2) Hydrocarbyl ester of polyalkylene glycol (A6-3) Hydrocarbyl ester of trihydric alcohol having 3-20 carbon atoms apart from (A1)

(A6-4) Hydrocarbyl ether of dihydric alcohol having 2-20 carbon atoms apart from (A2)

Further, in the third refrigerating machine oil composition of the present invention, at least one moiety selected from (A1), (A2), (A4), (A7) and (A8) is blended with the aforesaid base oil.

(A1) Alkylene oxide adduct of polyhydric alcohol having 3-6 hydroxyl groups (A2) Polyalkylene glycol (A4) Dihydric alcohol having 2-20 carbon atoms apart from (A2)

(A7) Hydrocarbyl ether of (A1), (A2) or (A4)

(A8) Hydrocarbyl ester of (A1), (A2) or (A4)

Here, the ingredients (A1), (A2) and (A4) in the third refrigerating machine oil composition are respectively identical to the ingredients (A1), (A2) and (A4) of the second refrigerating machine oil composition, and the ingredients (A7), (A8) of the third refrigerating machine oil composition are respectively identical to the ingredients (A5), (A6) of the second refrigerating machine oil composition. Therefore, in the following, the ingredients (A1)-(A6) of the second refrigerating machine oil composition will be described in detail.

Ingredient (A1) is an alkylene oxide adduct of a polyhydric alcohol having 3-6 hydroxyl groups. The polyhydric alcohol forming the ingredient (A1) is not particularly limited provided that it has 3-6 hydroxyl groups, but the polyhydric alcohols and sugars shown below may be used.

Examples of the polyhydric alcohol are glycerine, polyglycerols (dimers-tetramers of glycerine, for example, diglycerol, triglycerol, tetraglycerol), trimethylolalkane (for example, trimethylolethane, trimethylolpropane, trimethylol butane) and dimers-tetramers thereof, pentaerythritol, dipentaerythritol, 1,2,4-butane triol, 1,3,5-pentane triol, 1,2,6-hexane triol, 1,2,3,4-butane tetrol, sorbitol, sorbitan, sorbitol glycerin condensate, adonitol, arabitol, xylitol, mannitol, iditol, tallitol, dulcitol and allitol.

Examples of the sugar are xylose, arabinose, ribose, rhamnose, glucose, fructose, galactose, mannose, sorbose, cellobiose, mannitose, isomaltose, trehalose and sucrose.

Among these, from the viewpoint of superior lubricating properties, glycerine, trimethylolalkane and sorbitol are preferred.

The alkylene oxide forming ingredient (A1) is preferably an alkylene oxide having 2-6 carbon atoms, and more preferably an alkylene oxide having 2-4 carbon atoms. Examples of alkylene oxides having 2-6 carbon atoms are ethylene oxide, propylene oxide, 1,2-epoxy butane (α-butylene oxide), 2,3-epoxy butane (β-butylene oxide), 1,2-epoxy-1-methyl propane, 1,2-epoxy heptane and 1,2-epoxy hexane. Among these, from the viewpoint of superior lubricating properties, ethylene oxide, propylene oxide and butylene oxide are preferred, and ethylene oxide and propylene oxide are more preferred.

If two or more alkylene oxides are used, the type of polymerization of the oxyalkylene group is not particularly limited, and may be random copolymerization or block copolymerization. When the alkylene oxide is added to the polyhydric alcohol having 3-6 hydroxyl groups, it may be added to all the hydroxyl groups or added to only part of the hydroxyl groups. Among these, from the viewpoint of superior lubricating properties, it is preferably added to all the hydroxyl groups.

The number average molecular weight (Mn) of ingredient (A1) is not particularly limited, but from the viewpoint of the electrical insulating properties, it is preferably 100 or more, more preferably 125 or more and still more preferably 150 or more. From the viewpoint of stability, Mn of ingredient (A1) is preferably 3000 or less, more preferably 2000 or less, still more preferably 1000 or less, still more preferably 750 or less and most preferably 400 or less. Mn in this invention means the number average molecular weight converted for standard polystyrene by gel permeation chromatography (GPC).

If the number average molecular weight of ingredient (A1) is to satisfy the aforesaid conditions, when the alkylene oxide is added to the polyhydric alcohol having 3-6 hydroxyl groups, the type and polymerization degree of the alkylene oxide may first be selected and adjusted to give a desired number average molecular weight. Further, an ingredient whereof the number average molecular weight satisfies the aforesaid conditions may be separated from a mixture of alkylene oxide adducts of polyhydric alcohols having 3-6 hydroxyl groups obtained by any desired method or from a commercial mixture of alkylene oxide adducts of polyhydric alcohols having 3-6 hydroxyl groups by distillation or chromatography. The ingredient (A1) may also be one of the aforesaid ingredients used alone, or a mixture of two or more used together.

The ingredient (A1) may be obtained by adding an alkylene oxide to all the hydroxyl groups in the polyhydric alcohol, or by adding an alkylene oxide to part of the hydroxyl groups.

The polyalkylene glycol which is ingredient (A2) is a polymer obtained by homopolymerization of one type, or copolymerization of two or more types, of alkylene oxide. The alkylene oxide forming the polyalkylene glycol is preferably an alkylene oxide having 2-6 carbon atoms, but more preferably an alkylene oxide having 2-4 carbon atoms. Examples of an alkylene oxide having 2-6 carbon atoms are the alkylene oxides mentioned in the description of ingredient (A1). Among these, from the viewpoint of superior lubricating properties, ethylene oxide, propylene oxide and butylene oxide are preferred, ethylene oxide and propylene oxide are more preferred, and propylene oxide is most preferred. The degree of polymerization of the alkylene oxide depends on the number of carbon atoms in the alkylene oxide used, but it is preferably 5 or less and more preferably 4 or less.

If two or more alkylene oxides are used when preparing the polyalkylene oxide, the type of polymerization of the oxyalkylene groups is not particularly limited, and may be random copolymerization or block copolymerization.

Further, the number average molecular weight (Mn) of ingredient (A2) is not particularly limited, but from the viewpoint of electrical insulating properties, it is preferably 100 or more, more preferably 125 or more and most preferably 150 or more. From the viewpoint of stability, Mn of ingredient (A2) is preferably 3000 or less, more preferably 2000 or less, still more preferably 1000 or less, still more preferably 750 or less and most preferably 400 or less.

If the number average molecular weight of ingredient (A2) satisfies the aforesaid conditions, when the alkylene oxide is polymerized, the type and polymerization degree of the alkylene oxide may first be selected and adjusted to give a desired number average molecular weight. An ingredient whereof the number average molecular weight satisfies the aforesaid conditions may be separated from a polyalkylene glycol obtained by any desired method or a commercial polyalkylene glycol (including mixtures) by distillation or chromatography. Further, the ingredient (A2) may be any of these ingredients used alone, or a mixture of two or more used together. The ingredient (A3) is a trihydric alcohol having 3-20 carbon atoms apart from ingredient (A1), and is preferably a trihydric alcohol having 3-18 carbon atoms apart from ingredient (A1). Specifically, the trihydric alcohol of ingredient (A3) does not have an oxyalkylene structure (—O—R—; R is an alkylene group) in the molecule.

Examples of such a trihydric alcohol having 3-20 carbon atoms are glycerine, 1,2,3-butane triol, 1,2,4-butane triol, 1,2,5-pentane triol, 1,3,5-pentane triol, 1,2,3-pentane triol, 1,2,4-pentane triol, 1,2,6-hexane triol, 1,2,3-hexane triol, 1,2,4-hexane triol, 1,2,5-hexane triol, 1,3,4-hexane triol, 1,3,5-hexane triol, 1,3,6-hexane triol, 1,4,5-hexane triol, 1,2,7-heptane triol, 1,2,8-octane triol, 1,2,9-nonane triol, 1,2,10-decane triol, 1,2,11-undecane triol, 1,2,12-dodecane triol, 1,2,13-tridecane triol, 1,2,14-tetradecane triol, 1,2,15-pentadecane triol, 1,2,16-hexadecane triol, 1,2,17-heptadecane triol, 1,2,18-octadecane triol, 1,2,19-nonadecane triol and 1,2,20-eicosane triol. Among these, from the viewpoint of superior lubricating properties, 1,2,12-dodecane triol, 1,2,13-tridecane triol, 1,2,14-tetradecane triol, 1,2,15-pentadecane triol, 1,2,16-hexadecane triol, 1,2,17-heptadecane triol and 1,2,18-octadecane triol are preferred. According to the present invention, the ingredient (A3) may be one of these compounds used alone, or a mixture of two or more used together.

The ingredient (A4) is a dihydric alcohol having 2-20 carbon atoms apart from ingredient (A2), and is preferably a dihydric alcohol having 3-18 carbon atoms apart from ingredient (A2). Specifically, the dihydric alcohol of ingredient (A4) does not have an oxyalkylene structure (—O—R—; R is an alkylene group) in the molecule.

Examples of a dihydric alcohol having 2-20 carbon atoms are ethylene glycol, 1,3-propane diol, propylene glycol, 1,4-butane diol, 1,2-butane diol, 2-methyl-1,3-propane diol, 1,5-pentane diol, neopentyl glycol, 1,6-hexane diol, 2-ethyl-2-methyl-1,3-propane diol, 2-methyl-2,4-pentane diol, 1,7-heptane diol, 2-methyl-2-propyl-1,3-propane diol, 2,2-diethyl-1,3-propane diol, 1,8-octane diol, 1,9-nonane diol, 2-butyl-2-ethyl-1,3-propane diol, 1,10-decane diol, 1,11-undecane diol, 1,12-dodecane diol, 1,13-tridecane diol, 1,14-tetradecane diol, 1,15-heptadecane diol, 1,16-hexadecane diol, 1,17-heptadecane diol, 1,18-octadecane diol, 1,19-nonadecane diol and 1,20-icosadecane diol. Among these, from the viewpoint of superior lubricating properties, 1,4-butane diol, 1,5-pentane diol, neopentyl glycol, 1,6-hexane diol, 2-methyl-2,4-pentane diol, 2-ethyl-2-methyl-1,3-propane diol, 1,7-heptane diol, 1,8-octane diol, 1,9-nonane diol, 1,10-decane diol, 1,11-undecane diol and 1,12-dodecane diol are preferred. The ingredient (A4) may be any of these compounds used alone, or two or more mixed together.

The ingredient (A5) is a hydrocarbyl ether of ingredients (A1)-(A4). The hydrocarbyl ether referred to in this invention is an ether compound wherein a hydrogen atom of a hydroxyl group in ingredients (A1)-(A4) is substituted by a hydrocarbyl group (residue obtained by removing one hydrogen atom from a hydrocarbon). Ingredient (A5) may be a partially etherized compound wherein part of the hydroxyl groups of ingredients (A1)-(A4) are hydrocarbyl etherized, or a fully etherized compound wherein all the hydroxyl groups are hydrocarbyl etherized, but from the viewpoint of lubricating properties, a partially etherized compound is preferred.

The hydrocarbyl group is preferably a monovalent hydrocarbon group having 1-24 carbon atoms, specifically an alkyl group having 1-24 carbon atoms, an alkylene group having 2-24 carbon atoms, a cycloalkyl group having 5-7 carbon atoms, an alkyl cycloalkyl group having 6-11 carbon atoms, an aryl group having 6-10 carbon atoms, an alkyl aryl group having 7-18 carbon atoms or an aryl alkyl group having 7-18 carbon atoms.

Examples of an alkyl group having 1-24 carbon atoms are methyl, ethyl, n-propyl, isopropyl, n-butyl, isobutyl, sec-butyl, tert-butyl, straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched heptadecyl, straight-chain or branched octadecyl, straight-chain or branched nonadecyl, straight-chain or branched icosyl, straight-chain or branched henicosyl, straight-chain or branched docosyl, straight-chain or branched tricosyl and straight-chain or branched tetracosyl.

Examples of an alkenyl group having 2-24 carbon atoms are vinyl, straight-chain or branched propenyl, straight-chain or branched butenyl, straight-chain or branched pentenyl, straight-chain or branched hexenyl, straight-chain or branched heptenyl, straight-chain or branched octenyl, straight-chain or branched nonenyl, straight-chain or branched decenyl, straight-chain or branched undecenyl, straight-chain or branched dodecenyl, straight-chain or branched tridecenyl, straight-chain or branched tetradecenyl, straight-chain or branched pentadecenyl, straight-chain or branched hexadecenyl, straight-chain or branched heptadecenyl, straight-chain or branched octadecenyl, straight-chain or branched nonadecenyl, straight-chain or branched icosenyl, straight-chain or branched henicosenyl, straight-chain or branched docosenyl, straight-chain or branched tricosenyl and straight-chain or branched tetracosenyl.

Examples of a cycloalkyl group having 5-7 carbon atoms are cyclopentyl, cyclohexyl and cycloheptyl. Examples of an alkyl cycloalkyl group having 6-11 carbon atoms are methyl cyclopentyl and dimethyl cyclopentyl (including all structural isomers), methyl ethyl cyclopentyl (including all structural isomers), diethyl cyclopentyl (including all structural isomers), methyl cyclohexyl and dimethyl cyclohexyl (including all structural isomers), methyl ethyl cyclohexyl (including all structural isomers), diethyl cyclohexyl (including all structural isomers), methyl cycloheptyl and dimethyl cycloheptyl (including all structural isomers), methyl ethyl cycloheptyl (including all structural isomers) and diethyl cycloheptyl (including all structural isomers).

Examples of an aryl group having 6-10 carbon atoms are phenyl and naphthyl. Examples of an alkyl aryl group having 7-18 carbon atoms are tolyl (including all structural isomers), xylyl (including all structural isomers), ethyl phenyl (including all structural isomers), straight-chain or branched propyl phenyl (including all structural isomers), straight-chain or branched butyl phenyl (including all structural isomers), straight-chain or branched pentyl phenyl (including all structural isomers), straight-chain or branched hexyl phenyl (including all structural isomers), straight-chain or branched heptyl phenyl (including all structural isomers), straight-chain or branched octyl phenyl (including all structural isomers), straight-chain or branched nonyl phenyl (including all structural isomers), straight-chain or branched decyl phenyl (including all structural isomers), straight-chain or branched undecyl phenyl (including all structural isomers) and straight-chain or branched dodecyl phenyl (including all structural isomers).

Examples of an aryl alkyl group having 7-12 carbon atoms are benzyl, phenyl ethyl and phenyl propyl (including propyl isomers), phenyl butyl (including propyl isomers), phenyl pentyl (including pentyl isomers) and phenyl hexyl (including hexyl isomers).

Among the aforesaid hydrocarbyl groups, from the viewpoint of superior lubricating properties, a straight-chain or branched alkyl group having 2-18 carbon atoms or a straight-chain or branched alkenyl group having 2-18 carbon atoms is preferred, and a straight-chain or branched alkyl group having 3-12 carbon atoms or an oleyl group (residue obtained by removing a hydroxyl group from an oleyl alcohol) is more preferred.

The following ingredients (A5-1)-(A5-4) are included in ingredient (A5).

(A5-1) Hydrocarbyl ether of alkylene oxide adduct of polyhydric alcohol having 3-6 hydroxyl groups (A5-2) Hydrocarbyl ether of polyalkylene glycol (A5-3) Hydrocarbyl ether of trihydric alcohol having 3-20 carbon atoms apart from (A1)

(A5-4) Hydrocarbyl ether of dihydric alcohol having 2-20 carbon atoms apart from (A2).

In ingredients (A5-1), (A5-2) and (A5-4), specific examples and preferred aspects of structures derived from ingredients (A1), (A2) and (A4) are identical to the case of ingredients (A1), (A2) and (A4) respectively, so their description will not be repeated below.

The trihydric alcohol in ingredient (A5-3) may be the trihydric alcohols mentioned in the description of ingredient (A3), and among these, the hydrocarbyl ethers or partial esters of glycerine, 1,2,3-butane triol, 1,2,4-butane triol, 1,2,5-pentane triol, 1,3,5-pentane triol, 1,2,3-pentane triol, 1,2,4-pentane triol, 1,2,6-hexane triol, 1,2,3-hexane triol, 1,2,4-hexane triol, 1,2,5-hexane triol, 1,3,4-hexane triol, 1,3,5-hexane triol, 1,3,6-hexane triol and 1,4,5-hexane triol are preferred.

In the present invention, ingredient (A5) may be one of the ingredients (A5-1)-(A5-4) used alone, or two or more may be used together.

Ingredient (A6) is a hydrocarbyl ester of ingredients (A1)-(A4). The meaning of hydrocarbyl ester in the context of the invention is an esterified compound wherein a hydrogen atom of a hydoxyl group in ingredients (A1)-(A4) is substituted by an acyl group of a hydrocarbyl group. Ingredient (A6) may be a partially esterified compound wherein part of the hydroxyl groups in ingredients (A1)-(A4) are hydrocarbyl esterified, or a fully esterified compound wherein all the hydroxyl groups are hydrocarbyl esterified, but from the viewpoint of lubricating properties, a partially esterified compound is preferred.

For hydrocarbyl esterification, a carboxylic acid is normally used. This carboxylic acid may be a monobasic acid or a polybasic acid, but a monobasic acid is preferred and a fatty acid having 6-24 carbon atoms is more preferred. The monobasic acid may be straight-chain or branched.

The monobasic acid may also be a saturated fatty acid, an unsaturated fatty acid or a mixture thereof.

Examples of a saturated fatty acid are straight-chain or branched hexanoic acid, straight-chain or branched octanoic acid, straight-chain or branched nonanoic acid, straight-chain or branched decanoic acid, straight-chain or branched undecanoic acid, straight-chain or branched dodecanoic acid, straight-chain or branched tridecanoic acid, straight-chain or branched tetradecanoic acid, straight-chain or branched pentadecanoic acid, straight-chain or branched hexadecanoic acid, straight-chain or branched octadecanoic acid, straight-chain or branched hydroxy octadecanoic acid, straight-chain or branched nonadecanoic acid, straight-chain or branched eicosanic acid, straight-chain or branched heneicosanoic acid, straight-chain or branched docosanoic acid, straight-chain or branched tricosanoic acid and straight-chain or branched tetracosanoic acid.

Examples of an unsaturated fatty acid are straight-chain or branched hexenoic acid, straight-chain or branched heptenoic acid, straight-chain or branched octenoic acid, straight-chain or branched nonenoic acid, straight-chain or branched decenoic acid, straight-chain or branched undecenoic acid, straight-chain or branched dodecenoic acid, straight-chain or branched tridecenoic acid, straight-chain or branched tetradecenoic acid, straight-chain or branched pentadecenoic acid, straight-chain or branched hexadecenoic acid, straight-chain or branched octadecenoic acid, straight-chain or branched hydroxy octadecenoic acid, straight-chain or branched nonadecenoic acid, straight-chain or branched eicosenoic acid, straight-chain or branched heneicosenoic acid, straight-chain or branched docosenoic acid, straight-chain or branched tricosenoic acid, straight-chain or branched tetracosenoic acid.

Among these, saturated fatty acids having 8-20 carbon atoms, unsaturated fatty acids having 8-20 carbon atoms and mixtures thereof are preferred. These carboxylic acid may be used alone, or a mixture of two or more may be used together.

The following ingredients (A6-1)-A6-4) are included in ingredient (A6).

(A6-1) Hydrocarbyl ester of alkylene oxide adduct of polyhydric alcohol having 3-6 hydroxyl groups (A6-2) Hydrocarbyl ester of polyalkylene glycol (A6-3) Hydrocarbyl ester of trihydric alcohol having 3-20 carbon atoms apart from (A1)

(A6-3) Hydrocarbyl ester of dihydric alcohol having 2-20 carbon atoms apart from (A2)

In ingredients (A6-1), (A6-2) and (A6-4), specific examples and preferred aspects of structures derived from ingredients (A1), (A2) and (A4) are identical to the case of ingredients (A1), (A2) and (A4) respectively, so their description will not be repeated below.

The trihydric alcohol in ingredient (A6-3) may be the trihydric alcohols mentioned in the description of ingredient (A3), and among these, the hydrocarbyl ethers or partial esters of glycerine, 1,2,3-butane triol, 1,2,4-butane triol, 1,2,5-pentane triol, 1,3,5-pentane triol, 1,2,3-pentane triol, 1,2,4-pentane triol, 1,2,6-hexane triol, 1,2,3-hexane triol, 1,2,4-hexane triol, 1,2,5-hexane triol, 1,3,4-hexane triol, 1,3,5-hexane triol, 1,3,6-hexane triol and 1,4,5-hexane triol are preferred.

In the invention, ingredient (A6) may be one of the ingredients (A6-1)-(A6-4) used alone, or two or more may be used together.

In the invention, one moiety selected from among ingredients (A1)-(A6) may be used alone, or two or more may be used together. Among ingredients (A1)-(A6), from the viewpoint of superior lubricating properties, ingredients (A2), (A4) and (A5) are preferred, but ingredients (A2) and (A4) are more preferred.

The content of ingredients (A1)-(A6) (if two or more are contained, the total content) in the second refrigerating machine oil composition of the invention is preferably 0.01 mass % or more, more preferably 0.05 mass % or more and still more preferably 0.1 mass % or more, based on the total amount of composition. If the content is less than 0.01 mass %, lubricating properties tend to be insufficient. On the other hand, the content of ingredients (A1)-(A6) is preferably 3.0 mass % or less, more preferably 2.5 mass % or less and still more preferably 2.0 mass % or less based on the total amount of composition. Even if the content exceeds 3.0 mass %, an effect commensurate with the higher content is not obtained, and oxidation stability in an air atmosphere tends to decline.

The first, second and third refrigerating machine oil compositions of the invention may respectively comprise the aforesaid base oils and additives, but they preferably further contain (B) a phosphorothionate. The phosphorothionate is preferably a compound represented by the following general formula (27):

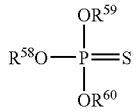

(27)

In the formula, $R^{58}$, $R^{59}$ and $R^{60}$ may be identical or different, and are respectively hydrocarbon groups having 1-24 carbon atoms. The hydrocarbon group having 1-24 carbon atoms represented by $R^{58}$-$R^{60}$ may be an alkyl group, cycloalkyl group, alkenyl group, alkyl cycloalkyl group, aryl group, alkyl aryl group or aryl alkyl group.

Examples of an alkyl group are methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl (these alkyl groups may be straight-chain or branched).

The cycloalkyl group may be a cycloalkyl group having 5-7 carbon atoms such as cyclopentyl, cyclohexyl and cycloheptyl. The alkyl cycloalkyl group may be an alkyl cycloalkyl group having 6-11 carbon atoms such as methyl cyclopentyl, dimethyl cyclopentyl, methyl ethyl cyclopentyl, diethyl cyclopentyl, methyl cyclohexyl, dimethyl cyclohexyl, methyl ethyl cyclohexyl, diethyl cyclohexyl, methyl cycloheptyl, dimethyl cycloheptyl, methyl ethyl cycloheptyl or diethyl cycloheptyl (the substitution position of the cycloalkyl group by the alkyl group is optional).

Examples of the alkenyl group are butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl and octadecenyl (these alkenyl groups may be straight-chain or branched, and the position of the double bond is optional).

Examples of an aryl group are phenyl and naphthyl. In addition,

The alkyl aryl group is an alkyl aryl group having 7-18 carbon atoms such as tolyl group, xylyl, ethyl phenyl, propyl phenyl, butyl phenyl, pentyl phenyl, hexyl phenyl, heptyl phenyl, octyl phenyl, nonyl phenyl, decyl phenyl, undecyl phenyl and dodecyl phenyl (the alkyl group may be straight-chain or branched, and the substitution position of the aryl group is optional).

The aryl alkyl group is an aryl alkyl group having 7-12 carbon atoms such as benzyl, phenyl ethyl, phenyl propyl, phenyl butyl, phenyl pentyl and phenyl hexyl (these alkyl groups may be straight-chain or branched).

The hydrocarbon group having 1-24 carbon atoms represented by $R^{58}$-$R^{60}$ is preferably an alkyl group, aryl group or alkyl aryl group, but an alkyl group having 4-18 carbon atoms, alkyl aryl group having 7-24 carbon atoms and phenyl are more preferred.

Examples of the phosphorothionate represented by the general formula (27) are tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyldiphenyl phosphorothionate, xylenyldiphenyl phosphorothionate, tris(n-propyl phenyl) phosphorothionate, tris(isopropyl phenyl) phosphorothionate, tris(n-butyl phenyl)phosphorothionate, tris(isobutyl phenyl) phosphorothionate, tris(s-butyl phenyl) phosphorothionate and tris (t-butyl phenyl) phosphorothionate. Mixtures thereof can also be used.

The blending amount of (B) phosphorothionate in the first, second and third refrigerating machine oil compositions of the invention is preferably 0.01-5 mass % or less based on the total amount of composition. By arranging the phosphorothionate content to be within the aforesaid range, abrasion resistance and stability (in particular, thermal/oxidation stability) of the refrigerating machine oil composition can be further enhanced. More specifically, from the viewpoint of obtaining a high degree of abrasion resistance, the addition amount of phosphorothionate is preferably 0.01 mass % or more, and more preferably 0.1 mass % or more. If the content exceeds this amount, a decrease of abrasion commensurate with the higher content is not obtained, and it can lead to less stability or corrosion abrasion, so the phosphorothionate content is preferably 5 mass % or less, more preferably 3 mass % or less and still more preferably 1 mass % or less.

The first, second and third refrigerating machine oil compositions of the invention may further contain (C) a phosphorus-type additive apart from the aforesaid phosphorothionate (hereafter referred to as phosphorus-type additive (C)). The phosphorus-type additive (C) is preferably at least one phosphorus compound selected from a group comprising phosphoric acid esters, acidic phosphoric acid esters, amine salts of phosphoric acid esters, chlorinated phosphoric acid esters and phosphorous acid esters. These phosphorous compounds are esters of phosphoric acid or phosphorous acid with alkanols or polyether alcohols, or derivatives thereof.

Examples of phosphoric acid esters are tributylphosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylenyl phosphate, cresyldiphenylphosphate and xylenyl diphenyl phosphate;

Examples of acidic phosphoric acid esters are monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate and dioleyl acid phosphate;

Examples of amine salts of acidic phosphoric acid esters are salts of the aforesaid acidic phosphoric acid esters with methyl amine, ethyl amine, propyl amine, butyl amine, pentyl amine, hexyl amine, heptyl amine, octyl amine, dimethyl amine, diethyl amine, dipropyl amine, dibutyl amine, dipentyl amine, dihexyl amine, diheptyl amine, dioctyl amine, trimethyl amine, triethyl amine, tripropyl amine, tributyl amine, tripentyl amine, trihexyl amine, triheptyl amine and trioctyl amine;

Examples of chlorinated phosphoric acid esters are tris-dichloropropyl phosphate, tris-chloroethyl phosphate, tris-chlorophenyl phosphate and polyoxyalkylene-bis[di(chloroalkyl)]phosphate.

Examples of phosphorous acid esters are dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite and tricresyl phosphite. Mixtures thereof can also be used.

The content of (C) the phosphorus-type additive in the first, second and third refrigerating machine oil compositions of the invention is preferably 0.01-5 mass % or less based on the total amount of composition. By arranging the content of the ester-type additive to be within the aforesaid range, abrasion resistance and stability (in particular, thermal/oxidation stability) can be further enhanced. More specifically, from the viewpoint of obtaining a high degree of abrasion resistance, the addition amount of phosphorus-type additive is preferably 0.01 mass % or more, and more preferably 0.1 mass % or more. If the content exceeds this amount, a decrease of abrasion commensurate with the higher content is not obtained, and it can lead to less stability or corrosion abrasion, so the phosphorus-type additive content is preferably 5 mass % or less, more preferably 4 mass % or less and still more preferably 3 mass % or less.

Among the refrigerating machine oil compositions of the invention, the second and third refrigerating machine oil compositions preferably contain both (B) phosphorothionate and (C) phosphorus-type additive. Due to the concurrent use of (B) phosphorothionate and (C) phosphorus-type additive, the abrasion resistance of the refrigerating machine oil composition can be further enhanced.

The first, second and third refrigerating machine oil compositions of the invention preferably further contain (D) benzotriazole and/or a derivative thereof. By containing (D) benzotriazole and/or a derivative thereof, a greater enhancement of abrasion resistance and friction properties is obtained.

Benzotriazole is the compound represented by the following formula (28):

(28)

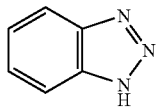

Examples of benzotriazole derivatives are the alkyl benzotriazole represented by the following general formula (29), or the (alkyl)aminoalkyl benzotriazole represented by the following general formula (30):

(29)

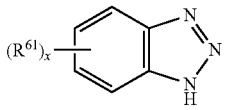

(30)

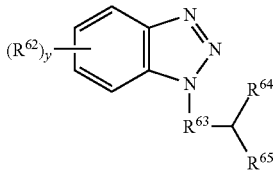

In formula (29), $R^{61}$ is a straight-chain or branched alkyl group having 1-4 carbon atoms, preferably methyl or ethyl, and x is 1-3, preferably 1 or 2. $R^{61}$ may be for example methyl, ethyl, n-propyl, isopropyl, n-butyl, isobutyl, sec-butyl or tert-butyl. In the alkyl benzotriazole represented by the general formula (14), from the viewpoint of superior anti-oxidation properties, $R^{75}$ is methyl or ethyl, and x is 1 or 2, e.g., methyl benzotriazole (tolyltriazole), dimethyl benzotriazole, ethyl benzotriazole, ethyl methyl benzotriazole, diethyl benzotriazole, or mixtures thereof.

In formula (30), $R^{62}$ is a straight-chain or branched alkyl group having 1-4 carbon atoms, preferably methyl or ethyl, $R^{63}$ is a methylene group or ethylene group, $R^{64}$, $R^{65}$ may be identical or different, and are a hydrogen atom, or a straight-chain or branched alkyl group having 1-18 carbon atoms, but preferably a straight-chain or branched alkyl group having 1-12 carbon atoms, and y is 0-3, but preferably 0 or 1. $R^{62}$ may be for example methyl, ethyl, n-propyl, isopropyl, n-butyl, isobutyl, sec-butyl or tert-butyl. $R^{64}$, $R^{65}$ may each be for example a hydrogen atom, or an alkyl group such as methyl, ethyl, n-propyl, isopropyl, n-butyl, isobutyl, sec-butyl, tert-butyl, straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched hepta decyl and straight-chain or branched octadecyl group.

In the (alkyl)amino benzotriazole represented by formula (30), from the viewpoint of superior anti-oxidation properties, it is preferred that $R^{62}$ is methyl, y is 0 or 1, $R^{63}$ is methylene or ethylene, $R^{64}$, $R^{65}$ are a dialkyl aminoalkyl benzotriazole or dialkyl aminoalkyl tolyltriazole which are straight-chain or branched alkyl groups having 1-12 carbon atoms, or mixtures thereof. Examples of these dialkyl aminoalkyl benzotriazoles are dimethyl amino methyl benzotriazole, diethyl amino methyl benzotriazole, di(straight-chain or branched) propyl amino methyl benzotriazole, di(straight-chain or branched) butyl amino methyl benzotriazole, di(straight-chain or branched) pentyl amino methyl benzotriazole, di(straight-chain or branched) hexyl amino methyl benzotriazole, di(straight-chain or branched) heptyl amino methyl benzotriazole, di(straight-chain or branched) octyl amino methyl benzotriazole, di(straight-chain or branched) nonyl amino methyl benzotriazole, di(straight-chain or branched) decyl amino methyl benzotriazole, di(straight-chain or branched) undecyl amino methyl benzotriazole, and di(straight-chain or branched) dodecyl amino methyl benzotriazole; dimethyl amino ethyl benzotriazole, diethyl amino ethyl benzotriazole, di(straight-chain or branched) propyl amino ethyl benzotriazole, di(straight-chain or branched) butyl amino ethyl benzotriazole, di(straight-chain or branched) pentyl amino ethyl benzotriazole, di(straight-chain or branched) hexyl amino ethyl benzotriazole, di(straight-chain or branched) heptyl amino ethyl benzotriazole, di(straight-chain or branched) octyl amino ethyl benzotriazole, di(straight-chain or branched) nonyl amino ethyl benzotriazole, di(straight-chain or branched) decyl amino ethyl benzotriazole, di(straight-chain or branched) undecyl amino ethyl benzotriazole, di(straight-chain or branched) dodecyl amino ethyl benzotriazole; dimethyl amino methyl tolyl triazole, diethyl amino methyl tolyl triazole, di(straight-chain or branched) propyl amino methyl tolyl triazole, di(straight-chain or branched) butyl amino methyl tolyl triazole, di(straight-chain or branched) pentyl amino methyl tolyl triazole, di(straight-chain or branched) hexyl amino methyl tolyl triazole, di(straight-chain or branched) heptyl amino methyl tolyl triazole, di(straight-chain or branched) octyl amino methyl tolyl triazole, di(straight-chain or branched) nonyl amino methyl tolyl triazole, di(straight-chain or branched) decyl amino methyl tolyl triazole, di(straight-chain or branched) undecyl amino methyl tolyl triazole, or di(straight-chain or branched) dodecyl amino methyl tolyl triazole; dimethyl amino ethyl tolyl triazole, diethyl amino ethyl tolyl triazole, di(straight-chain or branched) propyl amino ethyl tolyl, triazole, di(straight-chain or branched) butyl amino ethyl tolyl triazole, di(straight-chain or branched) pentyl amino ethyl tolyl triazole, di(straight-chain or branched) hexyl amino ethyl tolyl triazole, di(straight-chain or branched) heptyl amino ethyl tolyl triazole, di(straight-chain or branched) octyl amino ethyl tolyl triazole, di(straight-chain or branched) nonyl amino ethyl tolyl triazole, di(straight-chain or branched) decyl amino ethyl tolyl triazole, di(straight-chain or branched) undecyl amino ethyl tolyl triazole, or di(straight-chain or branched) dodecyl amino ethyl tolyl triazole, or a mixture thereof.

The content of (D) benzotriazole and/or its derivative in the first, second and third refrigerating machine oil compositions of the invention is preferably 0.001 mass % or more, but more preferably 0.005 mass % or more based on the total amount of composition. If it is less than 0.001 mass %, the improvement of abrasion resistance and frictional properties due to the presence of the benzotriazole and/or its derivative may be insufficient. The content of the benzotriazole and/or its derivative is preferably 1.0 mass % or less and more preferably 0.5 mass % or less based on the total amount of composition. If it exceeds 1.0 mass %, improvement of abrasion resistance and frictional properties commensurate with the higher content may not be obtained, which is uneconomical.

In order to improve thermal/hydrolytic stability and frictional properties, (E) an epoxy compound is preferably blended with the first, second and third refrigerating machine oil compositions of the invention. Preferred examples of (E) the epoxy compound are the following compounds (E1)-(E8):

(E1) Phenyl glycidyl ether type epoxy compounds
(E2) Alkyl glycidyl ether type epoxy compounds
(E3) Glycidyl ester type epoxy compounds
(E4) Allyl oxirane compounds
(E5) Alkyl oxirane compounds
(E6) Cycloaliphatic epoxy compounds
(E7) Epoxidized fatty acid monoesters
(E8) Epoxidized vegetable oils (E1) Examples of a phenyl glycidyl ether type epoxy compound are phenyl glycidyl ethers or alkyl phenyl glycidyl ethers. The alkyl phenyl glycidyl ether mentioned here may for example have 1-3 alkyl groups with 1-13 carbon atoms, among which those having one alkyl group with 4-10 carbon atoms are preferred, e.g., n-butyl phenyl glycidyl ether, i-butyl phenyl glycidyl ether, sec-butyl phenyl glycidyl ether, tert-butyl phenyl glycidyl ether, pentyl phenyl glycidyl ether, hexyl phenyl glycidyl ether, heptyl phenyl glycidyl ether, octyl phenyl glycidyl ether, nonyl phenyl glycidyl ether and decyl phenyl glycidyl ether.

(E2) Examples of an alkyl glycidyl ether type epoxy compound are decyl glycidyl ether, undecyl glycidyl ether, dodecyl glycidyl ether, tridecyl glycidyl ether, tetradecyl glycidyl ether, 2-ethyl hexyl glycidyl ether, neopentyl glycol diglycidyl ether, trimethylolpropane triglycidyl ether, pentaerythritol tetraglycidyl ether, 1,6-hexane diol diglycidyl ether, sorbitol polyglycidyl ether, polyalkylene glycol monoglycidyl ether and polyalkylene glycol diglycidyl ether.

(E3) Examples of a glycidyl ester type epoxy compound are the compounds represented by the following general formula (31):

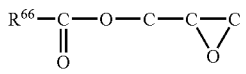

(31)

[in the formula, $R^{66}$ is a hydrocarbon group having 1-18 carbon atoms].

In formula (31), $R^{66}$ is a hydrocarbon group having 1-18 carbon atoms, examples of such a hydrocarbon group being an alkyl group having 1-18 carbon atoms, an alkenyl group having 2-18 carbon atoms, a cycloalkyl group having 5-7 carbon atoms, an alkyl cycloalkyl group having 6-18 carbon atoms, an aryl group having 6-10 carbon atoms, an alkyl aryl group having 7-18 carbon atoms, and an aryl alkyl group having 7-18 carbon atoms. Among these, an alkyl group having 5-15 carbon atoms, an alkenyl group having 2-15 carbon atoms, a phenyl group, and an alkyl phenyl group having an alkyl group with 1-4 carbon atoms, are preferred.

(E3) Among glycidyl ester type epoxy compounds, glycidyl-2,2-dimethyl octanoate, glycidyl benzoate, glycidyl-tert-butyl benzoate, glycidyl acrylate and glycidyl methacrylate are specifically preferred.

(E4) Examples of an allyl oxirane compound are 1,2-epoxyvinyl benzene and 1,2-alkyl-epoxy vinyl benzene.

(E5) Examples of an alkyl oxirane compound are 1,2-epoxy butane, 1,2-epoxy pentane, 1,2-epoxy hexane, 1,2-epoxy heptane, 1,2-epoxy octane, 1,2-epoxy nonane, 1,2-epoxy decane, 1,2-epoxy undecane, 1,2-epoxy dodecane, 1,2-epoxy tridecane, 1,2-epoxy tetradecane, 1,2-epoxy pentadecane, 1,2-epoxy hexadecane, 1,2-epoxy heptadecane, 1,1,2-epoxy octadecane, 2-epoxy nonadecane and 1,2-epoxy eicosane.

(E6) The cycloaliphatic epoxy compound may be a compound wherein the carbon atoms forming the epoxy group directly form an alicyclic ring, as in the compound represented by the general formula (32):

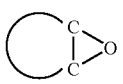

(32)

Examples of (E6) the alicyclic epoxy compound are 1,2-epoxy cyclohexane, 1,2-epoxy cyclopentane, 3,4-epoxy cyclohexyl methyl-3,4-epoxy cyclohexane carboxylate, bis (3,4-epoxy cyclohexyl methyl) adipate, exo-2,3-epoxy norbornane, bis(3,4-epoxy-6-methyl cyclohexyl)adipate, 2-(7-oxabicyclo[4.1.0]hept-3-yl)-spiro(1,3-dioxane-5,3'-[7] oxabicyclo[4.1.0]heptane), 4-(1'-methyl epoxy ethyl)-1,2-epoxy-2-methyl cyclohexane, and 4-epoxy ethyl-1,2-epoxy cyclohexane.

Examples of (E7) the epoxidized fatty acid monoester are esters of epoxidized fatty acids having 12-20 carbon atoms with alcohols or phenols and alkyl phenols having 1-8 carbon atoms. In particular, butyl, hexyl, benzyl, cyclohexyl, methoxy ethyl, octyl, phenyl and butyl phenyl esters of epoxy stearic acid are preferred.

Specific examples of (E8) epoxidized vegetable oil are the epoxy compounds of vegetable oils, such as soybean oil, linseed oil and cotton seed oil.

(E) The epoxy compound may be one of the above ingredients (E1)-(E8) used alone, or two or more may be used together. In this invention, from the viewpoint of further enhancing thermal/hydrolytic stability, (E1) a phenyl glycidyl ether type epoxy compound, (E3) a glycidyl ester type epoxy compound, (E6) an alicyclic epoxy compound and (E7) an epoxidized fatty acid monoester are preferred, and (E3) a glycidyl ester type epoxy compound and (E6) an alicyclic epoxy compound are more preferred.

When (E) the epoxy compound is blended with the first, second, and third refrigerating machine oil composition of this invention, the blending proportion is not particularly limited, but the epoxy compound is blended in an amount of 0.1-5.0 mass %, but more preferably 0.2-2.0 mass %, based on the total amount of refrigerating machine oil composition (based on sum amount of base oil and total blended additives).

In the first, second and third refrigerating machine oil composition of this invention, (F) an oily agent may be blended. Examples of (F) the oily agent are (F1) a monohydric alcohol oily agent, and (F2) a carboxylic acid oily agent.

(F1) The monohydric alcohol oily agent normally has 1-24 carbon atoms, but preferably 1-12 carbon atoms and more preferably 1-8 carbon atoms. This alcohol may be straight-chain or branched, and saturated or unsaturated. The monohydric alcohol having 1-24 carbon atoms may be for example methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetra-decanol, straight-chain or branched pentadecanol, straight-chain or branched hexadecanol, straight-chain or branched heptadecanol, straight-chain or branched octadecanol, straight-chain or branched nonadecanol, straight-chain or branched icosanol, straight-chain or branched henicosanol, straight-chain or branched tricosanol, straight-chain or branched tetracosanol, or a mixture thereof.

From the viewpoint of improvement of frictional properties and abrasion resistance, the number of carbon atoms in (F1) the monohydric alcohol oily agent is 6 or more, more preferably 8 or more and most preferably 10 or more. Since deposition may tend to increase in the refrigerant atmosphere if the number of carbon atoms is too large, the number of carbon atoms is preferably 20 or less, more preferably 18 or less, and most preferably 16 or less.

(F2) The carboxylic acid oily agent may be a monobasic acid or a polybasic acid. This carboxylic acid may be for example the monobasic acids and polybasic acids mentioned in the description of the ester oily agent. Among these, from the viewpoint of improving frictional properties and abrasion resistance, a monobasic acid is preferred.

From the viewpoint of improvement of frictional properties and abrasion resistance, the number of carbon atoms in (F2) the monohydric alcohol oily agent is preferably 6 or more, more preferably 8 or more and most preferably 10 or more. Since deposition may tend to increase in the refrigerant atmosphere if the number of carbon atoms in the carboxylic acid oily agent is too large, the number of carbon atoms is preferably 20 or less, more preferably 18 or less, and most preferably 16 or less.

In the first, second and third refrigerating machine oil composition of this invention, as (F) the oily agent, one of (F1) the monohydric alcohol oily agent or (F2) the carboxylic acid oily agent may be used alone, or two or more may be used together.

(F) The content of the oily agent is optional, but from the viewpoint of obtaining a remarkable enhancement of abrasion resistance and frictional properties, it is preferably 0.01 mass % or more, more preferably 0.05 mass % or more and still more preferably 0.1 mass % or more. From the viewpoint of preventing deposition in the refrigerant atmosphere at low temperature, and of superior thermal/oxidation stability of the refrigerating machine oil composition, this content is preferably 10 mass % or less, more preferably 7.5 mass % or less and still more preferably 5 mass % or less based on the total amount of composition.

In order to further improve the performance of the first, second and third refrigerating machine oil compositions of the invention, if required, refrigerating machine oil additives known in the art may also be used, for example, a phenolic anti-oxidant such as di-tert-butyl-p-cresol or bisphenol A, an amine anti-oxidant such as phenyl-α-naphthyl amine, N,N-di(2-naphthyl)-p-phenylene diamine, an abrasion resistant agent such as zinc phosphorodithioate, an extreme pressure agent such as a chlorinated paraffin or sulfur compound, a silicone or other defoaming agent, a viscosity index improver, a pour point depressant and a detergent dispersant. These may be used alone, or plural thereof may be blended together. The total blending amount of these additives is not particularly limited, but it is preferably 10 mass % or less and more preferably 5 mass % or less based on the total amount of refrigerating machine oil composition (based on the sum total of base oil and all blended additives).

The volume resistivity of the first, second and third refrigerating machine oil compositions of this invention is not particularly limited provided that it is $1.0\times10^9$ Ω-cm or more. In particular, when they are used for a closed type refrigerating machine, there is a tendency to require high electrical insulating properties. Volume resistivity here means the value [Ω-cm] at 25° C. measured based on JIS C 2101, "Electric Insulating Oil Test Methods".

The moisture content of the first, second and third refrigerating machine oil compositions of the invention is not particularly limited, but it is preferably 200 ppm or less, more preferably 100 ppm or less and still more preferably 50 ppm or less based on the total amount of refrigerating machine oil composition. In particular, when they are used for a closed type refrigerating machine, from the viewpoint of the effect on thermal/hydrolytic stability and electrical insulation properties of the oil, it is preferred that the moisture content is small.

The acid number of the first, second and third refrigerating machine oil compositions of the invention is not particularly limited, but in order to prevent corrosion of the metal used for the refrigerating machine or piping, it is preferably 0.1 mg KOH/g or less and more preferably 0.05 KOH/g or less. The acid number mentioned here means the value [mgKOH/g] measured based on JIS K 2501, "Petroleum Product and Lubricating Oil Neutralization Value Test Methods".

The ash content of the first, second and third refrigerating machine oil compositions of the invention is not particularly limited, but in order to enhance thermal/hydrolytic stability and suppress sludge, it is preferably 100 ppm or less and more preferably 50 ppm or less. In this invention, ash content means the value [ppm] measured based on JIS K 2272, "Ash Content of Crude oil and Petroleum Products, and Sulfuric Acid Ash Content Test Methods".

The refrigerant used in the first, second and third refrigerating machine oil compositions of the invention may be an HFC refrigerant, a perfluorinated ether-based refrigerant such as a perfluoroether, a non-fluorinated ether-based refrigerant such as dimethyl ether and carbon dioxide or ammonia, or a natural refrigerant such as a hydrocarbon. These may be used alone, or a mixture of two or more may be used.

The HFC refrigerant may be a hydrofluorocarbon having 1-3, but preferably 1-2, carbon atoms. Specific examples are HFC such as difluoromethane (HFC-32), trifluoromethane (HFC-23), pentafluoroethane (HFC-125), 1,1,2,2-tetra-fluoroethane (HFC-134), 1,1,1,2-tetrafluoroethane (HFC-134a), 11,1-trifluoroethane (HFC-143a), and 1,1-difluoroethane (HFC-152a), or a mixture of two or more thereof.

These refrigerants are selected according to the required performance, but suitable examples are HFC-32 alone; HFC-23 alone; HFC-134a alone; HFC-125 alone; mixture of HFC-134a/HFC-32=60-80 mass %/40-20 mass %; mixture of HFC-32/HFC-125=40-70 mass %/60-30 mass %; mixture of HFC-125/HFC-143a=40-60 mass %/60-40 mass %; mixture of HFC-134a/HFC-32/HFC-125=60 mass %/30 mass %/10 mass %; mixture of HFC-134a/HFC-32/HFC-125=40-70 mass %/15-35 mass %/5-40 mass %; and a mixture of HFC-125/HFC-134a/HFC-143a=35-55 mass %/1-15 mass %/40-60 mass %. More specific examples are a mixture of HFC-134a/HFC-32=70/30 mass %; mixture of HFC-32/HFC-125=60/40 mass %; mixture of HFC-32/HFC-125=50/50 mass % (R410A); mixture of HFC-32/HFC-125=45/55 mass % (R410B); mixture of HFC-125/HFC-143a=50/50 mass % (R507C); mixture of HFC-32/HFC-125/HFC-134a=30/10/60 mass %; mixture of HFC-32/HFC-125/HFC-134a=23/25/52 mass % (R407C); mixture of HFC-32/HFC-125/HFC-134a=25/15/60 mass % (R407E); and a mixture of HFC-125/HFC-134a/HFC-143a=44/4/52 mass % (R404A).

Examples of a natural refrigerant are carbon dioxide, ammonia, and hydrocarbons. Here, the hydrocarbon refrigerant is preferably a gas at 25° C. and 1 atmosphere. This may be an alkane, cycloalkane or alkene having 1-5 but preferably 1-4 carbon atoms. Specific examples are methane, ethylene, ethane, propylene, propane, cyclopropane, butane, isobutane, cyclobutane, methyl cyclopropane, or a mixture of two or more thereof. Among these, propane, butane, isobutane or mixtures thereof are preferred.

In a refrigerating machine, the first, second and third refrigerating machine oil compositions of the invention will ordinarily be in the form of a refrigerating machine fluid composition in admixture with the aforementioned refrigerant in a refrigerating machine. There are no particular restrictions on the mixing ratio of the refrigerating machine oil and refrigerant in the fluid composition, but it is preferably 1-500 parts by weight and more preferably 2-400 parts by weight of the refrigerating machine oil with respect to 100 parts by weight of the refrigerant.

The first, second and third refrigerating machine oil compositions of the invention provide a satisfactory balance between all of the required performance properties including lubricity, refrigerant miscibility, low temperature flow property and stability, and it may be suitably used in a refrigeration device or heat pump comprising a reciprocating or rotating open-type or semi-closed-type or closed-type compressor. Particularly when used in a refrigeration device employing aluminum-based members, it allows both the anti-abrasion property and thermal/chemical stability of the aluminum-based members to be kept at a high level. More specifically, such refrigeration devices include automobile air conditioners, dehumidifiers, refrigerators, refrigerated storage rooms, vending machines, showcases, refrigerating apparatuses in chemical plants and the like, home air conditioners, package air conditioners, and water heater heat pumps. The refrigerating machine oil composition of the invention may be used in a reciprocating, rotating or centrifugal type of compressor.

A typical construction for a refrigerant circulation system which may employ the first, second and third refrigerating machine oil compositions of the invention comprises a refrigerant compressor, condenser, expansion mechanism and evaporator connected in that order along the flow path, and if necessary is also equipped with a drier in the flow path.

Refrigerant compressors may be exemplified by a high-pressure vessel compressor housing a motor comprising a rotor and a stator in a closed vessel holding refrigerating machine oil, a rotary shaft fitted on the rotor and a compressor section connected to the motor via the rotary shaft, wherein high-pressure refrigerant gas discharged from the compressor section accumulates in the closed vessel, or a low-pressure vessel compressor housing a motor comprising a rotor and a stator in a closed vessel holding refrigerating machine oil, a rotary shaft fitted on the rotor and a compressor section connected to the motor via the rotary shaft, wherein high-pressure refrigerant gas discharged from the compressor section is directly expelled out of the closed vessel.

The insulating film used as an electrical insulating system material in the motor is preferably a crystalline plastic film having a glass transition temperature of 50° C. or higher, and specifically, for example, at least one type of insulating film selected from the group consisting of polyethylene terephthalate, polybutylene terephthalate, polyphenylene sulfide, polyetherether ketone, polyethylene naphthalate, polyamideimide and polyimide, or a composite film comprising a resin layer having a high glass transition temperature coated on a film having a low glass transition temperature, from the standpoint of avoiding deterioration in tensile strength and electrical insulating property. The magnet wire used in the motor preferably has an enamel coating having a glass transition temperature of 120° C. or higher, such as, for example, an enamel coating comprising a single layer of a polyester, polyesterimide, polyamide or polyamideimide, or comprising a composite coating of a layer with a low glass transition temperature as the lower layer and a layer with a high glass transition temperature as the upper layer. As composite coated enamel wires there may be mentioned those having a polyesterimide as the lower layer and a polyamideimide as the upper layer (AI/EI), and those having a polyester as the lower layer and a polyamideimide as the upper layer (AI/PE).

The drying agent filling the drier is preferably synthetic zeolite composed of compound alkali metal salts of silicic acid and aluminic acid, having a pore size of no greater than 3.3 angstroms and a carbon dioxide gas absorption capacity of no greater than 1.0% at 25° C. and a carbon dioxide partial pressure of 250 mmHg. As specific examples there may be mentioned XH-9, XH-10, XH-11 and XH-600 (trade names) by Union Showa Co., Ltd.

EXAMPLES

Hereafter, this invention will be described in more detail by means of specific examples, but it should be understood that the invention is not to be construed as being limited in anyway thereby.

Examples 1-120, Comparative Examples 1-20

In Examples 1-120 and Comparative Examples 1-20, refrigerating machine oil compositions having the compositions shown in TABLES 1-22 were prepared using the following base oils and additives, respectively.

(Base Oil)

Base oil 1: Tetraester of pentaerythritol with equimolar mixture of 2-ethyl hexanoic acid and 3,5,5-trimethyl hexanoic acid (kinematic viscosity at 40° C.: 68.5 $mm^2/s$, pour point: −25° C.).

Base oil 2: Diester of 1,2-cyclohexane dicarboxylic acid with 2-ethyl hexanol (kinematic viscosity at 40° C.: 15 $mm^2/s$, pour point: −40° C.)

Base oil 3: Random copolymer of vinyl ethyl ether and vinyl isobutyl ether (molar ratio of vinyl ethyl ether and vinyl isobutyl ether: 7/1, number average molecular weight: 900, kinematic viscosity at 40° C.: 68.5 $mm^2/s$, kinematic viscosity at 100° C.: 8 $mm^2/s$, pour point: −40° C.

Base oil 4: Naphthene type mineral oil (kinematic viscosity at 40° C.: 56.6 $mm^2/s$, pour point: −30° C.)

Base oil 5: Polypropylene glycol monomethyl ether (number average molecular weight: 1000, kinematic viscosity at 40° C.: 46 $mm^2/s$, kinematic viscosity at 100° C.: 10 $mm^2/s$, pour point: −40° C.).

(Ester Additive)

A1: methyl laurate

A2: propyl myristate

A3: butyl stearate

A4: diisobutyl adipate

A5: di-isodecyl adipate.

(Oily Agents for Comparison)

B1: 2-ethyl hexanoic acid methyl, B-2: oleyl alcohol, B3: stearic acid.

(Other Additives)

C1: DBPC, C2: glycidyl-2,2'-dimethyl octanoate, C3: benzotriazole

Next, evaluation tests were performed on the refrigerating machine oil compositions in Examples 1-120 and Comparative Examples 1-20. In TABLES 1-22, the "refrigerant" column shows the refrigerant used in the evaluation test.

[Lubrication Test 1]

A FALEX test (ASTM D2670) was performed under the following conditions while blowing a refrigerant into the refrigerating machine oil composition.

Test start temperature: 25° C.

Test time: 30 minutes

Load: 500N,

Refrigerant injection amount: 10 L/h.

The frictional coefficient was measured every other second from the start of the FALEX test, and the average (hereafter, "Average coefficient of friction 1") was calculated. The obtained results are shown in TABLES 1-22.

[Deposit Prevention Test]

First, the bilayer separation temperature of base oils 1-5 and a predetermined refrigerant was measured. The obtained results are as follows:

Base oil 1 and R410A: 10° C.

Base oil 2 and R134a: −35° C.

Base oil 3 and R410A: −50° C.

Base oil 4 and R22: 8° C.

Base oil 5 and R134a: −45° C.

Next, a deposit prevention test was performed based on JIS K 2211. Specifically, a sample solution containing 20 vol % of refrigerating machine oil composition and 80 vol % of refrigerant was prepared, the sample solution was cooled to a temperature 2° C. higher than the bilayer separation temperature of the base oil contained in the composition concerned, and the appearance of the composition was observed by viewing. The obtained results are shown in TABLES 1-22. In the tables, "A" means that the solution was transparent, and "B" that it was cloudy, respectively,

[Stability Test 1]

50 g of refrigerating machine oil composition and 15 g of refrigerant adjusted to a water content of 500 ppm were placed in a 200 ml autoclave, and the acid number (mgKOH/g) after maintaining for 2 weeks at 175° C. was measured. The stability was evaluated on the basis of the acid number at the time of using only Base oils 1-5 contained in each refrigerating machine oil composition (Comparative Examples 1, 8, 15, 22, 29). For example, in the case of Examples 1-17 and Comparative Examples 2-7, the base oil contained in these compositions is Base oil 1. Therefore, for these examples and comparative examples, taking the acid number of Comparative Example 1 using only Base oil 1 as a reference value, compositions for which the acid number was smaller or larger than the acid number of Comparative Example 1 by 0.2 mgKOH/g or less were referred to as "A", and compositions for which the acid number was larger than the acid number of Comparative Example 1 by more than 0.2 mgKOH/g, were referred to as "B".

The obtained results are shown in TABLES 1-22.

TABLE 1

| | | Example 1 | Example 2 | Example 3 | Example 4 | Example 5 | Example 6 | Example 7 | Example 8 | Example 9 |
|---|---|---|---|---|---|---|---|---|---|---|
| Base oil | | Base oil 1 | Base oil 1 | Base oil 1 | Base oil 1 | Base oil 1 | Base oil 1 | Base oil 1 | Base oil 1 | Base oil 1 |
| Additive | A1 | 0.1 | 0.5 | 5.0 | — | — | — | — | — | — |
| (mass %) | A2 | — | — | — | 0.1 | 0.5 | 5.0 | — | — | — |
| | A3 | — | — | — | — | — | — | 0.1 | 0.5 | 5.0 |
| | A4 | — | — | — | — | — | — | — | — | — |
| | A5 | — | — | — | — | — | — | — | — | — |
| Refrigerant | | R410A | R410A | R410A | R410A | R410A | R410A | R410A | R410A | R410A |
| Average coefficient of friction 1 | | 0.15 | 0.12 | 0.14 | 0.14 | 0.11 | 0.14 | 0.13 | 0.10 | 0.13 |
| Prevention of deposits | | A | A | A | A | A | A | A | A | A |
| Stability test 1 | | A | A | A | A | A | A | A | A | A |

TABLE 2

| | | Example 10 | Example 11 | Example 12 | Example 13 | Example 14 | Example 15 | Example 16 | Example 17 |
|---|---|---|---|---|---|---|---|---|---|
| Base oil | | Base oil 1 | Base oil 1 | Base oil 1 | Base oil 1 | Base oil 1 | Base oil 1 | Base oil 1 | Base oil 1 |
| Additive | A1 | — | — | — | — | — | — | 0.5 | 0.5 |
| (mass %) | A2 | — | — | — | — | — | — | — | — |
| | A3 | — | — | — | — | — | — | — | — |
| | A4 | 0.1 | 0.5 | 5.0 | — | — | — | — | — |
| | A5 | — | — | — | 0.1 | 0.5 | 2.0 | — | — |
| | C1 | — | — | — | — | — | — | 0.1 | 0.1 |
| | $C_2$ | — | — | — | — | — | — | 0.5 | 0.5 |
| | C3 | — | — | — | — | — | — | — | 0.001 |
| Refrigerant | | R410A | R410A | R410A | R410A | R410A | R410A | R410A | R410A |
| Average coefficient of friction 1 | | 0.15 | 0.13 | 0.14 | 0.15 | 0.14 | 0.15 | 0.14 | 0.11 |
| Prevention of deposits | | A | A | A | A | A | A | A | A |
| Stability test 1 | | A | A | A | A | A | A | A | A |

TABLE 3

| | | Comparative Example 1 | Comparative Example 2 | Comparative Example 3 | Comparative Example 4 |
|---|---|---|---|---|---|
| Base oil | | Base oil 1 | Base oil 1 | Base oil 1 | Base oil 1 |
| Additive | B1 | | 0.5 | | |
| (mass %) | B2 | | | 0.5 | |
| | B3 | | | | 0.5 |
| Refrigerant | | R410A | R410A | R410A | R410A |

TABLE 3-continued

| | Comparative Example 1 | Comparative Example 2 | Comparative Example 3 | Comparative Example 4 |
|---|---|---|---|---|
| Average coefficient of friction 1 | 0.17 | 0.17 | 0.18 | 0.13 |
| Prevention of deposits | A | A | B | A |
| Stability test 1 | — | B | A | B |

TABLE 4

| | | Example 18 | Example 19 | Example 20 | Example 21 | Example 22 | Example 23 | Example 24 | Example 25 | Example 26 |
|---|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 | Base oil 3 |
| Additive | A1 | 0.1 | 0.5 | 5.0 | — | — | — | — | — | — |
| (mass %) | A2 | — | — | — | 0.1 | 0.5 | 5.0 | — | — | — |
| | A3 | — | — | — | — | — | — | 0.1 | 0.5 | 5.0 |
| | A4 | — | — | — | — | — | — | — | — | — |
| | A5 | — | — | — | — | — | — | — | — | — |
| Refrigerant | | R410A | R410A | R410A | R410A | R410A | R410A | R410A | R410A | R410A |
| Average coefficient of friction 1 | | 0.17 | 0.14 | 0.16 | 0.17 | 0.13 | 0.16 | 0.17 | 0.12 | 0.16 |
| Prevention of deposits | | A | A | A | A | A | A | A | A | A |
| Stability test 1 | | A | A | A | A | A | A | A | A | A |

TABLE 5

| | | Example 27 | Example 28 | Example 29 | Example 30 | Example 31 | Example 32 | Example 33 | Example 34 |
|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 |
| Additive | A1 | — | — | — | — | — | — | 0.5 | 0.5 |
| (mass %) | A2 | — | — | — | — | — | — | — | — |
| | A3 | — | — | — | — | — | — | — | — |
| | A4 | 0.1 | 0.5 | 5.0 | — | — | — | — | — |
| | A5 | — | — | — | 0.1 | 0.5 | 2.0 | — | — |
| | C1 | — | — | — | — | — | — | 0.1 | 0.1 |
| | C2 | — | — | — | — | — | — | 0.5 | 0.5 |
| | C3 | — | — | — | — | — | — | — | 0.001 |
| Refrigerant | | R410A | R410A | R410A | R410A | R410A | R410A | R410A | R410A |
| Average coefficient of friction 1 | | 0.17 | 0.15 | 0.17 | 0.14 | 0.13 | 0.15 | 0.12 | 0.09 |
| Prevention of deposits | | A | A | A | A | A | A | A | A |
| Stability test 1 | | A | A | A | A | A | A | A | A |

TABLE 6

| | | Comparative Example 5 | Comparative Example 6 | Comparative Example 7 | Comparative Example 8 |
|---|---|---|---|---|---|
| Base oil | | Base oil 3 | Base oil 3 | Base oil 3 | Base oil 3 |
| Additive | B1 | — | 0.5 | — | — |
| (mass %) | B2 | — | — | 0.5 | — |
| | B3 | — | — | — | 0.5 |
| Refrigerant | | R410A | R410A | R410A | R410A |

TABLE 6-continued

| | Comparative Example 5 | Comparative Example 6 | Comparative Example 7 | Comparative Example 8 |
|---|---|---|---|---|
| Average coefficient of friction 1 | 0.19 | 0.19 | 0.19 | 0.13 |
| Prevention of deposits | A | A | B | A |
| Stability test 1 | — | B | A | B |

TABLE 7

| | | Example 35 | Example 36 | Example 37 | Example 38 | Example 39 | Example 40 | Example 41 | Example 42 | Example 43 |
|---|---|---|---|---|---|---|---|---|---|---|
| Base oil | | Base oil 2 | Base oil 2 | Base oil 2 | Base oil 2 | Base oil 2 | Base oil 2 | Base oil 2 | Base oil 2 | Base oil 2 |
| Additive | A1 | 0.1 | 0.5 | 5.0 | — | — | — | — | — | — |
| (mass %) | A2 | — | — | — | 0.1 | 0.5 | 5.0 | — | — | — |
| | A3 | — | — | — | — | — | — | 0.1 | 0.5 | 5.0 |
| | A4 | — | — | — | — | — | — | — | — | — |
| | A5 | — | — | — | — | — | — | — | — | — |
| Refrigerant | | R134a | R134a | R134a | R134a | R134a | R134a | R134a | R134a | R134a |
| Average coefficient of friction 1 | | 0.14 | 0.12 | 0.14 | 0.14 | 0.12 | 0.14 | 0.14 | 0.10 | 0.14 |
| Prevention of deposits | | A | A | A | A | A | A | A | A | A |
| Stability test 1 | | A | A | A | A | A | A | A | A | A |

TABLE 8

| | | Example 44 | Example 45 | Example 46 | Example 47 | Example 48 | Example 49 | Example 50 | Example 51 |
|---|---|---|---|---|---|---|---|---|---|
| Base oil | | Base oil 2 | Base oil 2 | Base oil 2 | Base oil 2 | Base oil 2 | Base oil 2 | Base oil 2 | Base oil 2 |
| Additive | A1 | — | — | — | — | — | — | 0.5 | 0.5 |
| (mass %) | A2 | — | — | — | — | — | — | — | — |
| | A3 | — | — | — | — | — | — | — | — |
| | A4 | 0.1 | 0.5 | 5.0 | — | — | — | — | — |
| | A5 | — | — | — | 0.1 | 0.5 | 2.0 | — | — |
| | C1 | — | — | — | — | — | — | 0.1 | 0.1 |
| | C2 | — | — | — | — | — | — | 0.5 | 0.5 |
| | C3 | — | — | — | — | — | — | — | 0.001 |
| Refrigerant | | R134a | R134a | R134a | R134a | R134a | R134a | R134a | R134a |
| Average coefficient of friction 1 | | 0.14 | 0.13 | 0.14 | 0.14 | 0.13 | 0.15 | 0.12 | 0.09 |
| Prevention of deposits | | A | A | A | A | A | A | A | A |
| Stability test 1 | | A | A | A | A | A | A | A | A |

TABLE 9

| | | Comparative Example 9 | Comparative Example 10 | Comparative Example 11 | Comparative Example 12 |
|---|---|---|---|---|---|
| Base oil | | Base oil 2 | Base oil 2 | Base oil 2 | Base oil 2 |
| Additive | B1 | — | 0.5 | — | — |
| (mass %) | B2 | — | — | 0.5 | — |
| | B3 | — | — | — | 0.5 |
| Refrigerant | | R134a | R134a | R134a | R134a |
| Average coefficient of friction 1 | | 0.17 | 0.17 | 0.18 | 0.13 |
| Prevention of deposits | | A | A | B | A |
| Stability test 1 | | — | B | A | B |

TABLE 10

| | | Example 52 | Example 53 | Example 54 | Example 55 | Example 56 | Example 57 | Example 58 | Example 59 | Example 60 |
|---|---|---|---|---|---|---|---|---|---|---|
| Base oil | | Base oil 5 | Base oil 5 | Base oil 5 | Base oil 5 | Base oil 5 | Base oil 5 | Base oil 5 | Base oil 5 | Base oil 5 |
| Additive | A1 | 0.1 | 0.5 | 5.0 | — | — | — | — | — | — |
| (mass %) | A2 | — | — | — | 0.1 | 0.5 | 5.0 | — | — | — |
| | A3 | — | — | — | — | — | — | 0.1 | 0.5 | 5.0 |
| | A4 | — | — | — | — | — | — | — | — | — |
| | A5 | — | — | — | — | — | — | — | — | — |
| Refrigerant | | R134a | R134a | R134a | R134a | R134a | R134a | R134a | R134a | R134a |
| Average coefficient of friction 1 | | 0.16 | 0.14 | 0.16 | 0.16 | 0.13 | 0.15 | 0.16 | 0.12 | 0.14 |
| Prevention of deposits | | A | A | A | A | A | A | A | A | A |
| Stability test 1 | | A | A | A | A | A | A | A | A | A |

TABLE 11

| | | Example 61 | Example 62 | Example 63 | Example 64 | Example 65 | Example 66 | Example 67 | Example 68 |
|---|---|---|---|---|---|---|---|---|---|
| Base oil | | Base oil 5 | Base oil 5 | Base oil 5 | Base oil 5 | Base oil 5 | Base oil 5 | Base oil 5 | Base oil 5 |
| Additive | A1 | — | — | — | — | — | — | 0.5 | 0.5 |
| (mass %) | A2 | — | — | — | — | — | — | — | — |
| | A3 | — | — | — | — | — | — | — | — |
| | A4 | 0.1 | 0.5 | 5.0 | — | — | — | — | — |
| | A5 | — | — | — | 0.1 | 0.5 | 2.0 | — | — |
| | C1 | — | — | — | — | — | — | 0.1 | 0.1 |
| | C2 | — | — | — | — | — | — | 0.5 | 0.5 |
| | C3 | — | — | — | — | — | — | — | 0.001 |
| Refrigerant | | R134a | R134a | R134a | R134a | R134a | R134a | R134a | R134a |
| Average coefficient of friction 1 | | 0.16 | 0.15 | 0.16 | 0.16 | 0.14 | 0.15 | 0.13 | 0.09 |
| Prevention of deposits | | A | A | A | A | A | A | A | A |
| Stability test 1 | | A | A | A | A | A | A | A | A |

TABLE 12

| | | Comparative Example 13 | Comparative Example 14 | Comparative Example 15 | Comparative Example 16 |
|---|---|---|---|---|---|
| Base oil | | Base oil 5 | Base oil 5 | Base oil 5 | Base oil 5 |
| Additive | B1 | — | 0.5 | — | — |
| (mass %) | B2 | — | — | 0.5 | — |
| | B3 | — | — | — | 0.5 |
| Refrigerant | | R134a | R134a | R134a | R134a |

TABLE 12-continued

| | Comparative Example 13 | Comparative Example 14 | Comparative Example 15 | Comparative Example 16 |
|---|---|---|---|---|
| Average coefficient of friction 1 | 0.18 | 0.19 | 0.18 | 0.15 |
| Prevention of deposits | A | A | B | A |
| Stability test 1 | — | B | A | B |

TABLE 13

| | | Example 69 | Example 70 | Example 71 | Example 72 | Example 73 | Example 74 | Example 75 | Example 76 | Example 77 |
|---|---|---|---|---|---|---|---|---|---|---|
| Base oil | | Base oil 4 | Base oil 4 | Base oil 4 | Base oil 4 | Base oil 4 | Base oil 4 | Base oil 4 | Base oil 4 | Base oil 4 |
| Additive | A1 | 0.1 | 0.5 | 5.0 | — | — | — | — | — | — |
| (mass %) | A2 | — | — | — | 0.1 | 0.5 | 5.0 | — | — | — |
| | A3 | — | — | — | — | — | — | 0.1 | 0.5 | 5.0 |
| | A4 | — | — | — | — | — | — | — | — | — |
| | A5 | — | — | — | — | — | — | — | — | — |
| Refrigerant | | R22 | R22 | R22 | R22 | R22 | R22 | R22 | R22 | R22 |
| Average coefficient of friction 1 | | 0.13 | 0.11 | 0.13 | 0.13 | 0.11 | 0.13 | 0.14 | 0.10 | 0.14 |
| Prevention of deposits | | A | A | A | A | A | A | A | A | A |
| Stability test 1 | | A | A | A | A | A | A | A | A | A |

TABLE 14

| | | Example 78 | Example 79 | Example 80 | Example 81 | Example 82 | Example 83 | Example 84 | Example 85 |
|---|---|---|---|---|---|---|---|---|---|
| Base oil | | Base oil 4 | Base oil 4 | Base oil 4 | Base oil 4 | Base oil 4 | Base oil 4 | Base oil 4 | Base oil 4 |
| Additive (mass %) | A1 | — | — | — | — | — | — | 0.5 | 0.5 |
| | A2 | — | — | — | — | — | — | — | — |
| | A3 | — | — | — | — | — | — | — | — |
| | A4 | 0.1 | 0.5 | 5.0 | — | — | — | — | — |
| | A5 | — | — | — | 0.1 | 0.5 | 2.0 | — | — |
| | C1 | — | — | — | — | — | — | 0.1 | 0.1 |
| | C2 | — | — | — | — | — | — | 0.5 | 0.5 |
| | C3 | — | — | — | — | — | — | — | 0.001 |
| Refrigerant | | R22 | R22 | R22 | R22 | R22 | R22 | R22 | R22 |
| Average coefficient of friction 1 | | 0.14 | 0.12 | 0.14 | 0.14 | 0.13 | 0.14 | 0.12 | 0.08 |
| Prevention of deposits | | A | A | A | A | A | A | A | A |
| Stability test 1 | | A | A | A | A | A | A | A | A |

TABLE 15

| | | Comparative Example 17 | Comparative Example 18 | Comparative Example 19 | Comparative Example 20 |
|---|---|---|---|---|---|
| Base oil | | Base oil 4 | Base oil 4 | Base oil 4 | Base oil 4 |
| Additive (mass %) | B1 | — | 0.5 | — | — |
| | B2 | — | — | 0.5 | — |
| | B3 | — | — | — | 0.5 |
| Refrigerant | | R22 | R22 | R22 | R22 |
| Average coefficient of friction 1 | | 0.15 | 0.16 | 0.17 | 0.13 |
| Prevention of deposits | | A | A | B | A |
| Stability test 1 | | — | B | A | B |

TABLE 16

| | | Example 86 | Example 87 | Example 88 | Example 89 | Example 90 |
|---|---|---|---|---|---|---|
| Base oil | | Base oil 1 | Base oil 1 | Base oil 1 | Base oil 1 | Base oil 1 |
| Additive (mass %) | A1 | 0.5 | — | — | — | — |
| | A2 | — | 0.5 | — | — | — |
| | A3 | — | — | 0.5 | — | — |
| | A4 | — | — | — | 0.5 | — |
| | A5 | — | — | — | — | 0.5 |
| Refrigerant | | R407C | R407C | R407C | R407C | R407C |
| Average coefficient of friction 1 | | 0.12 | 0.11 | 0.10 | 0.12 | 0.13 |
| Prevention of deposits | | A | A | A | A | A |
| Stability test 1 | | A | A | A | A | A |

TABLE 17

| | | Example 91 | Example 92 | Example 93 | Example 94 | Example 95 |
|---|---|---|---|---|---|---|
| Base oil | | Base oil 3 | Base oil 3 | Base oil 3 | Base oil 3 | Base oil 3 |
| Additive (mass %) | A1 | 0.5 | — | — | — | — |
| | A2 | — | 0.5 | — | — | — |
| | A3 | — | — | 0.5 | — | — |
| | A4 | — | — | — | 0.5 | — |
| | A5 | — | — | — | — | 0.5 |
| Refrigerant | | R407C | R407C | R407C | R407C | R407C |
| Average coefficient of friction 1 | | 0.13 | 0.13 | 0.12 | 0.14 | 0.13 |

TABLE 17-continued

| | | Example 91 | Example 92 | Example 93 | Example 94 | Example 95 |
|---|---|---|---|---|---|---|
| Prevention of deposits | | A | A | A | A | A |
| Stability test 1 | | A | A | A | A | A |

TABLE 18

| | | Example 96 | Example 97 | Example 98 | Example 99 | Example 100 |
|---|---|---|---|---|---|---|
| Base oil | | Base oil 8 | Base oil 8 | Base oil 8 | Base oil 8 | Base oil 8 |
| Additive (mass %) | A1 | 0.5 | — | — | — | — |
| | A2 | — | 0.5 | — | — | — |
| | A3 | — | — | 0.5 | — | — |
| | A4 | — | — | — | 0.5 | — |
| | A5 | — | — | — | — | 0.5 |
| Refrigerant | | $CO_2$ | $CO_2$ | $CO_2$ | $CO_2$ | $CO_2$ |
| Average coefficient of friction 1 | | 0.13 | 0.13 | 0.12 | 0.14 | 0.14 |
| Prevention of deposits | | A | A | A | A | A |
| Stability test 1 | | A | A | A | A | A |

TABLE 19

| | | Example 101 | Example 102 | Example 103 | Example 104 | Example 105 |
|---|---|---|---|---|---|---|
| Base oil | | Base oil 3 | Base oil 3 | Base oil 3 | Base oil 3 | Base oil 3 |
| Additive (mass %) | A1 | 0.5 | — | — | — | — |
| | A2 | — | 0.5 | — | — | — |
| | A3 | — | — | 0.5 | — | — |
| | A4 | — | — | — | 0.5 | — |
| | A5 | — | — | — | — | 0.5 |
| Refrigerant | | $CO_2$ | $CO_2$ | $CO_2$ | $CO_2$ | $CO_2$ |
| Average coefficient of friction 1 | | 0.15 | 0.14 | 0.12 | 0.16 | 0.14 |
| Prevention of deposits | | A | A | A | A | A |
| Stability test 1 | | A | A | A | A | A |

TABLE 20

| | | Example 106 | Example 107 | Example 108 | Example 109 | Example 110 |
|---|---|---|---|---|---|---|
| Base oil | | Base oil 5 | Base oil 5 | Base oil 5 | Base oil 5 | Base oil 5 |
| Additive (mass %) | A1 | 0.5 | — | — | — | — |
| | A2 | — | 0.5 | — | — | — |
| | A3 | — | — | 0.5 | — | — |
| | A4 | — | — | — | 0.5 | — |
| | A5 | — | — | — | — | 0.5 |
| Refrigerant | | $CO_2$ | $CO_2$ | $CO_2$ | $CO_2$ | $CO_2$ |
| Average coefficient of friction 1 | | 0.14 | 0.14 | 0.13 | 0.15 | 0.15 |
| Prevention of deposits | | A | A | A | A | A |
| Stability test 1 | | A | A | A | A | A |

TABLE 21

| | | Example 111 | Example 112 | Example 113 | Example 114 | Example 115 |
|---|---|---|---|---|---|---|
| Base oil | | Base oil 9 | Base oil 9 | Base oil 9 | Base oil 9 | Base oil 9 |
| Additive (mass %) | A1 | 0.5 | — | — | — | — |
| | A2 | — | 0.5 | — | — | — |
| | A3 | — | — | 0.5 | — | — |
| | A4 | — | — | — | 0.5 | — |
| | A5 | — | — | — | — | 0.5 |
| Refrigerant | | R290 | R290 | R290 | R290 | R290 |
| Average coefficient of friction 1 | | 0.11 | 0.10 | 0.09 | 0.11 | 0.12 |
| Prevention of deposits | | A | A | A | A | A |
| Stability test 1 | | A | A | A | A | A |

TABLE 22-continued

| | Example 116 | Example 117 | Example 118 | Example 119 | Example 120 |
|---|---|---|---|---|---|
| Refrigerant | R600a | R600a | R600a | R600a | R600a |
| Average coefficient of friction 1 | 0.11 | 0.11 | 0.10 | 0.12 | 0.12 |
| Prevention of deposits | A | A | A | A | A |
| Stability test 1 | A | A | A | A | A |

[Lubrication Test 2]

Using the freezer compositions of Examples 2, 16, 19, 33, 36, 50, 53, 67, 70 and 84, the sliding part of a FALEX tester (ASTM D2714) was installed in a pressure resistant container, a refrigerant was introduced in the container, and a FALEX test was performed under the following conditions.

Test material: steel ring, steel block

Test start temperature: 80° C.

Test time: 1 hour

Slide velocity: 0.5 m/s

Load: 1250 N

Pressure of refrigerant atmosphere: 500 kPa.

The frictional coefficient and oil temperature was measured every other second from the start of the FALEX test, and the average (hereafter, "Average coefficient of friction 2" and "Average oil temperature 2") was calculated. The abrasion loss of the block after the end of test was calculated as a volume reduction amount (hereafter, "Abrasion volume 2").

The obtained results are shown in TABLES 23-24.

TABLE 23

| | | Example 2 | Example 16 | Example 19 | Example 33 | Example 36 | Example 50 |
|---|---|---|---|---|---|---|---|
| Base oil | | Base oil 1 | Base oil 1 | Base oil 3 | Base oil 3 | Base oil 2 | Base oil 2 |
| Additive (mass %) | A1 | 0.5 | 0.5 | 0.5 | 0.5 | 0.5 | 0.5 |
| | A2 | — | — | — | — | — | — |
| | A3 | — | — | — | — | — | — |
| | A4 | — | — | — | — | — | — |
| | A5 | — | — | — | — | — | — |
| | C1 | — | 0.1 | — | 0.1 | — | 0.1 |
| | C2 | — | 0.5 | — | 0.5 | — | 0.5 |
| | C3 | — | — | — | — | — | — |
| Refrigerant | | R410A | R410A | R410A | R410A | R134a | R134a |
| Average coefficient of friction 2 | | 0.151 | 0.135 | 0.168 | 0.142 | 0.148 | 0.129 |
| Average oil temperature 2(° C.) | | 92 | 88 | 93 | 89 | 91 | 87 |
| Abrasion volume 2 ($mm^3$) | | 3.1 | 3.0 | 3.7 | 3.7 | 3.6 | 3.5 |

TABLE 22

| | | Example 116 | Example 117 | Example 118 | Example 119 | Example 120 |
|---|---|---|---|---|---|---|
| Base oil | | Base oil 10 | Base oil 10 | Base oil 10 | Base oil 10 | Base oil 10 |
| Additive (mass %) | A1 | 0.5 | — | — | — | — |
| | A2 | — | 0.5 | — | — | — |
| | A3 | — | — | 0.5 | — | — |
| | A4 | — | — | — | 0.5 | — |
| | A5 | — | — | — | — | 0.5 |

TABLE 24

| | | Example 53 | Example 67 | Example 70 | Example 84 |
|---|---|---|---|---|---|
| Base oil | | Base oil 5 | Base oil 5 | Base oil 4 | Base oil 4 |
| Additive (mass %) | A1 | 0.5 | 0.5 | 0.5 | 0.5 |
| | A2 | — | — | — | — |
| | A3 | — | — | — | — |
| | A4 | — | — | — | — |
| | A5 | — | — | — | — |
| | C1 | — | 0.1 | — | 0.1 |

TABLE 24-continued

| | Example 53 | Example 67 | Example 70 | Example 84 |
|---|---|---|---|---|
| C2 | — | 0.5 | — | 0.5 |
| C3 | — | — | — | — |
| Refrigerant | R134a | R134a | R22 | R22 |
| Average coefficient of friction 2 | 0.155 | 0.132 | 0.148 | 0.132 |
| Average oil temperature 2 (° C.) | 94 | 88 | 91 | 87 |
| Abrasion volume 2 ($mm^3$) | 4.2 | 4.2 | 3.0 | 3.1 |

Examples 121-502 and Comparative Examples 21-27

In Examples 121-502 and Comparative Examples 36-42, refrigerating machine oil compositions having the compositions shown in TABLES 25-108 were prepared using the base oils and additives shown below, respectively.

(Base Oils)

Base oil 1: Tetraester of pentaerythritol with equimolar mixture of 2-ethyl hexanoic acid and 3,5,5-trimethyl hexanoic acid (kinematic viscosity at 40° C.: 68.5 $mm^2/s$, pour point: −25° C.).

Base oil 2: Diester of 1,2-cyclohexane dicarboxylic acid with 2-ethylhexanol (kinematic viscosity at 40° C.: 15 $mm^2/s$, pour point: −40° C.)

Base oil 3: Random copolymer of vinyl ethyl ether and vinyl isobutyl ether (molar ratio of vinyl ethyl ether and vinyl isobutyl ether: 7/1, number average molecular weight: 900, kinematic viscosity at 40° C.: 68.5 $mm^2/s$, kinematic viscosity at 100° C.: 8 $mm^2/s$, pour point: −40° C.

Base oil 4: Naphthene type mineral oil (kinematic viscosity at 40° C.: 56.6 $mm^2/s$, pour point: −30° C.)

Base oil 5: Polypropylene glycol monomethyl ether (number average molecular weight: 1000, kinematic viscosity at 40° C.: 46 $mm^2/s$, kinematic viscosity at 100° C.: 10 $mm^2/s$, pour point: −40° C.).

Base oil 6: Straight-chain alkyl benzene (kinematic viscosity at 40° C.: 27 $mm^2/s$, pour point: −45° C. or less)

Base oil 7: Highly refined paraffin type mineral oil (kinematic viscosity at 40° C.: 12 $mm^2/s$, pour point: −20° C.)

Base oil 8: Full ester of 1:1 mixture of dipentaerythritol and pentaerythritol, with 1:1 mixture of 2-ethyl hexanoic acid and 3,5,5-trimethyl hexanoic acid (kinematic viscosity at 40° C.: 195 $mm^2/s$, pour point: −30° C.).

Base oil 9: Paraffin type mineral oil (kinematic viscosity at 40° C.: 92 $mm^2/s$, pour point: −15° C.)

(Additives)

A6: Propylene oxide adduct of glycerin (number average molecular weight: 500)

A7: Tributyl ester of propylene oxide adduct of glycerin (average molecular weight of propylene oxide adduct of glycerin: 500)

A8: Polypropylene glycol (number average molecular weight: 300)

A9: Polyethylene glycol dioleic acid ester

A10: 1,5-pentane diol

A11: 1:1 weight ratio mixture of neopentyl glycol diolate and monoolate

A12: Glycerin

A13: Glycerol monoolate

A14: Oleyl glyceryl ether

A15: Glycerol trioolate

B2: Oleyl alcohol

B3: Stearic acid

C4: Tricresyl phosphate

C5: Triphenyl phosphorothionate

C3: Glycidyl-2,2-dimethyl octanoate

Next, the following tests were performed on the refrigerating machine oil compositions of Examples 121-502 and Comparative Examples 21-27.

[Lubrication Test 3]

The sliding part of a FALEX tester (ASTM D2714) was installed in a pressure-resistant container, a refrigerant was introduced in the container, and a FALEX test was performed under the following conditions. The weight of the block before and after the end of the FALEX test was measured, and the abrasion loss was calculated as a weight reduction amount (hereafter, "Abrasion loss 3"). The obtained results are shown in TABLES 25-108. In the test, the base oil and the refrigerant of the refrigerating machine oil composition were the combinations shown in TABLES 25-108.

Test start temperature: 25° C.

Test time: 30-minutes

Load: 556 N

Refrigerant injection amount: 10 L/h

[Lubrication Test 4]

Using an Optimol SRV tester, the coefficient of friction between a ½-inch SUJ2 steel ball and SUJ2 disk (ϕ 10 mm) was measured. The test conditions were load 100 N, amplitude 1 mm, frequency 25 Hz, the coefficient of friction was recorded every second from test start to 20 minutes later, and the average was taken as the average coefficient of friction (hereafter, "Average coefficient of friction 3").

The refrigerant was poured onto the sliding part at a flow rate of 10 L/h. The obtained results are shown in TABLES 25-108. In the test, the base oil and the refrigerant of the refrigerating machine oil composition were the combinations shown in TABLES 25-108.

[Stability Test 2]

50 g of refrigerating machine oil composition was placed in a 200 ml autoclave, the air in the system was completely removed by a vacuum pump, air was returned to half (380 mmHg) of ordinary pressure (760 mmHg), 15 g of refrigerant was sealed inside, and the presence or absence of sludge, and the appearance of the catalyst, were evaluated after maintaining for 2 weeks at 175° C. The obtained results are shown in TABLES 25-108. In the test, the base oil and the refrigerant of the refrigerating machine oil composition were the combinations shown in TABLES 25-108. In the "anti-sludge properties" column of the table, A means no sludge was observed, B means very little sludge was observed, and C means a large amount of sludge was observed, respectively. In the "catalyst appearance change" column of the table, A means no change was observed in the catalyst, B means the catalyst slightly changed color, and x means the catalyst corroded, respectively.

TABLE 25

| | | Example 121 | Example 122 | Example 123 | Example 124 | Example 125 |
|---|---|---|---|---|---|---|
| Composition [Mass %] | Base oil 1 | 99.5 | 99.5 | 99.5 | 99.5 | 99.5 |
| | Base oil 2 | — | — | — | — | — |

TABLE 25-continued

| | | Example 121 | Example 122 | Example 123 | Example 124 | Example 125 |
|---|---|---|---|---|---|---|
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | — | — | — | — | — |
| | C5 | — | — | — | — | — |
| | C3 | — | — | — | — | — |
| Lubrication test 3 | Abrasion loss 3 [mg] | 6.0 | 6.2 | 4.8 | 5.5 | 5.0 |
| Lubrication test 4 | Average coefficient of friction 3 | 0.102 | 0.105 | 0.080 | 0.097 | 0.086 |
| Stability test 2 | Anti-sludge property | A | A | A | B | A |
| | Catalyst appearance change | A | A | A | A | A |

TABLE 26

| | | Example 126 | Example 127 | Example 128 | Example 129 | Example 130 |
|---|---|---|---|---|---|---|
| Composition [Mass %] | Base oil 1 | 99.5 | 99.5 | 99.5 | 99.5 | 99.5 |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | — | — | — | — | — |
| | C5 | — | — | — | — | — |
| | C3 | — | — | — | — | — |
| Lubrication test 3 | Abrasion loss 3 [mg] | 5.6 | 5.1 | 5.8 | 5.3 | 5.9 |
| Lubrication test 4 | Average coefficient of friction 3 | 0.097 | 0.090 | 0.098 | 0.092 | 0.100 |
| Stability test 2 | Anti-sludge property | B | A | B | A | B |
| | Catalyst appearance change | A | A | A | A | A |

TABLE 27

| | | Example 131 | Example 132 | Example 133 | Example 134 | Example 135 |
|---|---|---|---|---|---|---|
| Composition [Mass %] | Base oil 1 | 99.0 | 99.0 | 99.0 | 99.0 | 99.0 |
| | Base oil 2 | — | — | — | — | — |
| | Base oil 3 | — | — | — | — | — |
| | Base oil 4 | — | — | — | — | — |
| | Base oil 5 | — | — | — | — | — |

TABLE 27-continued

| | | Example 131 | Example 132 | Example 133 | Example 134 | Example 135 |
|---|---|---|---|---|---|---|
| | Base oil 6 | — | — | — | — | — |
| | Base oil 7 | — | — | — | — | — |
| | A6 | — | — | — | — | — |
| | A7 | — | — | — | — | — |
| | A8 | 0.5 | 0.5 | 0.5 | 0.5 | 0.5 |
| | A9 | — | — | — | — | — |
| | A10 | — | — | — | — | — |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 4.7 | 4.6 | 4.1 | 3.9 | 4.7 |
| Lubrication test 4 | Average coefficient of friction 3 | 0.072 | 0.070 | 0.081 | 0.079 | 0.075 |
| Stability test 2 | Anti-sludge property | A | A | B | B | A |
| | Catalyst appearance change | A | B | B | B | A |

TABLE 28

| | | Example 136 | Example 137 | Example 138 | Example 139 | Example 140 |
|---|---|---|---|---|---|---|
| Composition [Mass %] | Base oil 1 | 99.0 | 99.0 | 99.0 | 99.0 | 99.0 |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | 0.5 | 0.5 | 0.5 | 0.5 | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 4.9 | 4.8 | 4.5 | 4.2 | 5.0 |
| Lubrication test 4 | Average coefficient of friction 3 | 0.078 | 0.080 | 0.088 | 0.086 | 0.080 |
| Stability test 2 | Anti-sludge property | A | A | B | B | A |
| | Catalyst appearance change | A | B | B | B | A |

TABLE 29

| | | Example 141 | Example 142 | Example 143 | Example 144 | Example 145 |
|---|---|---|---|---|---|---|
| Composition [Mass %] | Base oil 1 | 99.0 | 99.0 | 99.0 | 99.0 | 99.0 |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |

TABLE 29-continued

| | | Example 141 | Example 142 | Example 143 | Example 144 | Example 145 |
|---|---|---|---|---|---|---|
| | A7 | — | — | — | — | — |
| | A8 | — | — | — | — | — |
| | A9 | — | — | — | — | — |
| | A10 | — | — | — | — | — |
| | A11 | — | — | — | — | — |
| | A12 | 0.5 | 0.5 | 0.5 | 0.5 | 0.5 |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 5.0 | 5.1 | 4.5 | 4.4 | 5.1 |
| Lubrication test 4 | Average coefficient of friction 3 | 0.081 | 0.080 | 0.092 | 0.089 | 0.085 |
| Stability test 2 | Anti-sludge property | A | A | B | B | A |
| | Catalyst appearance change | A | B | B | B | A |

TABLE 30

| | | Example 146 | Example 147 | Example 148 | Example 149 | Example 150 |
|---|---|---|---|---|---|---|
| Composition [Mass %] | Base oil 1 | 99.0 | 99.0 | 99.0 | 99.0 | 99.0 |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | — | — | — | — | — |
| | A12 | — | — | — | — | — |
| | A13 | — | — | — | — | — |
| | A14 | 0.5 | 0.5 | 0.5 | 0.5 | 0.5 |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 5.3 | 5.1 | 4.6 | 4.3 | 5.3 |
| Lubrication test 4 | Average coefficient of friction 3 | 0.084 | 0.081 | 0.092 | 0.088 | 0.086 |
| Stability test 2 | Anti-sludge property | B | B | B | B | A |
| | Catalyst appearance change | A | B | B | B | A |

TABLE 31

| | | Example 151 | Example 152 | Example 153 | Example 154 |
|---|---|---|---|---|---|
| Composition [Mass %] | Base oil 1 | 98.5 | 98.0 | 98.5 | 98.5 |
| | Base oil 2 | — | — | — | — |
| | Base oil 3 | — | — | — | — |
| | Base oil 4 | — | — | — | — |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | 0.5 | 0.5 | 0.5 | 0.5 |
| | A9 | — | — | — | — |

TABLE 31-continued

| | | Example 151 | Example 152 | Example 153 | Example 154 |
|---|---|---|---|---|---|
| | A10 | — | — | — | — |
| | A11 | — | — | — | — |
| | A12 | — | — | — | — |
| | A13 | — | — | — | — |
| | A14 | — | — | — | — |
| | A15 | — | — | — | — |
| | B2 | 0.5 | — | 0.5 | — |
| | B3 | — | 0.5 | — | — |
| | C4 | 0.5 | — | — | 0.5 |
| | C5 | — | 0.5 | — | — |
| | C3 | — | 0.5 | 0.5 | 0.5 |
| Lubrication test 3 | Abrasion loss 3 [mg] | 4.0 | 3.8 | 4.6 | 3.9 |
| Lubrication test 4 | Average coefficient of friction 3 | 0.071 | 0.065 | 0.070 | 0.070 |
| Stability test 2 | Anti-sludge property | A | A | A | A |
| | Catalyst appearance change | B | A | A | A |

TABLE 32

| | | Example 155 | Example 156 | Example 157 | Example 158 |
|---|---|---|---|---|---|
| Composition [Mass %] | Base oil 1 | 98.0 | 98.5 | 98.5 | 98.5 |
| | Base oil 2 | — | — | — | — |
| | Base oil 3 | — | — | — | — |
| | Base oil 4 | — | — | — | — |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |
| | A10 | 0.5 | 0.5 | 0.5 | 0.5 |
| | A11 | — | — | — | — |
| | A12 | — | — | — | — |
| | A13 | — | — | — | — |
| | A14 | — | — | — | — |
| | A15 | — | — | — | — |
| | B2 | 0.5 | — | — | — |
| | B3 | — | 0.5 | 0.5 | — |
| | C4 | 0.5 | — | — | — |
| | C5 | — | 0.5 | — | 0.5 |
| | C3 | 0.5 | — | 0.5 | 0.5 |
| Lubrication test 3 | Abrasion loss 3 [mg] | 4.0 | 4.2 | 4.7 | 4.1 |
| Lubrication test 4 | Average coefficient of friction 3 | 0.069 | 0.080 | 0.075 | 0.074 |
| Stability test 2 | Anti-sludge property | A | B | A | A |
| | Catalyst appearance change | A | B | A | A |

TABLE 33

| | | Example 159 | Example 160 | Example 161 | Example 162 |
|---|---|---|---|---|---|
| Composition [Mass %] | Base oil 1 | 98.5 | 98.0 | 98.5 | 98.5 |
| | Base oil 2 | — | — | — | — |
| | Base oil 3 | — | — | — | — |
| | Base oil 4 | — | — | — | — |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | 0.5 | 0.5 | 0.5 | 0.5 |
| | A13 | — | — | — | — |
| | A14 | — | — | — | — |
| | A15 | — | — | — | — |
| | B2 | 0.5 | — | 0.5 | — |

TABLE 33-continued

| | | Example 159 | Example 160 | Example 161 | Example 162 |
|---|---|---|---|---|---|
| | B3 | — | 0.5 | — | — |
| | C4 | 0.5 | — | — | 0.5 |
| | C5 | — | 0.5 | — | — |
| | C3 | — | 0.5 | 0.5 | 0.5 |
| Lubrication test 3 | Abrasion loss 3 [mg] | 4.5 | 4.4 | 5.0 | 4.5 |
| Lubrication test 4 | Average coefficient of friction 3 | 0.081 | 0.073 | 0.080 | 0.082 |
| Stability test 2 | Anti-sludge property | A | A | A | A |
| | Catalyst appearance change | B | A | A | A |

TABLE 34

| | | Example 163 | Example 164 | Example 165 | Example 166 |
|---|---|---|---|---|---|
| Composition [Mass %] | Base oil 1 | 98.0 | 98.5 | 98.5 | 98.5 |
| | Base oil 2 | — | — | — | — |
| | Base oil 3 | — | — | — | — |
| | Base oil 4 | — | — | — | — |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | — | — | — | — |
| | A13 | — | — | — | — |
| | A14 | 0.5 | 0.5 | 0.5 | 0.5 |
| | A15 | — | — | — | — |
| | B2 | 0.5 | — | — | — |
| | B3 | — | 0.5 | 0.5 | — |
| | C4 | 0.5 | — | — | — |
| | C5 | — | 0.5 | — | 0.5 |
| | C3 | 0.5 | — | 0.5 | 0.5 |
| Lubrication test 3 | Abrasion loss 3 [mg] | 4.2 | 4.5 | 5.2 | 4.3 |
| Lubrication test 4 | Average coefficient of friction 3 | 0.073 | 0.081 | 0.079 | 0.077 |
| Stability test 2 | Anti-sludge property | A | B | A | A |
| | Catalyst appearance change | A | B | A | A |

40

TABLE 35

| | | Example 167 | Example 168 | Example 169 | Example 170 | Example 171 |
|---|---|---|---|---|---|---|
| Composition [Mass %] | Base oil 1 | — | — | — | — | — |
| | Base oil 2 | 99.5 | 99.5 | 99.5 | 99.5 | 99.5 |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | — | — | — | — | — |
| | C5 | — | — | — | — | — |
| | C3 | — | — | — | — | — |
| Lubrication test 3 | Abrasion loss 3 [mg] | 7.3 | 7.6 | 6.2 | 6.9 | 6.3 |
| Lubrication test 4 | Average coefficient of friction 3 | 0.112 | 0.115 | 0.089 | 0.107 | 0.096 |

TABLE 35-continued

| | | Example 167 | Example 168 | Example 169 | Example 170 | Example 171 |
|---|---|---|---|---|---|---|
| Stability test 2 | Anti-sludge property | A | A | A | B | A |
| | Catalyst appearance change | A | A | A | A | A |

TABLE 36

| | | Example 172 | Example 173 | Example 174 | Example 175 | Example 176 |
|---|---|---|---|---|---|---|
| Composition [Mass %] | Base oil 1 | — | — | — | — | — |
| | Base oil 2 | 99.5 | 99.5 | 99.5 | 99.5 | 99.5 |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | — | — | — | — | — |
| | C5 | — | — | — | — | — |
| | C3 | — | — | — | — | — |
| Lubrication test 3 | Abrasion loss 3 [mg] | 6.9 | 6.5 | 7.3 | 6.7 | 7.3 |
| Lubrication test 4 | Average coefficient of friction 3 | 0.107 | 0.099 | 0.109 | 0.102 | 0.111 |
| Stability test 2 | Anti-sludge property | B | A | B | A | B |
| | Catalyst appearance change | A | A | A | A | A |

TABLE 37

| | | Example 177 | Example 178 | Example 179 | Example 180 | Example 181 |
|---|---|---|---|---|---|---|
| Composition [Mass %] | Base oil 1 | — | — | — | — | — |
| | Base oil 2 | 99.0 | 99.0 | 99.0 | 99.0 | 99.0 |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | 0.5 | 0.5 | 0.5 | 0.5 | 0.5 |
| | A9 | — | — | — | — | — |
| | A10 | — | — | — | — | — |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 6.0 | 5.9 | 5.5 | 5.3 | 6.2 |
| Lubrication test 4 | Average coefficient of friction 3 | 0.082 | 0.080 | 0.090 | 0.089 | 0.085 |
| Stability test 2 | Anti-sludge property | A | A | B | B | A |
| | Catalyst appearance change | A | B | B | B | A |

TABLE 38

| | | Example 182 | Example 183 | Example 184 | Example 185 | Example 186 |
|---|---|---|---|---|---|---|
| Composition [Mass %] | Base oil 1 | — | — | — | — | — |
| | Base oil 2 | 99.0 | 99.0 | 99.0 | 99.0 | 99.0 |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | 0.5 | 0.5 | 0.5 | 0.5 | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 5.4 | 5.4 | 6.0 | 5.5 | 6.4 |
| Lubrication test 4 | Average coefficient of friction 3 | 0.088 | 0.090 | 0.097 | 0.096 | 0.089 |
| Stability test 2 | Anti-sludge property | A | A | B | B | A |
| | Catalyst appearance change | A | B | B | B | A |

TABLE 39

| | | Example 187 | Example 188 | Example 189 | Example 190 | Example 191 |
|---|---|---|---|---|---|---|
| Compostion [Mass %] | Base oil 1 | — | — | — | — | — |
| | Base oil 2 | 99.0 | 99.0 | 99.0 | 99.0 | 99.0 |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | — | — | — | — | — |
| | A12 | 0.5 | 0.5 | 0.5 | 0.5 | 0.5 |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 6.4 | 6.5 | 6.0 | 5.8 | 6.6 |
| Lubrication test 4 | Average coefficient of friction 3 | 0.091 | 0.090 | 0.101 | 0.099 | 0.095 |
| Stability test 2 | Anti-sludge property | A | A | B | B | A |
| | Catalyst appearance change | A | B | B | B | A |

TABLE 40

| | | Example 192 | Example 193 | Example 194 | Example 195 | Example 196 |
|---|---|---|---|---|---|---|
| Composition [Mass %] | Base oil 1 | — | — | — | — | — |
| | Base oil 2 | 99.0 | 99.0 | 99.0 | 99.0 | 99.0 |
| | Base oil 3 | — | — | — | — | — |

TABLE 40-continued

| | | Example 192 | Example 193 | Example 194 | Example 195 | Example 196 |
|---|---|---|---|---|---|---|
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | — | — | — | — | — |
| | A12 | — | — | — | — | — |
| | A13 | — | — | — | — | — |
| | A14 | 0.5 | 0.5 | 0.5 | 0.5 | 0.5 |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 6.7 | 6.4 | 6.0 | 5.7 | 6.8 |
| Lubrication test 4 | Average coefficient of friction 3 | 0.093 | 0.091 | 0.102 | 0.097 | 0.096 |
| Stability test 2 | Anti-sludge property | A | A | B | B | A |
| | Catalyst appearance change | A | B | B | B | A |

TABLE 41

| | | Example 197 | Example 198 | Example 199 | Example 200 |
|---|---|---|---|---|---|
| Composition [Mass %] | Base oil 1 | — | — | — | — |
| | Base oil 2 | 98.5 | 98.0 | 98.5 | 98.5 |
| | Base oil 3 | — | — | — | — |
| | Base oil 4 | — | — | — | — |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | 0.5 | 0.5 | 0.5 | 0.5 |
| | A9 | — | — | — | — |
| | A10 | — | — | — | — |
| | A11 | — | — | — | — |
| | A12 | — | — | — | — |
| | A13 | — | — | — | — |
| | A14 | — | — | — | — |
| | A15 | — | — | — | — |
| | B2 | 0.5 | — | 0.5 | — |
| | B3 | — | 0.5 | — | — |
| | C4 | 0.5 | — | — | 0.5 |
| | C5 | — | 0.5 | — | — |
| | C3 | — | 0.5 | 0.5 | 0.5 |
| Lubrication test 3 | Abrasion loss 3 [mg] | 5.5 | 5.2 | 6.0 | 5.4 |
| Lubrication test 4 | Average coefficient of friction 3 | 0.081 | 0.075 | 0.080 | 0.089 |
| Stability test 2 | Anti-sludge property | A | A | A | A |
| | Catalyst appearance change | B | A | A | A |

TABLE 42

| | | Example 201 | Example 202 | Example 203 | Example 204 |
|---|---|---|---|---|---|
| Composition [Mass %] | Base oil 1 | — | — | — | — |
| | Base oil 2 | 98.0 | 98.5 | 98.5 | 98.5 |
| | Base oil 3 | — | — | — | — |
| | Base oil 4 | — | — | — | — |
| | Base oil 5 | — | — | — | — |
| | Base oil 6 | — | — | — | — |
| | Base oil 7 | — | — | — | — |
| | A6 | — | — | — | — |

TABLE 42-continued

| | | Example 201 | Example 202 | Example 203 | Example 204 |
|---|---|---|---|---|---|
| | A7 | — | — | — | — |
| | A8 | — | — | — | — |
| | A9 | — | — | — | — |
| | A10 | 0.5 | 0.5 | 0.5 | 0.5 |
| | A11 | — | — | — | — |
| | A12 | — | — | — | — |
| | A13 | — | — | — | — |
| | A14 | — | — | — | — |
| | A15 | — | — | — | — |
| | B2 | 0.5 | — | — | — |
| | B3 | — | 0.5 | 0.5 | — |
| | C4 | 0.5 | — | — | — |
| | C5 | — | 0.5 | — | 0.5 |
| | C3 | 0.5 | — | 0.5 | 0.5 |
| Lubrication test 3 | Abrasion loss 3 [mg] | 5.5 | 5.6 | 6.1 | 5.4 |
| Lubrication test 4 | Average coefficient of friction 3 | 0.079 | 0.091 | 0.085 | 0.083 |
| Stability test 2 | Anti-sludge property | A | B | A | A |
| | Catalyst appearance change | A | B | A | A |

20

TABLE 43

| | | Example 205 | Example 206 | Example 207 | Example 208 |
|---|---|---|---|---|---|
| Composition [Mass %] | Base oil 1 | — | — | — | — |
| | Base oil 2 | 98.5 | 98.0 | 98.5 | 98.5 |
| | Base oil 3 | — | — | — | — |
| | Base oil 4 | — | — | — | — |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | 0.5 | 0.5 | 0.5 | 0.5 |
| | A13 | — | — | — | — |
| | A14 | — | — | — | — |
| | A15 | — | — | — | — |
| | B2 | 0.5 | — | 0.5 | — |
| | B3 | — | 0.5 | — | — |
| | C4 | 0.5 | — | — | 0.5 |
| | C5 | — | 0.5 | — | — |
| | C3 | — | 0.5 | 0.5 | 0.5 |
| Lubrication test 3 | Abrasion loss 3 [mg] | 5.9 | 5.9 | 6.4 | 5.9 |
| Lubrication test 4 | Average coefficient of friction 3 | 0.090 | 0.083 | 0.091 | 0.092 |
| Stability test 2 | Anti-sludge property | A | A | A | A |
| | Catalyst appearance change | B | A | A | A |

TABLE 44

| | | Example 209 | Example 210 | Example 211 | Example 212 |
|---|---|---|---|---|---|
| Composition [Mass %] | Base oil 1 | — | — | — | — |
| | Base oil 2 | 98.0 | 98.5 | 98.5 | 98.5 |
| | Base oil 3 | — | — | — | — |
| | Base oil 4 | — | — | — | — |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | — | — | — | — |
| | A13 | — | — | — | — |

TABLE 44-continued

| | | Example 209 | Example 210 | Example 211 | Example 212 |
|---|---|---|---|---|---|
| | A14 | 0.5 | 0.5 | 0.5 | 0.5 |
| | A15 | — | — | — | — |
| | B2 | 0.5 | — | — | — |
| | B3 | — | 0.5 | 0.5 | — |
| | C4 | 0.5 | — | — | — |
| | C5 | — | 0.5 | — | 0.5 |
| | C3 | 0.5 | — | 0.5 | 0.5 |
| Lubrication test 3 | Abrasion loss 3 [mg] | 5.4 | 5.9 | 6.5 | 5.7 |
| Lubrication test 4 | Average coefficient of friction 3 | 0.083 | 0.091 | 0.088 | 0.087 |
| Stability test 2 | Anti-sludge property | A | B | A | A |
| | Catalyst appearance change | A | B | A | A |

TABLE 45

| | | Example 213 | Example 214 | Example 215 | Example 216 | Example 217 |
|---|---|---|---|---|---|---|
| Composition [Mass %] | Base oil 1 | — | — | — | — | — |
| | Base oil 2 | — | — | — | — | — |
| | Base oil 3 | 99.5 | 99.5 | 99.5 | 99.5 | 99.5 |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | — | — | — | — | — |
| | C5 | — | — | — | — | — |
| | C3 | — | — | — | — | — |
| Lubrication test 3 | Abrasion loss 3 [mg] | 6.5 | 6.8 | 5.3 | 5.9 | 5.5 |
| Lubrication test 4 | Average coefficient of friction 3 | 0.110 | 0.112 | 0.088 | 0.104 | 0.093 |
| Stability test 2 | Anti-sludge property | A | A | A | B | A |
| | Catalyst appearance change | A | A | A | A | A |

TABLE 46

| | | Example 218 | Example 219 | Example 220 | Example 221 | Example 222 |
|---|---|---|---|---|---|---|
| Composition [Mass %] | Base oil 1 | — | — | — | — | — |
| | Base oil 2 | — | — | — | — | — |
| | Base oil 3 | 99.5 | 99.5 | 99.5 | 99.5 | 99.5 |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | — | — | — | — | — |

TABLE 46-continued

| | | Example 218 | Example 219 | Example 220 | Example 221 | Example 222 |
|---|---|---|---|---|---|---|
| | C5 | — | — | — | — | — |
| | C3 | — | — | — | — | — |
| Lubrication test 3 | Abrasion loss 3 [mg] | 6.2 | 5.6 | 6.4 | 5.8 | 6.5 |
| Lubrication test 4 | Average coefficient of friction 3 | 0.105 | 0.097 | 0.106 | 0.099 | 0.107 |
| Stability test 2 | Anti-sludge property | B | A | B | A | B |
| | Catalyst appearance change | A | A | A | A | A |

TABLE 47

| | | Example 223 | Example 224 | Example 225 | Example 226 | Example 227 |
|---|---|---|---|---|---|---|
| Composition [Mass %] | Base oil 1 | — | — | — | — | — |
| | Base oil 2 | — | — | — | — | — |
| | Base oil 3 | 99.0 | 99.0 | 99.0 | 99.0 | 99.0 |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | 0.5 | 0.5 | 0.5 | 0.5 | 0.5 |
| | A9 | — | — | — | — | — |
| | A10 | — | — | — | — | — |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 5.1 | 5.1 | 4.6 | 4.3 | 5.2 |
| Lubrication test 4 | Average coefficient of friction 3 | 0.078 | 0.077 | 0.088 | 0.085 | 0.082 |
| Stability test 2 | Anti-sludge property | A | A | B | B | A |
| | Catalyst appearance change | A | B | B | B | A |

TABLE 48

| | | Example 228 | Example 229 | Example 230 | Example 231 | Example 232 |
|---|---|---|---|---|---|---|
| Composition [Mass %] | Base oil 1 | — | — | — | — | — |
| | Base oil 2 | — | — | — | — | — |
| | Base oil 3 | 99.0 | 99.0 | 99.0 | 99.0 | 99.0 |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | 0.5 | 0.5 | 0.5 | 0.5 | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |

TABLE 48-continued

| | | Example 228 | Example 229 | Example 230 | Example 231 | Example 232 |
|---|---|---|---|---|---|---|
| Lubrication test 3 | Abrasion loss 3 [mg] | 4.5 | 4.5 | 4.9 | 4.7 | 5.6 |
| Lubrication test 4 | Average coefficient of friction 3 | 0.084 | 0.087 | 0.095 | 0.093 | 0.088 |
| Stability test 2 | Anti-sludge property | A | A | B | B | A |
| | Catalyst appearance change | A | B | B | B | A |

TABLE 49

| | | Example 233 | Example 234 | Example 235 | Example 236 | Example 237 |
|---|---|---|---|---|---|---|
| Composition [Mass %] | Base oil 1 | — | — | — | — | — |
| | Base oil 2 | — | — | — | — | — |
| | Base oil 3 | 99.0 | 99.0 | 99.0 | 99.0 | 99.0 |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | — | — | — | — | — |
| | A12 | 0.5 | 0.5 | 0.5 | 0.5 | 0.5 |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 5.5 | 5.7 | 4.9 | 4.9 | 5.6 |
| Lubrication test 4 | Average coefficient of friction 3 | 0.088 | 0.087 | 0.100 | 0.096 | 0.091 |
| Stability test 2 | Anti-sludge property | A | A | B | B | A |
| | Catalyst appearance change | A | B | B | B | A |

40

TABLE 50

| | | Example 238 | Example 239 | Example 240 | Example 241 | Example 242 |
|---|---|---|---|---|---|---|
| Composition [Mass %] | Base oil 1 | — | — | — | — | — |
| | Base oil 2 | — | — | — | — | — |
| | Base oil 3 | 99.0 | 99.0 | 99.0 | 99.0 | 99.0 |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | — | — | — | — | — |
| | A12 | — | — | — | — | — |
| | A13 | — | — | — | — | — |
| | A14 | 0.5 | 0.5 | 0.5 | 0.5 | 0.5 |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 5.8 | 5.7 | 5.0 | 5.0 | 5.8 |
| Lubrication test 4 | Average coefficient of friction 3 | 0.091 | 0.088 | 0.099 | 0.094 | 0.092 |

TABLE 50-continued

| | | Example 238 | Example 239 | Example 240 | Example 241 | Example 242 |
|---|---|---|---|---|---|---|
| Stability test 2 | Anti-sludge property | A | A | B | B | A |
| | Catalyst appearance change | A | B | B | B | A |

TABLE 51

| | | Example 243 | Example 244 | Example 245 | Example 246 |
|---|---|---|---|---|---|
| Compostion [Mass %] | Base oil 1 | — | — | — | — |
| | Base oil 2 | — | — | — | — |
| | Base oil 3 | 98.5 | 98.0 | 98.5 | 98.5 |
| | Base oil 4 | — | — | — | — |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | 0.5 | 0.5 | 0.5 | 0.5 |
| | A9 | — | — | — | — |
| | A10 | — | — | — | — |
| | A11 | — | — | — | — |
| | A12 | — | — | — | — |
| | A13 | — | — | — | — |
| | A14 | — | — | — | — |
| | A15 | — | — | — | — |
| | B2 | 0.5 | — | 0.5 | — |
| | B3 | — | 0.5 | — | — |
| | C4 | 0.5 | — | — | 0.5 |
| | C5 | — | 0.5 | — | — |
| | C3 | — | 0.5 | 0.5 | 0.5 |
| Lubrication test 3 | Abrasion loss 3 [mg] | 4.6 | 4.3 | 5.1 | 4.4 |
| Lubrication test 4 | Average coefficient of friction 3 | 0.079 | 0.072 | 0.077 | 0.076 |
| Stability test 2 | Anti-sludge property | A | A | A | A |
| | Catalyst appearance change | B | A | A | A |

TABLE 52

| | | Example 247 | Example 248 | Example 249 | Example 250 |
|---|---|---|---|---|---|
| Composition [Mass %] | Base oil 1 | — | — | — | — |
| | Base oil 2 | — | — | — | — |
| | Base oil 3 | 98.0 | 98.5 | 98.5 | 98.5 |
| | Base oil 4 | — | — | — | — |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |
| | A10 | 0.5 | 0.5 | 0.5 | 0.5 |
| | A11 | — | — | — | — |
| | A12 | — | — | — | — |
| | A13 | — | — | — | — |
| | A14 | — | — | — | — |
| | A15 | — | — | — | — |
| | B2 | 0.5 | — | — | — |
| | B3 | — | 0.5 | 0.5 | — |
| | C4 | 0.5 | — | — | — |
| | C5 | — | 0.5 | — | 0.5 |
| | C3 | 0.5 | — | 0.5 | 0.5 |
| Lubrication test 3 | Abrasion loss 3 [mg] | 4.6 | 4.7 | 5.3 | 4.6 |
| Lubrication test 4 | Average coefficient of friction 3 | 0.076 | 0.086 | 0.082 | 0.080 |
| Stability test 2 | Anti-sludge property | A | B | A | A |
| | Catalyst appearance change | A | B | A | A |

TABLE 53

| | | Example 251 | Example 252 | Example 253 | Example 254 |
|---|---|---|---|---|---|
| Composition [Mass %] | Base oil 1 | — | — | — | — |
| | Base oil 2 | — | — | — | — |
| | Base oil 3 | 98.5 | 98.0 | 98.5 | 98.5 |
| | Base oil 4 | — | — | — | — |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | 0.5 | 0.5 | 0.5 | 0.5 |
| | A13 | — | — | — | — |
| | A14 | — | — | — | — |
| | A15 | — | — | — | — |
| | B2 | 0.5 | — | 0.5 | — |
| | B3 | — | 0.5 | — | — |
| | C4 | 0.5 | — | — | 0.5 |
| | C5 | — | 0.5 | — | — |
| | C3 | — | 0.5 | 0.5 | 0.5 |
| Lubrication test 3 | Abrasion loss 3 [mg] | 5.1 | 4.9 | 5.4 | 4.9 |
| Lubrication test 4 | Average coefficient of friction 3 | 0.088 | 0.081 | 0.087 | 0.090 |
| Stability test 2 | Anti-sludge property | A | A | A | A |
| | Catalyst appearance change | B | A | A | A |

TABLE 54

| | | Example 255 | Example 256 | Example 257 | Example 258 |
|---|---|---|---|---|---|
| Composition [Mass %] | Base oil 1 | — | — | — | — |
| | Base oil 2 | — | — | — | — |
| | Base oil 3 | 98.0 | 98.5 | 98.5 | 98.5 |
| | Base oil 4 | — | — | — | — |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | — | — | — | — |
| | A13 | — | — | — | — |
| | A14 | 0.5 | 0.5 | 0.5 | 0.5 |
| | A15 | — | — | — | — |
| | B2 | 0.5 | — | — | — |
| | B3 | — | 0.5 | 0.5 | — |
| | C4 | 0.5 | — | — | — |
| | C5 | — | 0.5 | — | 0.5 |
| | C3 | 0.5 | — | 0.5 | 0.5 |
| Lubrication test 3 | Abrasion loss 3 [mg] | 4.7 | 4.9 | 5.7 | 4.9 |
| Lubrication test 4 | Average coefficient of friction 3 | 0.079 | 0.088 | 0.086 | 0.084 |
| Stability test 2 | Anti-sludge property | A | B | A | A |
| | Catalyst appearance change | A | B | A | A |

TABLE 55

| | | Example 259 | Example 260 | Example 261 | Example 262 | Example 263 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | 99.5 | 99.5 | 99.5 | 99.5 | 99.5 |
| | Base oil 5 | — | — | — | — | — |
| | Base oil 6 | — | — | — | — | — |
| | Base oil 7 | — | — | — | — | — |

TABLE 55-continued

| | | Example 259 | Example 260 | Example 261 | Example 262 | Example 263 |
|---|---|---|---|---|---|---|
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | — | — | — | — | — |
| | C5 | — | — | — | — | — |
| | C3 | — | — | — | — | — |
| Lubrication test 3 | Abrasion loss 3 [mg] | 4.6 | 4.9 | 3.4 | 4.0 | 3.6 |
| Lubrication test 4 | Average coefficient of friction 3 | 0.094 | 0.098 | 0.072 | 0.091 | 0.079 |
| Stability test 2 | Anti-sludge property | A | A | A | B | A |
| | Catalyst appearance change | A | A | A | A | A |

TABLE 56

| | | Example 264 | Example 265 | Example 266 | Example 267 | Example 268 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | 99.5 | 99.5 | 99.5 | 99.5 | 99.5 |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | — | — | — | — | — |
| | C5 | — | — | — | — | — |
| | C3 | — | — | — | — | — |
| Lubrication test 3 | Abrasion loss 3 [mg] | 4.2 | 3.8 | 4.4 | 4.0 | 4.5 |
| Lubrication test 4 | Average coefficient of friction 3 | 0.089 | 0.083 | 0.091 | 0.086 | 0.093 |
| Stability test 2 | Anti-sludge property | B | A | B | A | B |
| | Catalyst appearance change | A | A | A | A | A |

TABLE 57

| | | Example 269 | Example 270 | Example 271 | Example 272 | Example 273 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | 99.0 | 99.0 | 99.0 | 99.0 | 99.0 |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | 0.5 | 0.5 | 0.5 | 0.5 | 0.5 |

TABLE 57-continued

| | | Example 269 | Example 270 | Example 271 | Example 272 | Example 273 |
|---|---|---|---|---|---|---|
| | A9 | — | — | — | — | — |
| | A10 | — | — | — | — | — |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 3.3 | 3.2 | 2.8 | 2.6 | 3.3 |
| Lubrication test 4 | Average coefficient of friction 3 | 0.065 | 0.062 | 0.074 | 0.073 | 0.068 |
| Stability test 2 | Anti-sludge property | A | A | B | B | A |
| | Catalyst appearance change | A | B | B | B | A |

20

TABLE 58

| | | Example 274 | Example 275 | Example 276 | Example 277 | Example 278 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | 99.0 | 99.0 | 99.0 | 99.0 | 99.0 |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | 0.5 | 0.5 | 0.5 | 0.5 | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 2.6 | 2.6 | 3.0 | 2.9 | 3.6 |
| Lubrication test 4 | Average coefficient of friction 3 | 0.071 | 0.073 | 0.082 | 0.079 | 0.073 |
| Stability test 2 | Anti-sludge property | A | A | B | B | A |
| | Catalyst appearance change | A | B | B | B | A |

TABLE 59

| | | Example 279 | Example 280 | Example 281 | Example 282 | Example 283 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | 99.0 | 99.0 | 99.0 | 99.0 | 99.0 |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | — | — | — | — | — |

TABLE 59-continued

| | | Example 279 | Example 280 | Example 281 | Example 282 | Example 283 |
|---|---|---|---|---|---|---|
| | A12 | 0.5 | 0.5 | 0.5 | 0.5 | 0.5 |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 3.6 | 3.7 | 3.0 | 3.0 | 3.7 |
| Lubrication test 4 | Average coefficient of friction 3 | 0.075 | 0.073 | 0.084 | 0.082 | 0.078 |
| Stability test 2 | Anti-sludge property | A | A | B | B | A |
| | Catalyst appearance change | A | B | B | B | A |

TABLE 60

| | | Example 284 | Example 285 | Example 286 | Example 287 | Example 288 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | 99.0 | 99.0 | 99.0 | 99.0 | 99.0 |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | — | — | — | — | — |
| | A12 | — | — | — | — | — |
| | A13 | — | — | — | — | — |
| | A14 | 0.5 | 0.5 | 0.5 | 0.5 | 0.5 |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 4.0 | 3.7 | 3.2 | 2.8 | 3.9 |
| Lubrication test 4 | Average coefficient of friction 3 | 0.078 | 0.074 | 0.085 | 0.080 | 0.079 |
| Stability test 2 | Anti-sludge property | A | A | B | B | A |
| | Catalyst appearance change | A | B | B | B | A |

TABLE 61

| | | Example 289 | Example 290 | Example 291 | Example 292 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | 98.5 | 98.0 | 98.5 | 98.5 |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | 0.5 | 0.5 | 0.5 | 0.5 |
| | A9 | — | — | — | — |
| | A10 | — | — | — | — |
| | A11 | — | — | — | — |
| | A12 | — | — | — | — |
| | A13 | — | — | — | — |
| | A14 | — | — | — | — |

TABLE 61-continued

| | | Example 289 | Example 290 | Example 291 | Example 292 |
|---|---|---|---|---|---|
| | A15 | — | — | — | — |
| | B2 | 0.5 | — | 0.5 | — |
| | B3 | — | 0.5 | — | — |
| | C4 | 0.5 | — | — | 0.5 |
| | C5 | — | 0.5 | — | — |
| | C3 | — | 0.5 | 0.5 | 0.5 |
| Lubrication test 3 | Abrasion loss 3 [mg] | 2.7 | 2.4 | 3.2 | 2.6 |
| Lubrication test 4 | Average coefficient of friction 3 | 0.063 | 0.058 | 0.063 | 0.062 |
| Stability test 2 | Anti-sludge property | A | A | A | A |
| | Catalyst appearance change | B | A | A | A |

TABLE 62

| | | Example 293 | Example 294 | Example 295 | Example 296 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | 98.0 | 98.5 | 98.5 | 98.5 |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |
| | A10 | 0.5 | 0.5 | 0.5 | 0.5 |
| | A11 | — | — | — | — |
| | A12 | — | — | — | — |
| | A13 | — | — | — | — |
| | A14 | — | — | — | — |
| | A15 | — | — | — | — |
| | B2 | 0.5 | — | — | — |
| | B3 | — | 0.5 | 0.5 | — |
| | C4 | 0.5 | — | — | — |
| | C5 | — | 0.5 | — | 0.5 |
| | C3 | 0.5 | — | 0.5 | 0.5 |
| Lubrication test 3 | Abrasion loss 3 [mg] | 2.6 | 2.7 | 3.3 | 2.6 |
| Lubrication test 4 | Average coefficient of friction 3 | 0.062 | 0.073 | 0.069 | 0.067 |
| Stability test 2 | Anti-sludge property | A | B | A | A |
| | Catalyst appearance change | A | B | A | A |

TABLE 63

| | | Example 297 | Example 298 | Example 299 | Example 300 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | 98.5 | 98.0 | 98.5 | 98.5 |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | 0.5 | 0.5 | 0.5 | 0.5 |
| | A13 | — | — | — | — |
| | A14 | — | — | — | — |
| | A15 | — | — | — | — |
| | B2 | 0.5 | — | 0.5 | — |
| | B3 | — | 0.5 | — | — |
| | C4 | 0.5 | — | — | 0.5 |
| | C5 | — | 0.5 | — | — |
| | C3 | — | 0.5 | 0.5 | 0.5 |

TABLE 63-continued

| | | Example 297 | Example 298 | Example 299 | Example 300 |
|---|---|---|---|---|---|
| Lubrication test 3 | Abrasion loss 3 [mg] | 3.1 | 3.0 | 3.6 | 3.0 |
| Lubrication test 4 | Average coefficient of friction 3 | 0.074 | 0.065 | 0.073 | 0.074 |
| Stability test 2 | Anti-sludge property | A | A | A | A |
| | Catalyst appearance change | B | A | A | A |

TABLE 64

| | | Example 301 | Example 302 | Example 303 | Example 304 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | 98.0 | 98.5 | 98.5 | 98.5 |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | — | — | — | — |
| | A13 | — | — | — | — |
| | A14 | 0.5 | 0.5 | 0.5 | 0.5 |
| | A15 | — | — | — | — |
| | B2 | 0.5 | — | — | — |
| | B3 | — | 0.5 | 0.5 | — |
| | C4 | 0.5 | — | — | — |
| | C5 | — | 0.5 | — | 0.5 |
| | C3 | 0.5 | — | 0.5 | 0.5 |
| Lubrication test 3 | Abrasion loss 3 [mg] | 2.7 | 3.1 | 3.9 | 2.9 |
| Lubrication test 4 | Average coefficient of friction 3 | 0.066 | 0.074 | 0.073 | 0.070 |
| Stability test 2 | Anti-sludge property | A | B | A | A |
| | Catalyst appearance change | A | B | A | A |

TABLE 65

| | | Example 305 | Example 306 | Example 307 | Example 308 | Example 309 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | 99.5 | 99.5 | 99.5 | 99.5 | 99.5 |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | — | — | — | — | — |
| | C5 | — | — | — | — | — |
| | C3 | — | — | — | — | — |
| Lubrication test 3 | Abrasion loss 3 [mg] | 5.8 | 6.1 | 4.7 | 5.3 | 4.8 |
| Lubrication test 4 | Average coefficient of friction 3 | 0.085 | 0.088 | 0.063 | 0.078 | 0.069 |
| Stability test 2 | Anti-sludge property | A | A | A | B | A |
| | Catalyst appearance change | A | A | A | A | A |

TABLE 66

| | | Example 310 | Example 311 | Example 312 | Example 313 | Example 314 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | 99.5 | 99.5 | 99.5 | 99.5 | 99.5 |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | — | — | — | — | — |
| | C5 | — | — | — | — | — |
| | C3 | — | — | — | — | — |
| Lubrication test 3 | Abrasion loss 3 [mg] | 5.5 | 4.9 | 5.7 | 5.1 | 5.8 |
| Lubrication test 4 | Average coefficient of friction 3 | 0.080 | 0.074 | 0.085 | 0.075 | 0.083 |
| Stability test 2 | Anti-sludge property | B | A | B | A | B |
| | Catalyst appearance change | A | A | A | A | A |

TABLE 67

| | | Example 315 | Example 316 | Example 317 | Example 318 | Example 319 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | 99.0 | 99.0 | 99.0 | 99.0 | 99.0 |
| | Base oil 6 | — | — | — | — | — |
| | Base oil 7 | — | — | — | — | — |
| | A6 | — | — | — | — | — |
| | A7 | — | — | — | — | — |
| | A8 | 0.5 | 0.5 | 0.5 | 0.5 | 0.5 |
| | A9 | — | — | — | — | — |
| | A10 | — | — | — | — | — |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 4.5 | 4.4 | 4.0 | 3.8 | 4.4 |
| Lubrication test 4 | Average coefficient of friction 3 | 0.055 | 0.054 | 0.065 | 0.063 | 0.060 |
| Stability test 2 | Anti-sludge property | A | A | B | B | A |
| | Catalyst appearance change | A | B | B | B | A |

TABLE 68

| | | Example 320 | Example 321 | Example 322 | Example 323 | Example 324 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |

TABLE 68-continued

| | | Example 320 | Example 321 | Example 322 | Example 323 | Example 324 |
|---|---|---|---|---|---|---|
| | Base oil 4 | — | — | — | — | — |
| | Base oil 5 | 99.0 | 99.0 | 99.0 | 99.0 | 99.0 |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | 0.5 | 0.5 | 0.5 | 0.5 | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 3.9 | 4.0 | 4.4 | 4.1 | 4.9 |
| Lubrication test 4 | Average coefficient of friction 3 | 0.062 | 0.065 | 0.072 | 0.071 | 0.063 |
| Stability test 2 | Anti-sludge property | A | A | A | B | A |
| | Catalyst appearance change | A | B | B | B | A |

TABLE 69

| | | Example 325 | Example 326 | Example 327 | Example 328 | Example 329 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | 99.0 | 99.0 | 99.0 | 99.0 | 99.0 |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | — | — | — | — | — |
| | A12 | 0.5 | 0.5 | 0.5 | 0.5 | 0.5 |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 4.9 | 5.0 | 4.3 | 4.4 | 4.9 |
| Lubrication test 4 | Average coefficient of friction 3 | 0.063 | 0.062 | 0.076 | 0.071 | 0.068 |
| Stability test 2 | Anti-sludge property | A | A | A | B | A |
| | Catalyst appearance change | A | B | B | B | A |

55

TABLE 70

| | | Example 330 | Example 331 | Example 332 | Example 333 | Example 334 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | 99.0 | 99.0 | 99.0 | 99.0 | 99.0 |
| | Base oil 6 | — | — | — | — | — |

TABLE 70-continued

| | | Example 330 | Example 331 | Example 332 | Example 333 | Example 334 |
|---|---|---|---|---|---|---|
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | — | — | — | — | — |
| | A12 | — | — | — | — | — |
| | A13 | — | — | — | — | — |
| | A14 | 0.5 | 0.5 | 0.5 | 0.5 | 0.5 |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 5.2 | 5.0 | 4.4 | 4.2 | 5.2 |
| Lubrication test 4 | Average coefficient of friction 3 | 0.066 | 0.063 | 0.076 | 0.071 | 0.070 |
| Stability test 2 | Anti-sludge property | A | A | A | B | A |
| | Catalyst appearance change | A | B | B | B | A |

TABLE 71

| | | Example 335 | Example 336 | Example 337 | Example 338 |
|---|---|---|---|---|---|
| Compostion [Mass %] | Base oil 1 | — | — | — | — |
| | Base oil 2 | — | — | — | — |
| | Base oil 3 | — | — | — | — |
| | Base oil 4 | — | — | — | — |
| | Base oil 5 | 98.5 | 98.0 | 98.5 | 98.5 |
| | Base oil 6 | — | — | — | — |
| | Base oil 7 | — | — | — | — |
| | A6 | — | — | — | — |
| | A7 | — | — | — | — |
| | A8 | 0.5 | 0.5 | 0.5 | 0.5 |
| | A9 | — | — | — | — |
| | A10 | — | — | — | — |
| | A11 | — | — | — | — |
| | A12 | — | — | — | — |
| | A13 | — | — | — | — |
| | A14 | — | — | — | — |
| | A15 | — | — | — | — |
| | B2 | 0.5 | — | 0.5 | — |
| | B3 | — | 0.5 | — | — |
| | C4 | 0.5 | — | — | 0.5 |
| | C5 | — | 0.5 | — | — |
| | C3 | — | 0.5 | 0.5 | 0.5 |
| Lubrication test 3 | Abrasion loss 3 [mg] | 3.9 | 3.8 | 4.4 | 3.8 |
| Lubrication test 4 | Average coefficient of friction 3 | 0.054 | 0.049 | 0.055 | 0.054 |
| Stability test 2 | Anti-sludge property | A | A | A | A |
| | Catalyst appearance change | B | A | A | A |

TABLE 72

| | | Example 339 | Example 340 | Example 341 | Example 342 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | — | — | — | — |
| | Base oil 5 | 98.0 | 98.5 | 98.5 | 98.5 |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |

TABLE 72-continued

| | | Example 339 | Example 340 | Example 341 | Example 342 |
|---|---|---|---|---|---|
| | A10 | 0.5 | 0.5 | 0.5 | 0.5 |
| | A11 | — | — | — | — |
| | A12 | — | — | — | — |
| | A13 | — | — | — | — |
| | A14 | — | — | — | — |
| | A15 | — | — | — | — |
| | B2 | 0.5 | — | — | — |
| | B3 | — | 0.5 | 0.5 | — |
| | C4 | 0.5 | — | — | — |
| | C5 | — | 0.5 | — | 0.5 |
| | C3 | 0.5 | — | 0.5 | 0.5 |
| Lubrication test 3 | Abrasion loss 3 [mg] | 3.9 | 4.0 | 4.6 | 3.9 |
| Lubrication test 4 | Average coefficient of friction 3 | 0.053 | 0.063 | 0.059 | 0.057 |
| Stability test 2 | Anti-sludge property | A | A | A | A |
| | Catalyst appearance change | A | B | A | A |

TABLE 73

| | | Example 343 | Example 344 | Example 345 | Example 346 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | — | — | — | — |
| | Base oil 5 | 98.5 | 98.0 | 98.5 | 98.5 |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | 0.5 | 0.5 | 0.5 | 0.5 |
| | A13 | — | — | — | — |
| | A14 | — | — | — | — |
| | A15 | — | — | — | — |
| | B2 | 0.5 | — | 0.5 | — |
| | B3 | — | 0.5 | — | — |
| | C4 | 0.5 | — | — | 0.5 |
| | C5 | — | 0.5 | — | — |
| | C3 | — | 0.5 | 0.5 | 0.5 |
| Lubrication test 3 | Abrasion loss 3 [mg] | 4.4 | 4.3 | 4.8 | 4.3 |
| Lubrication test 4 | Average coefficient of friction 3 | 0.064 | 0.057 | 0.063 | 0.065 |
| Stability test 2 | Anti-sludge property | A | A | A | A |
| | Catalyst appearance change | B | A | A | A |

TABLE 74

| | | Example 347 | Example 348 | Example 349 | Example 350 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | — | — | — | — |
| | Base oil 5 | 98.0 | 98.5 | 98.5 | 98.5 |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | — | — | — | — |
| | A13 | — | — | — | — |
| | A14 | 0.5 | 0.5 | 0.5 | 0.5 |
| | A15 | — | — | — | — |
| | B2 | 0.5 | — | — | — |

TABLE 74-continued

| | | Example 347 | Example 348 | Example 349 | Example 350 |
|---|---|---|---|---|---|
| | B3 | — | 0.5 | 0.5 | — |
| | C4 | 0.5 | — | — | — |
| | C5 | — | 0.5 | — | 0.5 |
| | C3 | 0.5 | — | 0.5 | 0.5 |
| Lubrication test 3 | Abrasion loss 3 [mg] | 4.1 | 4.3 | 5.0 | 4.2 |
| Lubrication test 4 | Average coefficient of friction 3 | 0.057 | 0.065 | 0.063 | 0.060 |
| Stability test 2 | Anti-sludge property | A | A | A | A |
| | Catalyst appearance change | A | B | A | A |

TABLE 75

| | | Example 351 | Example 352 | Example 353 | Example 354 | Example 355 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | 99.5 | 99.5 | 99.5 | 99.5 | 99.5 |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | — | — | — | — | — |
| | C5 | — | — | — | — | — |
| | C3 | — | — | — | — | — |
| Lubrication test 3 | Abrasion loss 3 [mg] | 4.5 | 4.6 | 3.1 | 4.0 | 3.4 |
| Lubrication test 4 | Average coefficient of friction 3 | 0.091 | 0.095 | 0.069 | 0.087 | 0.076 |
| Stability test 2 | Anti-sludge property | A | A | A | B | A |
| | Catalyst appearance change | A | A | A | A | A |

TABLE 76

| | | Example 356 | Example 357 | Example 358 | Example 359 | Example 360 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | 99.5 | 99.5 | 99.5 | 99.5 | 99.5 |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | — | — | — | — | — |
| | C5 | — | — | — | — | — |
| | C3 | — | — | — | — | — |

TABLE 76-continued

| | | Example 356 | Example 357 | Example 358 | Example 359 | Example 360 |
|---|---|---|---|---|---|---|
| Lubrication test 3 | Abrasion loss 3 [mg] | 4.0 | 3.6 | 4.2 | 3.7 | 4.4 |
| Lubrication test 4 | Average coefficient of friction 3 | 0.088 | 0.08 | 0.089 | 0.082 | 0.089 |
| Stability test 2 | Anti-sludge property | B | A | B | A | B |
| | Catalyst appearance change | A | A | A | A | A |

TABLE 77

| | | Example 361 | Example 362 | Example 363 | Example 364 | Example 365 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | 99.0 | 99.0 | 99.0 | 99.0 | 99.0 |
| | Base oil 7 | — | — | — | — | — |
| | A6 | — | — | — | — | — |
| | A7 | — | — | — | — | — |
| | A8 | 0.5 | 0.5 | 0.5 | 0.5 | 0.5 |
| | A9 | — | — | — | — | — |
| | A10 | — | — | — | — | — |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 3.1 | 2.9 | 2.6 | 2.4 | 3.1 |
| Lubrication test 4 | Average coefficient of friction 3 | 0.062 | 0.061 | 0.072 | 0.069 | 0.065 |
| Stability test 2 | Anti-sludge property | A | A | B | B | A |
| | Catalyst appearance change | A | B | B | B | A |

40

TABLE 78

| | | Example 366 | Example 367 | Example 368 | Example 369 | Example 370 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | 99.0 | 99.0 | 99.0 | 99.0 | 99.0 |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | 0.5 | 0.5 | 0.5 | 0.5 | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 2.5 | 2.4 | 2.9 | 2.6 | 3.3 |
| Lubrication test 4 | Average coefficient of friction 3 | 0.067 | 0.070 | 0.078 | 0.075 | 0.069 |

TABLE 78-continued

| | | Example 366 | Example 367 | Example 368 | Example 369 | Example 370 |
|---|---|---|---|---|---|---|
| Stability test 2 | Anti-sludge property | A | A | B | B | A |
| | Catalyst appearance change | A | B | B | B | A |

TABLE 79

| | | Example 371 | Example 372 | Example 373 | Example 374 | Example 375 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | 99.0 | 99.0 | 99.0 | 99.0 | 99.0 |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | — | — | — | — | — |
| | A12 | 0.5 | 0.5 | 0.5 | 0.5 | 0.5 |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 3.4 | 3.4 | 2.9 | 2.8 | 3.5 |
| Lubrication test 4 | Average coefficient of friction 3 | 0.071 | 0.071 | 0.081 | 0.079 | 0.074 |
| Stability test 2 | Anti-sludge property | A | A | B | B | A |
| | Catalyst appearance change | A | B | B | B | A |

TABLE 80

| | | Example 376 | Example 377 | Example 378 | Example 379 | Example 380 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | 99.0 | 99.0 | 99.0 | 99.0 | 99.0 |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | — | — | — | — | — |
| | A12 | — | — | — | — | — |
| | A13 | — | — | — | — | — |
| | A14 | 0.5 | 0.5 | 0.5 | 0.5 | 0.5 |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 3.6 | 3.5 | 3.0 | 2.7 | 3.8 |
| Lubrication test 4 | Average coefficient of friction 3 | 0.075 | 0.071 | 0.082 | 0.078 | 0.075 |
| Stability test 2 | Anti-sludge property | A | A | B | B | A |
| | Catalyst appearance change | A | B | B | B | A |

TABLE 81

| | | Example 381 | Example 382 | Example 383 | Example 384 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | — | — | — | — |
| | Base oil 5 | — | — | — | — |
| | Base oil 6 | 98.5 | 98.0 | 98.5 | 98.5 |
| | Base oil 7 | — | — | — | — |
| | A6 | — | — | — | — |
| | A7 | — | — | — | — |
| | A8 | 0.5 | 0.5 | 0.5 | 0.5 |
| | A9 | — | — | — | — |
| | A10 | — | — | — | — |
| | A11 | — | — | — | — |
| | A12 | — | — | — | — |
| | A13 | — | — | — | — |
| | A14 | — | — | — | — |
| | A15 | — | — | — | — |
| | B2 | 0.5 | — | 0.5 | — |
| | B3 | — | 0.5 | — | — |
| | C4 | 0.5 | — | — | 0.5 |
| | C5 | — | 0.5 | — | — |
| | C3 | — | 0.5 | 0.5 | 0.5 |
| Lubrication test 3 | Abrasion loss 3 [mg] | 2.3 | 2.2 | 2.9 | 2.3 |
| Lubrication test 4 | Average coefficient of friction 3 | 0.061 | 0.054 | 0.060 | 0.061 |
| Stability test 2 | Anti-sludge property | A | A | A | A |
| | Catalyst appearance change | B | A | A | A |

TABLE 82

| | | Example 385 | Example 386 | Example 387 | Example 388 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | — | — | — | — |
| | Base oil 5 | — | — | — | — |
| | Base oil 6 | 98.0 | 98.5 | 98.5 | 98.5 |
| | Base oil 7 | — | — | — | — |
| | A6 | — | — | — | — |
| | A7 | — | — | — | — |
| | A8 | — | — | — | — |
| | A9 | — | — | — | — |
| | A10 | 0.5 | 0.5 | 0.5 | 0.5 |
| | A11 | — | — | — | — |
| | A12 | — | — | — | — |
| | A13 | — | — | — | — |
| | A14 | — | — | — | — |
| | A15 | — | — | — | — |
| | B2 | 0.5 | — | — | — |
| | B3 | — | 0.5 | 0.5 | — |
| | C4 | 0.5 | — | — | — |
| | C5 | — | 0.5 | — | 0.5 |
| | C3 | 0.5 | — | 0.5 | 0.5 |
| Lubrication test 3 | Abrasion loss 3 [mg] | 2.4 | 2.6 | 3.0 | 2.5 |
| Lubrication test 4 | Average coefficient of friction 3 | 0.059 | 0.069 | 0.065 | 0.063 |
| Stability test 2 | Anti-sludge property | A | B | A | A |
| | Catalyst appearance change | A | B | A | A |

TABLE 83

| | | Example 389 | Example 390 | Example 391 | Example 392 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | — | — | — | — |
| | Base oil 5 | — | — | — | — |
| | Base oil 6 | 98.5 | 98.0 | 98.5 | 98.5 |
| | Base oil 7 | — | — | — | — |

TABLE 83-continued

| | | Example 389 | Example 390 | Example 391 | Example 392 |
|---|---|---|---|---|---|
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | 0.5 | 0.5 | 0.5 | 0.5 |
| | A13 | — | — | — | — |
| | A14 | — | — | — | — |
| | A15 | — | — | — | — |
| | B2 | 0.5 | — | 0.5 | — |
| | B3 | — | 0.5 | — | — |
| | C4 | 0.5 | — | — | 0.5 |
| | C5 | — | 0.5 | — | — |
| | C3 | — | 0.5 | 0.5 | 0.5 |
| Lubrication test 3 | Abrasion loss 3 [mg] | 3.0 | 2.7 | 3.4 | 2.8 |
| Lubrication test 4 | Average coefficient of friction 3 | 0.070 | 0.063 | 0.069 | 0.072 |
| Stability test 2 | Anti-sludge property | A | A | A | A |
| | Catalyst appearance change | B | A | A | A |

TABLE 84

| | | Example 393 | Example 394 | Example 395 | Example 396 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | — | — | — | — |
| | Base oil 5 | — | — | — | — |
| | Base oil 6 | 98.0 | 98.5 | 98.5 | 98.5 |
| | Base oil 7 | — | — | — | — |
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | — | — | — | — |
| | A13 | — | — | — | — |
| | A14 | 0.5 | 0.5 | 0.5 | 0.5 |
| | A15 | — | — | — | — |
| | B2 | 0.5 | — | — | — |
| | B3 | — | 0.5 | 0.5 | — |
| | C4 | 0.5 | — | — | — |
| | C5 | — | 0.5 | — | 0.5 |
| | C3 | 0.5 | — | 0.5 | 0.5 |
| Lubrication test 3 | Abrasion loss 3 [mg] | 2.5 | 3.0 | 3.6 | 2.6 |
| Lubrication test 4 | Average coefficient of friction 3 | 0.063 | 0.070 | 0.069 | 0.067 |
| Stability test 2 | Anti-sludge property | A | B | A | A |
| | Catalyst appearance change | A | B | A | A |

TABLE 85

| | | Example 397 | Example 398 | Example 399 | Example 400 | Example 401 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | 99.5 | 99.5 | 99.5 | 99.5 | 99.5 |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |

TABLE 85-continued

| | | Example 397 | Example 398 | Example 399 | Example 400 | Example 401 |
|---|---|---|---|---|---|---|
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | — | — | — | — | — |
| | C5 | — | — | — | — | — |
| | C3 | — | — | — | — | — |
| Lubrication test 3 | Abrasion loss 3 [mg] | 4.2 | 4.5 | 3.0 | 3.7 | 3.1 |
| Lubrication test 4 | Average coefficient of friction 3 | 0.088 | 0.091 | 0.065 | 0.084 | 0.072 |
| Stability test 2 | Anti-sludge property | A | A | A | B | A |
| | Catalyst appearance change | A | A | A | A | A |

TABLE 86

| | | Example 402 | Example 403 | Example 404 | Example 405 | Example 406 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | 99.5 | 99.5 | 99.5 | 99.5 | 99.5 |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | — | — | — | — | — |
| | C5 | — | — | — | — | — |
| | C3 | — | — | — | — | — |
| Lubrication test 3 | Abrasion loss 3 [mg] | 3.8 | 3.4 | 4.0 | 3.6 | 4.1 |
| Lubrication test 4 | Average coefficient of friction 3 | 0.083 | 0.075 | 0.084 | 0.078 | 0.085 |
| Stability test 2 | Anti-sludge property | B | A | B | A | B |
| | Catalyst appearance change | A | A | A | A | A |

TABLE 87

| | | Example 407 | Example 408 | Example 409 | Example 410 | Example 411 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | 99.0 | 99.0 | 99.0 | 99.0 | 99.0 |
| | A6 | — | — | — | — | — |
| | A7 | — | — | — | — | — |
| | A8 | 0.5 | 0.5 | 0.5 | 0.5 | 0.5 |
| | A9 | — | — | — | — | — |
| | A10 | — | — | — | — | — |
| | A11 | — | — | — | — | — |
| | A12 | — | — | — | — | — |
| | A13 | — | — | — | — | — |
| | A14 | — | — | — | — | — |
| | A15 | — | — | — | — | — |

TABLE 87-continued

| | | Example 407 | Example 408 | Example 409 | Example 410 | Example 411 |
|---|---|---|---|---|---|---|
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 3.0 | 2.8 | 2.3 | 2.0 | 2.9 |
| Lubrication test 4 | Average coefficient of friction 3 | 0.058 | 0.055 | 0.067 | 0.066 | 0.061 |
| Stability test 2 | Anti-sludge property | A | A | B | B | A |
| | Catalyst appearance change | A | B | B | B | A |

TABLE 88

| | | Example 412 | Example 413 | Example 414 | Example 415 | Example 416 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | 99.0 | 99.0 | 99.0 | 99.0 | 99.0 |
| | A6 | — | — | — | — | — |
| | A7 | — | — | — | — | — |
| | A8 | — | — | — | — | — |
| | A9 | — | — | — | — | — |
| | A10 | 0.5 | 0.5 | 0.5 | 0.5 | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 2.1 | 2.2 | 2.8 | 2.4 | 3.2 |
| Lubrication test 4 | Average coefficient of friction 3 | 0.063 | 0.066 | 0.073 | 0.072 | 0.065 |
| Stability test 2 | Anti-sludge property | A | A | B | B | A |
| | Catalyst appearance change | A | B | B | B | A |

TABLE 89

| | | Example 417 | Example 418 | Example 419 | Example 420 | Example 421 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | 99.0 | 99.0 | 99.0 | 99.0 | 99.0 |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | — | — | — | — | — |
| | A12 | 0.5 | 0.5 | 0.5 | 0.5 | 0.5 |
| | A13 | — | — | — | — | — |
| | A14 | — | — | — | — | — |
| | A15 | — | — | — | — | — |
| | B2 | 0.5 | — | — | — | — |
| | B3 | — | 0.5 | — | — | — |
| | C4 | — | — | 0.5 | — | — |

TABLE 89-continued

| | | Example 417 | Example 418 | Example 419 | Example 420 | Example 421 |
|---|---|---|---|---|---|---|
| | C5 | — | — | — | 0.5 | — |
| | C3 | — | — | — | — | 0.5 |
| Lubrication test 3 | Abrasion loss 3 [mg] | 3.3 | 3.3 | 2.8 | 2.7 | 3.3 |
| Lubrication test 4 | Average coefficient of friction 3 | 0.067 | 0.066 | 0.078 | 0.070 | 0.071 |
| Stability test 2 | Anti-sludge property | A | A | B | B | A |
| | Catalyst appearance change | A | B | B | B | A |

TABLE 90

| | | Example 422 | Example 423 | Example 424 | Example 425 | Example 426 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | 99.0 | 99.0 | 99.0 | 99.0 | 99.0 |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | — | — | — | — | — |
| | A12 | — | — | — | — | — |
| | A13 | — | — | — | — | — |
| | A14 | 0.5 | 0.5 | 0.5 | 0.5 | 0.5 |
| | A15 | — | — | — | — | — |
| | B2 | 0.5 | — | — | — | — |
| | B3 | — | 0.5 | — | — | — |
| | C4 | — | — | 0.5 | — | — |
| | C5 | — | — | — | 0.5 | — |
| | C3 | — | — | — | — | 0.5 |
| Lubrication test 3 | Abrasion loss 3 [mg] | 3.4 | 3.3 | 2.8 | 2.4 | 3.5 |
| Lubrication test 4 | Average coefficient of friction 3 | 0.069 | 0.067 | 0.078 | 0.074 | 0.071 |
| Stability test 2 | Anti-sludge property | A | A | B | B | A |
| | Catalyst appearance change | A | B | B | B | A |

TABLE 91

| | | Example 427 | Example 428 | Example 429 | Example 430 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | — | — | — | — |
| | Base oil 5 | — | — | — | — |
| | Base oil 6 | — | — | — | — |
| | Base oil 7 | 98.5 | 98.0 | 98.5 | 98.5 |
| | A6 | — | — | — | — |
| | A7 | — | — | — | — |
| | A8 | 0.5 | 0.5 | 0.5 | 0.5 |
| | A9 | — | — | — | — |
| | A10 | — | — | — | — |
| | A11 | — | — | — | — |
| | A12 | — | — | — | — |
| | A13 | — | — | — | — |
| | A14 | — | — | — | — |
| | A15 | — | — | — | — |
| | B2 | 0.5 | — | 0.5 | — |
| | B3 | — | 0.5 | — | — |
| | C4 | 0.5 | — | — | 0.5 |
| | C5 | — | 0.5 | — | — |
| | C3 | — | 0.5 | 0.5 | 0.5 |

TABLE 91-continued

| | | Example 427 | Example 428 | Example 429 | Example 430 |
|---|---|---|---|---|---|
| Lubrication test 3 | Abrasion loss 3 [mg] | 2.2 | 2.0 | 2.8 | 2.0 |
| Lubrication test 4 | Average coefficient of friction 3 | 0.056 | 0.051 | 0.055 | 0.056 |
| Stability test 2 | Anti-sludge property | A | A | A | A |
| | Catalyst appearance change | B | A | A | A |

TABLE 92

| | | Example 431 | Example 432 | Example 433 | Example 434 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | — | — | — | — |
| | Base oil 5 | — | — | — | — |
| | Base oil 6 | — | — | — | — |
| | Base oil 7 | 98.0 | 98.5 | 98.5 | 98.5 |
| | A6 | — | — | — | — |
| | A7 | — | — | — | — |
| | A8 | — | — | — | — |
| | A9 | — | — | — | — |
| | A10 | 0.5 | 0.5 | 0.5 | 0.5 |
| | A11 | — | — | — | — |
| | A12 | — | — | — | — |
| | A13 | — | — | — | — |
| | A14 | — | — | — | — |
| | A15 | — | — | — | — |
| | B2 | 0.5 | — | — | — |
| | B3 | — | 0.5 | 0.5 | — |
| | C4 | 0.5 | — | — | — |
| | C5 | — | 0.5 | — | 0.5 |
| | C3 | 0.5 | — | 0.5 | 0.5 |
| Lubrication test 3 | Abrasion loss 3 [mg] | 2.2 | 2.3 | 2.9 | 2.3 |
| Lubrication test 4 | Average coefficient of friction 3 | 0.055 | 0.065 | 0.061 | 0.059 |
| Stability test 2 | Anti-sludge property | A | B | A | A |
| | Catalyst appearance change | A | B | A | A |

TABLE 93

| | | Example 435 | Example 436 | Example 437 | Example 438 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | — | — | — | — |
| | Base oil 5 | — | — | — | — |
| | Base oil 6 | — | — | — | — |
| | Base oil 7 | 98.5 | 98.0 | 98.5 | 98.5 |
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | 0.5 | 0.5 | 0.5 | 0.5 |
| | A13 | — | — | — | — |
| | A14 | — | — | — | — |
| | A15 | — | — | — | — |
| | B2 | 0.5 | — | 0.5 | — |
| | B3 | — | 0.5 | — | — |
| | C4 | 0.5 | — | — | 0.5 |
| | C5 | — | 0.5 | — | — |
| | C3 | — | 0.5 | 0.5 | 0.5 |
| Lubrication test 3 | Abrasion loss 3 [mg] | 2.8 | 2.6 | 3.2 | 2.6 |
| Lubrication test 4 | Average coefficient of friction 3 | 0.067 | 0.059 | 0.066 | 0.067 |
| Stability test 2 | Anti-sludge property | A | A | A | A |
| | Catalyst appearance change | B | A | A | A |

TABLE 94

| | | Example 439 | Example 440 | Example 441 | Example 442 |
|---|---|---|---|---|---|
| Composition [Mass %] | Base oil 1 | — | — | — | — |
| | Base oil 2 | — | — | — | — |
| | Base oil 3 | — | — | — | — |
| | Base oil 4 | — | — | — | — |
| | Base oil 5 | — | — | — | — |
| | Base oil 6 | — | — | — | — |
| | Base oil 7 | 98.0 | 98.5 | 98.5 | 98.5 |
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | — | — | — | — |
| | A13 | — | — | — | — |
| | A14 | 0.5 | 0.5 | 0.5 | 0.5 |
| | A15 | — | — | — | — |
| | B2 | 0.5 | — | — | — |
| | B3 | — | 0.5 | 0.5 | — |
| | C4 | 0.5 | — | — | — |
| | C5 | — | 0.5 | — | 0.5 |
| | C3 | 0.5 | — | 0.5 | 0.5 |
| Lubrication test 3 | Abrasion loss 3 [mg] | 2.2 | 2.7 | 3.4 | 2.5 |
| Lubrication test 4 | Average coefficient of friction 3 | 0.059 | 0.067 | 0.065 | 0.062 |
| Stability test 2 | Anti-sludge property | A | B | A | A |
| | Catalyst appearance change | A | B | A | A |

TABLE 95

| | | Comparative Example 21 | Comparative Example 22 | Comparative Example 23 | Comparative Example 24 |
|---|---|---|---|---|---|
| Composition [Mass %] | Base oil 1 | 100 | — | — | — |
| | Base oil 2 | — | 100 | — | — |
| | Base oil 3 | — | — | 100 | — |
| | Base oil 4 | — | — | — | 100 |
| | Base oil 5 | — | — | — | — |
| | Base oil 6 | — | — | — | — |
| | Base oil 7 | — | — | — | — |
| | A6 | — | — | — | — |
| | A7 | — | — | — | — |
| | A8 | — | — | — | — |
| | A9 | — | — | — | — |
| | A10 | — | — | — | — |
| | A11 | — | — | — | — |
| | A12 | — | — | — | — |
| | A13 | — | — | — | — |
| | A14 | — | — | — | — |
| | A15 | — | — | — | — |
| | B2 | — | — | — | — |
| | B3 | — | — | — | — |
| | C4 | — | — | — | — |
| | C5 | — | — | — | — |
| | C3 | — | — | — | — |
| Lubrication test 3 | Abrasion loss 3 [mg] | 7.8 | 9.2 | 8.3 | 6.4 |
| Lubrication test 4 | Average coefficient of friction 3 | 0.122 | 0.132 | 0.129 | 0.115 |
| Stability test 2 | Anti-sludge property | A | A | A | A |
| | Catalyst appearance change | A | A | A | A |

TABLE 96

| | | Comparative Example 25 | Comparative Example 26 | Comparative Example 27 |
|---|---|---|---|---|
| Composition [Mass %] | Base oil 1 | — | — | — |
| | Base oil 2 | — | — | — |
| | Base oil 3 | — | — | — |

TABLE 96-continued

| | | Comparative Example 25 | Comparative Example 26 | Comparative Example 27 |
|---|---|---|---|---|
| | Base oil 4 | — | — | — |
| | Base oil 5 | 100 | — | — |
| | Base oil 6 | — | 100 | — |
| | Base oil 7 | — | — | 100 |
| | A6 | — | — | — |
| | A7 | — | — | — |
| | A8 | — | — | — |
| | A9 | — | — | — |
| | A10 | — | — | — |
| | A11 | — | — | — |
| | A12 | — | — | — |
| | A13 | — | — | — |
| | A14 | — | — | — |
| | A15 | — | — | — |
| | B2 | — | — | — |
| | B3 | — | — | — |
| | C4 | — | — | — |
| | C5 | — | — | — |
| | C3 | — | — | — |
| Lubrication test 3 | Abrasion loss 3 [mg] | 8.0 | 6.2 | 6.0 |
| Lubrication test 4 | Average coefficient of friction 3 | 0.110 | 0.112 | 0.108 |
| Stability test 2 | Anti-sludge property | A | A | A |
| | Catalyst appearance change | A | A | A |

TABLE 97

| | | Example 443 | Example 444 | Example 445 | Example 446 | Example 447 |
|---|---|---|---|---|---|---|
| Composition [Mass %] | Base oil 1 | 99.5 | 99.5 | 99.5 | 99.5 | 99.5 |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | — | — | — | — | — |
| | C5 | — | — | — | — | — |
| | C3 | — | — | — | — | — |
| Refrigerant | | R407C | R407C | R407C | R407C | R407C |
| Lubrication test 3 | Abrasion loss 3 [mg] | 6.1 | 6.2 | 5.0 | 5.4 | 5.1 |
| Lubrication test 4 | Average coefficient of friction 3 | 0.103 | 0.104 | 0.082 | 0.098 | 0.088 |
| Stability test 2 | Anti-sludge property | A | A | A | B | A |
| | Catalyst appearance change | A | A | A | A | A |

TABLE 98

| | | Example 448 | Example 449 | Example 450 | Example 451 | Example 452 |
|---|---|---|---|---|---|---|
| Composition [Mass %] | Base oil 1 | 99.5 | 99.5 | 99.5 | 99.5 | 99.5 |
| | Base oil 2 | — | — | — | — | — |
| | Base oil 3 | — | — | — | — | — |
| | Base oil 4 | — | — | — | — | — |
| | Base oil 5 | — | — | — | — | — |

TABLE 98-continued

| | | Example 448 | Example 449 | Example 450 | Example 451 | Example 452 |
|---|---|---|---|---|---|---|
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | — | — | — | — | — |
| | C5 | — | — | — | — | — |
| | C3 | — | — | — | — | — |
| Refrigerant | | R407C | R407C | R407C | R407C | R407C |
| Lubrication test 3 | Abrasion loss 3 [mg] | 5.5 | 5.0 | 5.9 | 5.3 | 5.8 |
| Lubrication test 4 | Average coefficient of friction 3 | 0.098 | 0.091 | 0.098 | 0.091 | 0.099 |
| Stability test 2 | Anti-sludge property | B | A | B | A | B |
| | Catalyst appearance change | A | A | A | A | A |

TABLE 99

| | | Example 453 | Example 454 | Example 455 | Example 456 | Example 457 |
|---|---|---|---|---|---|---|
| Composition [Mass %] | Base oil 1 | — | — | — | — | — |
| | Base oil 2 | — | — | — | — | — |
| | Base oil 3 | 99.5 | 99.5 | 99.5 | 99.5 | 99.5 |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | — | — | — | — | — |
| | C5 | — | — | — | — | — |
| | C3 | — | — | — | — | — |
| Refrigerant | | R407C | R407C | R407C | R407C | R407C |
| Lubrication test 3 | Abrasion loss 3 [mg] | 6.4 | 6.9 | 5.2 | 5.8 | 5.4 |
| Lubrication test 4 | Average coefficient of friction 3 | 0.111 | 0.113 | 0.090 | 0.105 | 0.094 |
| Stability test 2 | Anti-sludge property | A | A | A | B | A |
| | Catalyst appearance change | A | A | A | A | A |

TABLE 100

| | | Example 458 | Example 459 | Example 460 | Example 461 | Example 462 |
|---|---|---|---|---|---|---|
| Composition [Mass %] | Base oil 1 | — | — | — | — | — |
| | Base oil 2 | — | — | — | — | — |
| | Base oil 3 | 99.5 | 99.5 | 99.5 | 99.5 | 99.5 |
| | Base oil 4 | — | — | — | — | — |
| | Base oil 5 | — | — | — | — | — |
| | Base oil 6 | — | — | — | — | — |

TABLE 100-continued

| | | Example 458 | Example 459 | Example 460 | Example 461 | Example 462 |
|---|---|---|---|---|---|---|
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | — | — | — | — | — |
| | C5 | — | — | — | — | — |
| | C3 | — | — | — | — | — |
| Refrigerant | | R407C | R407C | R407C | R407C | R407C |
| Lubrication test 3 | Abrasion loss 3 [mg] | 6.1 | 5.7 | 6.5 | 5.7 | 6.4 |
| Lubrication test 4 | Average coefficient of friction 3 | 0.104 | 0.098 | 0.107 | 0.100 | 0.106 |
| Stability test 2 | Anti-sludge property | B | A | B | A | B |
| | Catalyst appearance change | A | A | A | A | A |

TABLE 101

| | | Example 463 | Example 464 | Example 465 | Example 466 | Example 467 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | Base oil 8 | 99.5 | 99.5 | 99.5 | 99.5 | 99.5 |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | — | — | — | — | — |
| | C5 | — | — | — | — | — |
| | C3 | — | — | — | — | — |
| Refrigerant | | $CO_2$ | $CO_2$ | $CO_2$ | $CO_2$ | $CO_2$ |
| Lubrication test 3 | Abrasion loss 3 [mg] | 6.2 | 6.3 | 5.1 | 5.7 | 5.2 |
| Lubrication test 4 | Average coefficient of friction 3 | 0.112 | 0.115 | 0.091 | 0.103 | 0.097 |
| Stability test 2 | Anti-sludge property | A | A | A | B | A |
| | Catalyst appearance change | A | A | A | A | A |

55

TABLE 102

| | | Example 468 | Example 469 | Example 470 | Example 471 | Example 472 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |

TABLE 102-continued

| | | Example 468 | Example 469 | Example 470 | Example 471 | Example 472 |
|---|---|---|---|---|---|---|
| | Base oil 7 | — | — | — | — | — |
| | Base oil 8 | 99.5 | 99.5 | 99.5 | 99.5 | 99.5 |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | — | — | — | — | — |
| | C5 | — | — | — | — | — |
| | C3 | — | — | — | — | — |
| Refrigerant | | $CO_2$ | $CO_2$ | $CO_2$ | $CO_2$ | $CO_2$ |
| Lubrication test 3 | Abrasion loss 3 [mg] | 5.8 | 5.5 | 6.0 | 5.6 | 6.1 |
| Lubrication test 4 | Average coefficient of friction 3 | 0.103 | 0.100 | 0.107 | 0.100 | 0.110 |
| Stability test 2 | Anti-sludge property | B | A | B | A | B |
| | Catalyst appearance change | A | A | A | A | A |

TABLE 103

| | | Example 473 | Example 474 | Example 475 | Example 476 | Example 477 |
|---|---|---|---|---|---|---|
| Composition [Mass %] | Base oil 1 | — | — | — | — | — |
| | Base oil 2 | — | — | — | — | — |
| | Base oil 3 | 99.5 | 99.5 | 99.5 | 99.5 | 99.5 |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | — | — | — | — | — |
| | C5 | — | — | — | — | — |
| | C3 | — | — | — | — | — |
| | Refrigerant | $CO_2$ | $CO_2$ | $CO_2$ | $CO_2$ | $CO_2$ |
| Lubrication test 3 | Abrasion loss 3 [mg] | 6.8 | 7.0 | 5.6 | 6.1 | 5.7 |
| Lubrication test 4 | Average coefficient of friction 3 | 0.120 | 0.122 | 0.099 | 0.116 | 0.104 |
| Stability test 2 | Anti-sludge property | A | A | A | B | A |
| | Catalyst appearance change | A | A | A | A | A |

TABLE 104

| | | Example 478 | Example 479 | Example 480 | Example 481 | Example 482 |
|---|---|---|---|---|---|---|
| Composition [Mass %] | Base oil 1 | — | — | — | — | — |
| | Base oil 2 | — | — | — | — | — |
| | Base oil 3 | 99.5 | 99.5 | 99.5 | 99.5 | 99.5 |
| | Base oil 4 | — | — | — | — | — |
| | Base oil 5 | — | — | — | — | — |

TABLE 104-continued

| | | Example 478 | Example 479 | Example 480 | Example 481 | Example 482 |
|---|---|---|---|---|---|---|
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | — | — | — | — | — |
| | C5 | — | — | — | — | — |
| | C3 | — | — | — | — | — |
| Refrigerant | | $CO_2$ | $CO_2$ | $CO_2$ | $CO_2$ | $CO_2$ |
| Lubrication test 3 | Abrasion loss 3 [mg] | 6.6 | 5.8 | 6.6 | 5.9 | 6.8 |
| Lubrication test 4 | Average coefficient of friction 3 | 0.116 | 0.108 | 0.117 | 0.110 | 0.118 |
| Stability test 2 | Anti-sludge property | B | A | B | A | B |
| | Catalyst appearance change | A | A | A | A | A |

TABLE 105

| | | Example 483 | Example 484 | Example 485 | Example 486 | Example 487 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | 99.5 | 99.5 | 99.5 | 99.5 | 99.5 |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | — | — | — | — | — |
| | C5 | — | — | — | — | — |
| | C3 | — | — | — | — | — |
| | Refrigerant | $CO_2$ | $CO_2$ | $CO_2$ | $CO_2$ | $CO_2$ |
| Lubrication test 3 | Abrasion loss 3 [mg] | 6.3 | 6.5 | 5.3 | 5.8 | 5.3 |
| Lubrication test 4 | Average coefficient of friction 3 | 0.100 | 0.102 | 0.079 | 0.092 | 0.083 |
| Stability test 2 | Anti-sludge property | A | A | A | B | A |
| | Catalyst appearance change | A | A | A | A | A |

TABLE 106

| | | Example 488 | Example 489 | Example 490 | Example 491 | Example 492 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | 99.5 | 99.5 | 99.5 | 99.5 | 99.5 |

TABLE 106-continued

| | | Example 488 | Example 489 | Example 490 | Example 491 | Example 492 |
|---|---|---|---|---|---|---|
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | — | — | — | — | — |
| | C5 | — | — | — | — | — |
| | C3 | — | — | — | — | — |
| | Refrigerant | $CO_2$ | $CO_2$ | $CO_2$ | $CO_2$ | $CO_2$ |
| Lubrication test 3 | Abrasion loss 3 [mg] | 6.0 | 5.5 | 6.3 | 5.6 | 6.2 |
| Lubrication test 4 | Average coefficient of friction 3 | 0.092 | 0.088 | 0.099 | 0.089 | 0.096 |
| Stability test 2 | Anti-sludge property | B | A | B | A | B |
| | Catalyst appearance change | A | A | A | A | A |

25

TABLE 107

| | | Example 493 | Example 494 | Example 495 | Example 496 | Example 497 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | Base oil 8 | — | — | — | — | — |
| | Base oil 9 | 99.5 | 99.5 | 99.5 | 99.5 | 99.5 |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | — | — | — | — | — |
| | C5 | — | — | — | — | — |
| | C3 | — | — | — | — | — |
| | Refrigerant | R290 | R290 | R290 | R290 | R290 |
| Lubrication test 3 | Abrasion loss 3 [mg] | 7.3 | 7.6 | 6.2 | 6.9 | 6.3 |
| Lubrication test 4 | Average coefficient of friction 3 | 0.088 | 0.101 | 0.075 | 0.095 | 0.082 |
| Stability test 2 | Anti-sludge property | A | A | A | B | A |
| | Catalyst appearance change | A | A | A | A | A |

TABLE 108

| | | Example 498 | Example 499 | Example 500 | Example 501 | Example 502 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |

TABLE 108-continued

| | | Example 498 | Example 499 | Example 500 | Example 501 | Example 502 |
|---|---|---|---|---|---|---|
| | Base oil 5 | — | — | — | — | — |
| | Base oil 6 | — | — | — | — | — |
| | Base oil 7 | — | — | — | — | — |
| | Base oil 8 | — | — | — | — | — |
| | Base oil 9 | 99.5 | 99.5 | 99.5 | 99.5 | 99.5 |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | — | — | — | — | — |
| | C5 | — | — | — | — | — |
| | C3 | — | — | — | — | — |
| | Refrigerant | R290 | R290 | R290 | R290 | R290 |
| Lubrication test 3 | Abrasion loss 3 [mg] | 7.5 | 7.0 | 7.8 | 7.3 | 7.7 |
| Lubrication test 4 | Average coefficient of friction 3 | 0.105 | 0.102 | 0.110 | 0.104 | 0.110 |
| Stability test 2 | Anti-sludge property | B | A | B | A | B |
| | Catalyst appearance change | A | A | A | A | A |

TABLE 109

| | | Example 503 | Example 504 | Example 505 | Example 506 | Example 507 |
|---|---|---|---|---|---|---|
| Composition [Mass %] | Base oil 1 | 99.5 | 99.5 | 99.5 | 99.5 | 99.5 |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Lubrication test 3 | Abrasion loss 3 [mg] | 3.4 | 3.5 | 3.1 | 3.3 | 3.1 |
| Lubrication test 4 | Average coefficient of friction 3 | 0.103 | 0.104 | 0.082 | 0.098 | 0.088 |
| Stability test 2 | Anti-sludge property | A | B | A | B | A |
| | Catalyst appearance change | A | A | A | A | A |

Examples 503-633

In Examples 503-633, refrigerating machine oil compositions having the compositions shown in the following TABLES 109-134 were prepared using the above-mentioned base oils and additives, respectively. These refrigerating machine oil compositions contain both tricresyl phosphate (C4) and triphenyl phosphorothionete (C5) as essential ingredients.

Next, the following tests were performed on each refrigerating machine oil composition of Examples 503-633.

[Lubrication Test 3]

The sliding part of a FALEX tester (ASTM D2714) was installed in a pressure resistant container, a refrigerant was introduced in the container, and a FALEX test was performed under the following conditions. The weight of the block before and after the end of the FALEX test was measured, and the abrasion loss was calculated as a weight amount reduction (Abrasion loss 3). The obtained results are shown in TABLES 109-134. In the test, the base oil and the refrigerant of the refrigerating machine oil composition were the combinations shown in TABLES 109-134.

Test start temperature: 25° C.

Test time: 30 minutes,

Load: 556 N,

Refrigerant injection amount: 10 L/h

[Lubrication Test 4]

Using an Optimol SRV tester, the coefficient of friction between a ½-inch SUJ2 steel ball and SUJ2 disk (ϕ 10 mm) was measured. The test conditions were load 100 N, amplitude 1 mm, frequency 25 Hz, the coefficient of friction was recorded every second from test start to 20 minutes later, and the average was taken as the average coefficient of friction (hereafter, "Average coefficient of friction 3"). The refrigerant was poured onto the sliding parts at a flow rate of 10 L/h. The obtained results are shown in TABLES 109-134.

In the test, the base oil and the refrigerant of the refrigerating machine oil composition were the combinations shown in TABLES 109-134.

[Stability Test 2]

50 g of refrigerating machine oil composition was placed in a 200 ml autoclave, the air in the system was completely removed by a vacuum pump, air was returned to half (380 mmHg) of ordinary pressure (760 mmHg), 15 g of refrigerant was sealed inside, and the presence or absence of sludge, and the appearance of the catalyst, were evaluated after maintaining for 2 weeks at 175° C. The obtained results are shown in TABLES 109-134. In the test, the base oil and the refrigerant of the refrigerating machine oil composition were the combinations shown in TABLES 109-134. In the "anti-sludge properties" column of the table, A means no sludge was observed, B means very little sludge was observed, and C means a large amount of sludge was observed, respectively. In the "catalyst appearance change" column of the table, A means no change was observed in the catalyst, B means the catalyst slightly changed color, and x means the catalyst corroded, respectively.

TABLE 110

| | | Example 508 | Example 509 | Example 510 | Example 511 | Example 512 |
|---|---|---|---|---|---|---|
| Composition [Mass %] | Base oil 1 | 99.5 | 99.5 | 99.5 | 99.5 | 99.5 |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Lubrication test 3 | Abrasion loss 3 [mg] | 5.1 | 4.6 | 5.1 | 4.8 | 5.3 |
| Lubrication test 4 | Average coefficient of friction 3 | 0.096 | 0.089 | 0.099 | 0.093 | 0.101 |
| Stability test 2 | Anti-sludge property | B | A | B | A | B |
| | Catalyst appearance change | A | A | A | A | A |

TABLE 111

| | | Example 513 | Example 514 | Example 515 | Example 516 | Example 517 |
|---|---|---|---|---|---|---|
| Composition [Mass %] | Base oil 1 | — | — | — | — | — |
| | Base oil 2 | 99.5 | 99.5 | 99.5 | 99.5 | 99.5 |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |

TABLE 111-continued

| | | Example 513 | Example 514 | Example 515 | Example 516 | Example 517 |
|---|---|---|---|---|---|---|
| | A15 | — | — | — | — | — |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Lubrication test 3 | Abrasion loss 3 [mg] | 4.5 | 4.4 | 4.2 | 4.4 | 4.1 |
| Lubrication test 4 | Average coefficient of friction 3 | 0.113 | 0.114 | 0.090 | 0.105 | 0.097 |
| Stability test 2 | Anti-sludge property | A | A | A | B | A |
| | Catalyst appearance change | A | A | A | A | A |

TABLE 112

| | | Example 518 | Example 519 | Example 520 | Example 521 | Example 522 |
|---|---|---|---|---|---|---|
| Composition [Mass %] | Base oil 1 | — | — | — | — | — |
| | Base oil 2 | 99.5 | 99.5 | 99.5 | 99.5 | 99.5 |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Lubrication test 3 | Abrasion loss 3 [mg] | 4.5 | 4.2 | 4.4 | 4.2 | 4.5 |
| Lubrication test 4 | Average coefficient of friction 3 | 0.106 | 0.099 | 0.108 | 0.101 | 0.110 |
| Stability test 2 | Anti-sludge property | B | A | B | A | B |
| | Catalyst appearance change | A | A | A | A | A |

TABLE 113

| | | Example 523 | Example 524 | Example 525 | Example 526 | Example 527 |
|---|---|---|---|---|---|---|
| Composition [Mass %] | Base oil 1 | — | — | — | — | — |
| | Base oil 2 | — | — | — | — | — |
| | Base oil 3 | 99.5 | 99.5 | 99.5 | 99.5 | 99.5 |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |

TABLE 113-continued

| | | Example 523 | Example 524 | Example 525 | Example 526 | Example 527 |
|---|---|---|---|---|---|---|
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Lubrication test 3 | Abrasion loss 3 [mg] | 3.7 | 3.6 | 3.2 | 3.7 | 3.3 |
| Lubrication test 4 | Average coefficient of friction 3 | 0.111 | 0.113 | 0.090 | 0.105 | 0.092 |
| Stability test 2 | Anti-sludge property | A | A | A | B | A |
| | Catalyst appearance change | A | A | A | A | A |

TABLE 114

| | | Example 528 | Example 529 | Example 530 | Example 531 | Example 532 |
|---|---|---|---|---|---|---|
| Composition [Mass %] | Base oil 1 | — | — | — | — | — |
| | Base oil 2 | — | — | — | — | — |
| | Base oil 3 | 99.5 | 99.5 | 99.5 | 99.5 | 99.5 |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Lubrication test 3 | Abrasion loss 3 [mg] | 3.5 | 3.3 | 3.7 | 3.2 | 3.6 |
| Lubrication test 4 | Average coefficient of friction 3 | 0.106 | 0.098 | 0.107 | 0.100 | 0.106 |
| Stability test 2 | Anti-sludge property | B | A | B | A | B |
| | Catalyst appearance change | A | A | A | A | A |

TABLE 115

| | | Example 533 | Example 534 | Example 535 | Example 536 | Example 537 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | 99.5 | 99.5 | 99.5 | 99.5 | 99.5 |
| | Base oil 5 | — | — | — | — | — |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |

TABLE 115-continued

| | | Example 533 | Example 534 | Example 535 | Example 536 | Example 537 |
|---|---|---|---|---|---|---|
| Lubrication test 3 | Abrasion loss 3 [mg] | 2.1 | 2.0 | 1.6 | 1.9 | 1.7 |
| Lubrication test 4 | Average coefficient of friction 3 | 0.095 | 0.097 | 0.073 | 0.090 | 0.080 |
| Stability test 2 | Anti-sludge property | A | A | A | B | A |
| | Catalyst appearance change | A | A | A | A | A |

TABLE 116

| | | Example 538 | Example 539 | Example 540 | Example 541 | Example 542 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | 99.5 | 99.5 | 99.5 | 99.5 | 99.5 |
| | Base oil 5 | — | — | — | — | — |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Lubrication test 3 | Abrasion loss 3 [mg] | 2.0 | 1.7 | 2.0 | 1.8 | 2.2 |
| Lubrication test 4 | Average coefficient of friction 3 | 0.090 | 0.084 | 0.092 | 0.085 | 0.092 |
| Stability test 2 | Anti-sludge property | B | A | B | A | B |
| | Catalyst appearance change | A | A | A | A | A |

40

TABLE 117

| | | Example 543 | Example 544 | Example 545 | Example 546 | Example 547 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | 99.5 | 99.5 | 99.5 | 99.5 | 99.5 |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Lubrication test 3 | Abrasion loss 3 [mg] | 3.2 | 3.0 | 2.6 | 3.1 | 2.8 |
| Lubrication test 4 | Average coefficient of friction 3 | 0.086 | 0.090 | 0.065 | 0.079 | 0.070 |

TABLE 117-continued

| | | Example 543 | Example 544 | Example 545 | Example 546 | Example 547 |
|---|---|---|---|---|---|---|
| Stability test 2 | Anti-sludge property | A | A | A | B | A |
| | Catalyst appearance change | A | A | A | A | A |

TABLE 118

| | | Example 548 | Example 549 | Example 550 | Example 551 | Example 552 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | 99.5 | 99.5 | 99.5 | 99.5 | 99.5 |
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Lubrication test 3 | Abrasion loss 3 [mg] | 3.1 | 2.7 | 3.0 | 2.8 | 3.2 |
| Lubrication test 4 | Average coefficient of friction 3 | 0.081 | 0.073 | 0.086 | 0.074 | 0.082 |
| Stability test 2 | Anti-sludge property | B | A | B | A | B |
| | Catalyst appearance change | A | A | A | A | A |

TABLE 119

| | | Example 553 | Example 554 | Example 555 | Example 556 | Example 557 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | 99.5 | 99.5 | 99.5 | 99.5 | 99.5 |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Lubrication test 3 | Abrasion loss 3 [mg] | 2.2 | 2.1 | 1.7 | 2.1 | 1.8 |
| Lubrication test 4 | Average coefficient of friction 3 | 0.092 | 0.094 | 0.070 | 0.088 | 0.077 |
| Stability test 2 | Anti-sludge property | A | A | A | B | A |
| | Catalyst appearance change | A | A | A | A | A |

TABLE 120

| | | Example 558 | Example 559 | Example 560 | Example 561 | Example 562 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | 99.5 | 99.5 | 99.5 | 99.5 | 99.5 |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Lubrication test 3 | Abrasion loss 3 [mg] | 2.2 | 1.9 | 2.1 | 2.0 | 2.2 |
| Lubrication test 4 | Average coefficient of friction 3 | 0.089 | 0.081 | 0.090 | 0.081 | 0.088 |
| Stability test 2 | Anti-sludge property | B | A | B | A | B |
| | Catalyst appearance change | A | A | A | A | A |

TABLE 121

| | | Example 563 | Example 564 | Example 565 | Example 567 | Example 568 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | 99.5 | 99.5 | 99.5 | 99.5 | 99.5 |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Lubrication test 3 | Abrasion loss 3 [mg] | 1.8 | 1.7 | 1.5 | 1.8 | 1.6 |
| Lubrication test 4 | Average coefficient of friction 3 | 0.089 | 0.090 | 0.067 | 0.083 | 0.071 |
| Stability test 2 | Anti-sludge property | A | A | A | B | A |
| | Catalyst appearance change | A | A | A | A | A |

TABLE 122

| | | Example 569 | Example 570 | Example 571 | Example 572 | Example 573 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |

TABLE 122-continued

| | | Example 569 | Example 570 | Example 571 | Example 572 | Example 573 |
|---|---|---|---|---|---|---|
| | Base oil 4 | — | — | — | — | — |
| | Base oil 5 | — | — | — | — | — |
| | Base oil 6 | — | — | — | — | — |
| | Base oil 7 | 99.5 | 99.5 | 99.5 | 99.5 | 99.5 |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Lubrication test 3 | Abrasion loss 3 [mg] | 1.9 | 1.7 | 1.8 | 1.6 | 1.8 |
| Lubrication test 4 | Average coefficient of friction 3 | 0.082 | 0.076 | 0.085 | 0.079 | 0.084 |
| Stability test 2 | Anti-sludge property | B | A | B | A | B |
| | Catalyst appearance change | A | A | A | A | A |

TABLE 123

| | | Example 574 | Example 575 | Example 576 | Example 577 | Example 578 |
|---|---|---|---|---|---|---|
| Composition [Mass %] | Base oil 1 | 99.5 | 99.5 | 99.5 | 99.5 | 99.5 |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Refrigerant | | R407C | R407C | R407C | R407C | R407C |
| Lubrication test 3 | Abrasion loss 3 [mg] | 3.3 | 3.4 | 2.9 | 3.1 | 3.0 |
| Lubrication test 4 | Average coefficient of friction 3 | 0.103 | 0.105 | 0.082 | 0.099 | 0.089 |
| Stability test 2 | Anti-sludge property | A | A | A | B | A |
| | Catalyst appearance change | A | A | A | A | A |

TABLE 124

| | | Example 579 | Example 580 | Example 581 | Example 582 | Example 583 |
|---|---|---|---|---|---|---|
| Composition [Mass %] | Base oil 1 | 99.5 | 99.5 | 99.5 | 99.5 | 99.5 |
| | Base oil 2 | — | — | — | — | — |
| | Base oil 3 | — | — | — | — | — |
| | Base oil 4 | — | — | — | — | — |
| | Base oil 5 | — | — | — | — | — |

TABLE 124-continued

| | | Example 579 | Example 580 | Example 581 | Example 582 | Example 583 |
|---|---|---|---|---|---|---|
| | Base oil 6 | — | — | — | — | — |
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Refrigerant | | R407C | R407C | R407C | R407C | R407C |
| Lubrication test 3 | Abrasion loss 3 [mg] | 3.4 | 2.9 | 3.1 | 3.0 | 3.2 |
| Lubrication test 4 | Average coefficient of friction 3 | 0.099 | 0.092 | 0.098 | 0.091 | 0.100 |
| Stability test 2 | Anti-sludge property | B | A | B | A | B |
| | Catalyst appearance change | A | A | A | A | A |

TABLE 125

| | | Example 584 | Example 585 | Example 586 | Example 587 | Example 588 |
|---|---|---|---|---|---|---|
| Composition [Mass %] | Base oil 1 | — | — | — | — | — |
| | Base oil 2 | — | — | — | — | — |
| | Base oil 3 | 99.5 | 99.5 | 99.5 | 99.5 | 99.5 |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Refrigerant | | R407C | R407C | R407C | R407C | R407C |
| Lubrication test 3 | Abrasion loss 3 [mg] | 3.6 | 3.7 | 3.2 | 3.6 | 3.3 |
| Lubrication test 4 | Average coefficient of friction 3 | 0.110 | 0.113 | 0.092 | 0.105 | 0.094 |
| Stability test 2 | Anti-sludge property | A | A | A | B | A |
| | Catalyst appearance change | A | A | A | A | A |

TABLE 126

| | | Example 589 | Example 590 | Example 591 | Example 592 | Example 593 |
|---|---|---|---|---|---|---|
| Composition [Mass %] | Base oil 1 | — | — | — | — | — |
| | Base oil 2 | — | — | — | — | — |
| | Base oil 3 | 99.5 | 99.5 | 99.5 | 99.5 | 99.5 |
| | Base oil 4 | — | — | — | — | — |
| | Base oil 5 | — | — | — | — | — |
| | Base oil 6 | — | — | — | — | — |

TABLE 126-continued

| | | Example 589 | Example 590 | Example 591 | Example 592 | Example 593 |
|---|---|---|---|---|---|---|
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Refrigerant | | R407C | R407C | R407C | R407C | R407C |
| Lubrication test 3 | Abrasion loss 3 [mg] | 3.5 | 3.3 | 3.6 | 3.2 | 3.7 |
| Lubrication test 4 | Average coefficient of friction 3 | 0.105 | 0.098 | 0.107 | 0.101 | 0.105 |
| Stability test 2 | Anti-sludge property | B | A | B | A | B |
| | Catalyst appearance change | A | A | A | A | A |

TABLE 127

| | | Example 594 | Example 595 | Example 596 | Example 597 | Example 598 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | Base oil 8 | 99.5 | 99.5 | 99.5 | 99.5 | 99.5 |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Refrigerant | | $CO_2$ | $CO_2$ | $CO_2$ | $CO_2$ | $CO_2$ |
| Lubrication test 3 | Abrasion loss 3 [mg] | 3.9 | 4.0 | 3.6 | 3.9 | 3.7 |
| Lubrication test 4 | Average coefficient of friction 3 | 0.113 | 0.114 | 0.091 | 0.103 | 0.096 |
| Stability test 2 | Anti-sludge property | A | A | A | B | A |
| | Catalyst appearance change | A | A | A | A | A |

55

TABLE 128

| | | Example 599 | Example 600 | Example 601 | Example 602 | Example 603 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |

TABLE 128-continued

| | | Example 599 | Example 600 | Example 601 | Example 602 | Example 603 |
|---|---|---|---|---|---|---|
| | Base oil 7 | — | — | — | — | — |
| | Base oil 8 | 99.5 | 99.5 | 99.5 | 99.5 | 99.5 |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Refrigerant | | $CO_2$ | $CO_2$ | $CO_2$ | $CO_2$ | $CO_2$ |
| Lubrication test 3 | Abrasion loss 3 [mg] | 4.1 | 3.7 | 4.1 | 3.8 | 4.0 |
| Lubrication test 4 | Average coefficient of friction 3 | 0.104 | 0.101 | 0.107 | 0.100 | 0.111 |
| Stability test 2 | Anti-sludge property | B | A | B | A | B |
| | Catalyst appearance change | A | A | A | A | A |

TABLE 129

| | | Example 604 | Example 605 | Example 606 | Example 607 | Example 608 |
|---|---|---|---|---|---|---|
| Composition [Mass %] | Base oil 1 | — | — | — | — | — |
| | Base oil 2 | — | — | — | — | — |
| | Base oil 3 | 99.5 | 99.5 | 99.5 | 99.5 | 99.5 |
| | Base oil 4 | — | — | — | — | — |
| | Base oil 5 | — | — | — | — | — |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Refrigerant | | $CO_2$ | $CO_2$ | $CO_2$ | $CO_2$ | $CO_2$ |
| Lubrication test 3 | Abrasion loss 3 [mg] | 3.9 | 3.8 | 3.3 | 3.9 | 3.5 |
| Lubrication test 4 | Average coefficient of friction 3 | 0.120 | 0.121 | 0.099 | 0.114 | 0.105 |
| Stability test 2 | Anti-sludge property | A | A | A | B | A |
| | Catalyst appearance change | A | A | A | A | A |

TABLE 130

| | | Example 609 | Example 610 | Example 611 | Example 612 | Example 613 |
|---|---|---|---|---|---|---|
| Composition [Mass %] | Base oil 1 | — | — | — | — | — |
| | Base oil 2 | — | — | — | — | — |
| | Base oil 3 | 99.5 | 99.5 | 99.5 | 99.5 | 99.5 |
| | Base oil 4 | — | — | — | — | — |
| | Base oil 5 | — | — | — | — | — |
| | Base oil 6 | — | — | — | — | — |

TABLE 130-continued

| | | Example 609 | Example 610 | Example 611 | Example 612 | Example 613 |
|---|---|---|---|---|---|---|
| | Base oil 7 | — | — | — | — | — |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Refrigerant | | $CO_2$ | $CO_2$ | $CO_2$ | $CO_2$ | $CO_2$ |
| Lubrication test 3 | Abrasion loss 3 [mg] | 3.9 | 3.4 | 3.9 | 3.5 | 4.0 |
| Lubrication test 4 | Average coefficient of friction 3 | 0.116 | 0.110 | 0.117 | 0.111 | 0.118 |
| Stability test 2 | Anti-sludge property | B | A | B | A | B |
| | Catalyst appearance change | A | A | A | A | A |

TABLE 131

| | | Example 614 | Example 615 | Example 616 | Example 617 | Example 618 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | 99.5 | 99.5 | 99.5 | 99.5 | 99.5 |
| | Base oil 6 | — | — | — | — | — |
| | Base oil 7 | — | — | — | — | — |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Refrigerant | | $CO_2$ | $CO_2$ | $CO_2$ | $CO_2$ | $CO_2$ |
| Lubrication test 3 | Abrasion loss 3 [mg] | 3.5 | 3.3 | 2.9 | 3.2 | 3.0 |
| Lubrication test 4 | Average coefficient of friction 3 | 0.101 | 0.102 | 0.080 | 0.092 | 0.085 |
| Stability test 2 | Anti-sludge property | A | A | A | B | A |
| | Catalyst appearance change | A | A | A | A | A |

TABLE 132

| | | Example 619 | Example 620 | Example 621 | Example 622 | Example 623 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | 99.5 | 99.5 | 99.5 | 99.5 | 99.5 |
| | Base oil 6 | — | — | — | — | — |
| | Base oil 7 | — | — | — | — | — |

TABLE 132-continued

| | | Example 619 | Example 620 | Example 621 | Example 622 | Example 623 |
|---|---|---|---|---|---|---|
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Refrigerant | | $CO_2$ | $CO_2$ | $CO_2$ | $CO_2$ | $CO_2$ |
| Lubrication test 3 | Abrasion loss 3 [mg] | 3.4 | 3.1 | 3.5 | 3.2 | 3.6 |
| Lubrication test 4 | Average coefficient of friction 3 | 0.093 | 0.088 | 0.099 | 0.090 | 0.096 |
| Stability test 2 | Anti-sludge property | B | A | B | A | B |
| | Catalyst appearance change | A | A | A | A | A |

TABLE 133

| | | Example 624 | Example 625 | Example 626 | Example 627 | Example 628 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |
| | Base oil 6 | — | — | — | — | — |
| | Base oil 7 | — | — | — | — | — |
| | Base oil 8 | — | — | — | — | — |
| | Base oil 9 | 99.5 | 99.5 | 99.5 | 99.5 | 99.5 |
| | A6 | 0.5 | — | — | — | — |
| | A7 | — | 0.5 | — | — | — |
| | A8 | — | — | 0.5 | — | — |
| | A9 | — | — | — | 0.5 | — |
| | A10 | — | — | — | — | 0.5 |
| | A11 | — | — | — | — | — |
| | A12 | — | — | — | — | — |
| | A13 | — | — | — | — | — |
| | A14 | — | — | — | — | — |
| | A15 | — | — | — | — | — |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Refrigerant | | R290 | R290 | R290 | R290 | R290 |
| Lubrication test 3 | Abrasion loss 3 [mg] | 5.2 | 5.3 | 4.6 | 5.1 | 4.7 |
| Lubrication test 4 | Average coefficient of friction 3 | 0.089 | 0.103 | 0.075 | 0.094 | 0.082 |
| Stability test 2 | Anti-sludge property | A | A | A | B | A |
| | Catalyst appearance change | A | A | A | A | A |

55

TABLE 134

| | | Example 629 | Example 630 | Example 631 | Example 632 | Example 633 |
|---|---|---|---|---|---|---|
| Composition [Mass %] | Base oil 1 | — | — | — | — | — |
| | Base oil 2 | — | — | — | — | — |
| | Base oil 3 | — | — | — | — | — |
| | Base oil 4 | — | — | — | — | — |
| | Base oil 5 | — | — | — | — | — |

TABLE 134-continued

| | | Example 629 | Example 630 | Example 631 | Example 632 | Example 633 |
|---|---|---|---|---|---|---|
| | Base oil 6 | — | — | — | — | — |
| | Base oil 7 | — | — | — | — | — |
| | Base oil 8 | — | — | — | — | — |
| | Base oil 9 | 99.5 | 99.5 | 99.5 | 99.5 | 99.5 |
| | A6 | — | — | — | — | — |
| | A7 | — | — | — | — | — |
| | A8 | — | — | — | — | — |
| | A9 | — | — | — | — | — |
| | A10 | — | — | — | — | — |
| | A11 | 0.5 | — | — | — | — |
| | A12 | — | 0.5 | — | — | — |
| | A13 | — | — | 0.5 | — | — |
| | A14 | — | — | — | 0.5 | — |
| | A15 | — | — | — | — | 0.5 |
| | B2 | — | — | — | — | — |
| | B3 | — | — | — | — | — |
| | C4 | 0.5 | 0.5 | 0.5 | 0.5 | 0.5 |
| | C5 | 0.5 | 0.5 | 0.5 | 0.5 | 0.5 |
| | C3 | — | — | — | — | — |
| Refrigerant | | R290 | R290 | R290 | R290 | R290 |
| Lubrication test 3 | Abrasion loss 3 [mg] | 5.1 | 4.7 | 5.3 | 4.8 | 5.2 |
| Lubrication test 4 | Average coefficient of friction 3 | 0.106 | 0.102 | 0.111 | 0.104 | 0.111 |
| Stability test 2 | Anti-sludge property | B | A | B | A | B |
| | Catalyst appearance change | A | A | A | A | A |

The invention claimed is:

1. A refrigerating machine oil composition, comprising:

a full ester of a diol or a polyol having 3-20 hydroxyl groups with a fatty acid having 6-20 carbon atoms as a base oil;

at least one ester additive selected from propyl myristate, methyl stearate, and methyl palmitate;

at least one refrigerant selected from the group consisting of HFC refrigerants, perfluoroether, dimethyl ether, hydrocarbon, and mixtures thereof; and an epoxy compound; wherein the refrigerating machine oil composition does not comprise carbon dioxide or ammonia.

2. The refrigerating machine oil composition according to claim 1, wherein the content of said ester additive is 0.01-10 mass % based on the total amount of the composition.

3. The refrigerating machine oil composition according to claim 1, wherein said base oil comprises at least one kind selected from esters of a polyhydric alcohol and a monobasic fatty acid, and esters of an alicyclic dibasic acid and a monohydric alcohol.

4. A refrigerating machine oil composition, comprising:

a full ester of a diol or a polyol having 3-20 hydroxyl groups with a fatty acid having 6-20 carbon atoms as a base oil;

at least one oxygen-containing compound selected from the group consisting of the following (A3), and (A5):

(A3) Trihydric alcohol having 3-20 carbon atoms not including alkylene oxide adduct of a polyhydric alcohol having 3-6 hydroxyl groups, and (A5) Hydrocarbyl ether of dihydric alcohol having 2-20 carbon atoms not including polyalkylene glycol;

at least one refrigerant selected from the group consisting of HFC refrigerants, perfluoroether, dimethyl ether, hydrocarbon, and mixtures thereof; and an epoxy compound; wherein the refrigerating machine oil composition does not comprise carbon dioxide or ammonia.

5. The refrigerating machine oil composition according to claim 4, further comprising a phosphorus additive.

6. A refrigerating machine oil composition, comprising:

a full ester of a diol or a polyol having 3-20 hydroxyl groups with a fatty acid having 6-20 carbon atoms as a base oil;

at least one oxygen-containing compound selected from the group consisting of (A7) Hydrocarbyl ether of dihydric alcohol having 2-20 carbon atoms not including polyalkylene glycol; and at least one refrigerant selected from the group consisting of HFC refrigerants, perfluoroether, dimethyl ether, hydrocarbon, and mixtures thereof; wherein the refrigerating machine oil composition does not comprise carbon dioxide or ammonia.

7. The refrigerating machine oil composition according to claim 6, further comprising a phosphorus additive.

8. The refrigerating machine oil composition according to claim 6, further comprising a phosphorothionate and a phosphorus additive not including said phosphorothionate.

9. The refrigerating machine oil composition according to claim 1, further comprising a phosphorous additive.

10. A refrigerating machine fluid composition, comprising:

a full ester of a dial or a polyol having 3-20 hydroxyl groups with a fatty acid having 6-20 carbon atoms as a base oil;

at least one ester additive selected from propyl myristate, methyl stearate, and methyl palmitate;

at least one compound or additive selected from phosphorus additives and epoxy compounds; and at least one refrigerant selected from the group consisting of HFC refrigerants, perfluoroether, dimethyl ether, hydrocarbon, and mixtures thereof; wherein the refrigerating machine oil composition does not comprise carbon dioxide or ammonia.

11. A refrigerating machine fluid composition, comprising:

a full ester of a diol or a polyol having 3-20 hydroxyl groups with a fatty acid having 6-20 carbon atoms as a base oil;

at least one oxygen-containing compound selected from the group consisting of the following (A3), (A4), and (A5):

(A3) Trihydric alcohol having 3-20 carbon atoms not including alkylene oxide adduct of a polyhydric alcohol having 3-6 hydroxyl groups, (A4) Dihydric alcohol having 2-20 carbon atoms not including polyalkylene glycol, and (A5) Hydrocarbyl ether of (A4); and at least one refrigerant selected from the group consisting of HFC refrigerants, perfluoroether, dimethyl ether, hydrocarbon, and mixtures thereof; wherein the refrigerating machine oil composition does not comprise carbon dioxide or ammonia.

12. A refrigerating machine fluid composition, comprising:

a full ester of a diol or a polyol having 3-20 hydroxyl groups with a fatty acid having 6-20 carbon atoms as a base oil;

at least one oxygen-containing compound selected from the group consisting of the following (A4) and (A7):

(A4) Dihydric alcohol having 2-20 carbon atoms not including polyalkylene glycol, and (A7) Hydrocarbyl ether of (A4); and at least one refrigerant selected from the group consisting of HFC refrigerants, perfluoroether, dimethyl ether, hydrocarbon, and mixtures thereof; wherein the refrigerating machine oil composition does not comprise carbon dioxide or ammonia.

* * * * *

UNITED STATES PATENT AND TRADEMARK OFFICE

CERTIFICATE OF CORRECTION

PATENT NO. : 8,796,193 B2
APPLICATION NO. : 10/566494
DATED : August 5, 2014
INVENTOR(S) : Kazuo Tagawa et al.

It is certified that error appears in the above-identified patent and that said Letters Patent is hereby corrected as shown below:

In the Claims

Claim 10, col. 158, line 56, “dial” should read --diol--.

Signed and Sealed this
Twenty-fourth Day of February, 2015

Michelle K. Lee

Michelle K. Lee
*Deputy Director of the United States Patent and Trademark Office*